US008096892B2

(12) United States Patent
Henry et al.

(10) Patent No.: US 8,096,892 B2
(45) Date of Patent: Jan. 17, 2012

(54) CONTROL SYSTEM FOR WATER AMUSEMENT DEVICES

(75) Inventors: Jeffery W. Henry, New Braunfels, TX (US); David Mosley, Austin, TX (US)

(73) Assignee: Water Ride Concepts, Inc., New Braunfels, TX (US)

( * ) Notice: Subject to any disclaimer, the term of this patent is extended or adjusted under 35 U.S.C. 154(b) by 1192 days.

(21) Appl. No.: 11/708,644

(22) Filed: Feb. 20, 2007

(65) Prior Publication Data

US 2008/0032806 A1 Feb. 7, 2008

Related U.S. Application Data

(63) Continuation of application No. 10/105,865, filed on Mar. 25, 2002, now Pat. No. 7,179,173.

(51) Int. Cl.
*A63H 23/10* (2006.01)
*A63H 23/00* (2006.01)

(52) U.S. Cl. ..... 472/128

(58) Field of Classification Search ..... 472/13, 472/116, 117, 128, 129; 446/153–159, 175, 446/484

See application file for complete search history.

(56) References Cited

U.S. PATENT DOCUMENTS

| | | | |
|---|---|---|---|
| 142,605 | A | 9/1873 | Yates |
| 193,516 | A | 7/1877 | Johns |
| 206,387 | A | 7/1878 | Bowen |
| 419,860 | A | 1/1890 | Libbey |
| 435,227 | A | 8/1890 | Inglis |
| 485,624 | A | 11/1892 | Gardner |
| 536,441 | A | 3/1895 | Morris |
| 540,715 | A | 6/1895 | Butler |
| 548,256 | A | 10/1895 | Idler |
| 552,713 | A | 1/1896 | Lenox |
| 555,049 | A | 2/1896 | Ogilbe |
| 566,182 | A | 8/1896 | Jackman |
| 567,861 | A | 9/1896 | Mustain |
| 570,016 | A | 10/1896 | Harman |
| 572,426 | A | 12/1896 | Idler |
| 576,704 | A | 2/1897 | Urch |
| 583,121 | A | 5/1897 | Pattee |

(Continued)

FOREIGN PATENT DOCUMENTS

| | | |
|---|---|---|
| BG | 543055 | 12/1955 |

(Continued)

OTHER PUBLICATIONS

International Search Report for PCT/US01/28542 mailed Mar. 27, 2002.

(Continued)

*Primary Examiner* — Kien Nguyen
(74) *Attorney, Agent, or Firm* — Meyertons, Hood, Kivlin, Kowert & Goetzel, P.C.; Eric B. Meyertons

(57) ABSTRACT

A control system for a water amusement system is described. The control system is configured to operate the water amusement system to produce water effects, sound effects, and/or light effects when the control system receives an activation signal. The activation signal may be sent to the control system by an activation point, such as an optical touch button, or a water target. The control system is further configured to produce water effects, sound effects, and/or light effects in the absence of an activation signal to attract participants to the water amusement system.

11 Claims, 26 Drawing Sheets

U.S. PATENT DOCUMENTS

| | | | |
|---|---|---|---|
| 604,164 | A | 5/1898 | Wilde et al. |
| 610,548 | A | 9/1898 | Manny |
| 640,439 | A | 1/1900 | Boyton |
| 654,980 | A | 7/1900 | Howard |
| 664,179 | A | 12/1900 | Schofield |
| 665,765 | A | 1/1901 | Thompson |
| 689,114 | A | 12/1901 | Pape |
| 691,353 | A | 1/1902 | Carpenter et al. |
| 697,202 | A | 4/1902 | Donne |
| 697,891 | A | 4/1902 | Schrader |
| 706,821 | A | 8/1902 | Hart |
| 714,717 | A | 12/1902 | LaPorte |
| 720,014 | A | 2/1903 | Folks |
| 724,040 | A | 3/1903 | Pusterla |
| 724,757 | A | 4/1903 | Symonds |
| 728,246 | A | 5/1903 | Kremer |
| 728,303 | A | 5/1903 | Roltair |
| 728,894 | A | 5/1903 | Folks |
| 741,964 | A | 10/1903 | Harlan |
| 743,968 | A | 11/1903 | Wilson |
| 744,880 | A | 11/1903 | Smith |
| 753,311 | A | 3/1904 | Pusterla |
| 753,449 | A | 3/1904 | Thompson |
| 754,698 | A | 3/1904 | Reed |
| 757,286 | A | 4/1904 | Du Clos |
| 760,503 | A | 5/1904 | Welsh |
| 762,566 | A | 6/1904 | Webster et al. |
| 764,675 | A | 7/1904 | Pfeiffer |
| 771,322 | A | 10/1904 | Pattee |
| 774,209 | A | 11/1904 | Stubbs |
| 774,274 | A | 11/1904 | Pusterla |
| 774,917 | A | 11/1904 | Maguire |
| 776,936 | A | 12/1904 | Pusterla |
| 779,464 | A | 1/1905 | Bruce |
| 783,425 | A | 2/1905 | Folks |
| 792,422 | A | 6/1905 | Kelly |
| 801,945 | A | 10/1905 | Welsh |
| 803,465 | A | 10/1905 | Bemheisel |
| 808,487 | A | 12/1905 | Stahl |
| 815,210 | A | 3/1906 | Pattee |
| 815,211 | A | 3/1906 | Fraser |
| 824,436 | A | 6/1906 | Pester |
| 828,689 | A | 8/1906 | Thompson |
| 831,149 | A | 9/1906 | Faller |
| 849,970 | A | 4/1907 | Boyton |
| 868,736 | A | 10/1907 | Washington |
| 869,432 | A | 10/1907 | Gin |
| 879,283 | A | 2/1908 | Mayberry et al. |
| 883,441 | A | 3/1908 | Andrews |
| 887,082 | A | 5/1908 | Fraser |
| 891,388 | A | 6/1908 | Visser et al. |
| 896,940 | A | 8/1908 | Rosen |
| 901,435 | A | 10/1908 | Fuller |
| 904,848 | A | 11/1908 | DeVore |
| 929,972 | A | 8/1909 | M'Giehan |
| 931,863 | A | 8/1909 | Haight |
| 944,407 | A | 12/1909 | Beebe |
| 952,673 | A | 3/1910 | Karr |
| 995,945 | A | 6/1911 | Berhold |
| 1,004,174 | A | 9/1911 | Kavakos |
| 1,056,929 | A | 3/1913 | Navarro |
| 1,062,838 | A | 5/1913 | Miller |
| 1,063,949 | A | 6/1913 | Bedient |
| 1,095,965 | A | 5/1914 | Glazier |
| 1,124,950 | A | 1/1915 | Reagen et al. |
| 1,158,295 | A | 10/1915 | Rodriguez |
| 1,159,519 | A | 11/1915 | Menier |
| 1,167,993 | A | 1/1916 | Guzendorfer |
| 1,195,707 | A | 8/1916 | Miller |
| 1,198,749 | A | 9/1916 | Myers |
| 1,230,559 | A | 6/1917 | Burke |
| 1,249,455 | A | 12/1917 | Myers |
| 1,266,749 | A | 5/1918 | Abbott |
| 1,320,124 | A | 10/1919 | Chrul |
| 1,378,635 | A | 5/1921 | Unger |
| 1,399,469 | A | 12/1921 | Cucullu |
| 1,417,570 | A | 5/1922 | Ridgway |
| 1,440,661 | A | 1/1923 | Dickinson |
| 1,441,126 | A | 1/1923 | Sherman et al. |
| 1,448,306 | A | 3/1923 | Lezert |
| 1,497,754 | A | 6/1924 | Howard |
| 1,520,217 | A | 12/1924 | Auperl |
| 1,540,635 | A | 6/1925 | Kohl |
| 1,551,249 | A | 8/1925 | Held |
| 1,555,475 | A | 9/1925 | Maunz |
| 1,563,855 | A | 12/1925 | Held |
| 1,591,566 | A | 6/1926 | Schmidt et al. |
| 1,601,483 | A | 9/1926 | Vaszin |
| 1,606,024 | A | 11/1926 | Gorhum et al. |
| 1,606,854 | A | 11/1926 | Vaszin |
| 1,607,771 | A | 11/1926 | Miller |
| 1,609,922 | A | 12/1926 | Wiig |
| 1,648,196 | A | 11/1927 | Rohmer |
| 1,763,976 | A | 6/1930 | Lippincott |
| 1,783,268 | A | 12/1930 | Traver |
| 1,849,226 | A | 3/1932 | Erban |
| 1,859,267 | A | 5/1932 | Kurz |
| 1,893,167 | A | 1/1933 | Glagolin |
| 1,926,780 | A | 9/1933 | Lippincott |
| 2,009,904 | A | 7/1935 | Purves |
| 2,064,035 | A | 12/1936 | Rynearson |
| 2,135,230 | A | 11/1938 | Courtney |
| 2,146,631 | A | 2/1939 | Kish |
| 2,484,466 | A | 3/1946 | Rumler |
| 2,498,450 | A | 2/1950 | Pewitt |
| 2,499,470 | A | 3/1950 | Duncan |
| 2,535,862 | A | 12/1950 | Pewitt |
| 2,651,143 | A | 9/1953 | Esmay et al. |
| 2,705,144 | A | 3/1955 | Ridgway |
| 2,738,885 | A | 3/1956 | Demaline |
| 2,794,191 | A | 6/1957 | Gaskouitz |
| 2,837,866 | A | 6/1958 | Esmay et al. |
| 2,838,022 | A | 6/1958 | Wilson |
| 2,888,205 | A | 5/1959 | Trucco |
| 3,007,282 | A | 5/1959 | Galesky |
| 3,000,022 | A | 7/1959 | Cathey et al. |
| 2,900,759 | A | 8/1959 | Hutchinson |
| 2,941,331 | A | 6/1960 | Ottolini |
| D190,127 | S | 4/1961 | Fowler |
| 2,991,726 | A | 6/1961 | Miller |
| 3,000,017 | A | 9/1961 | Skovira |
| 3,003,430 | A | 10/1961 | Hamel |
| 3,011,280 | A | 12/1961 | Keidd |
| 3,030,895 | A | 4/1962 | Hamel |
| 3,066,951 | A | 12/1962 | Gray |
| 3,113,528 | A | 12/1963 | Morgan et al. |
| 3,114,333 | A | 12/1963 | Fowler et al. |
| 3,116,925 | A | 1/1964 | Welch |
| 3,152,002 | A | 10/1964 | Wisotzky et al. |
| D204,282 | S | 4/1966 | Morgan |
| 3,299,565 | A | 1/1967 | Yarashes |
| 3,302,413 | A | 2/1967 | Burnett |
| 3,340,635 | A | 9/1967 | McIntosh |
| 3,390,640 | A | 7/1968 | Couttet et al. |
| 3,404,635 | A | 10/1968 | Bacon et al. |
| 3,410,420 | A | 11/1968 | Butts |
| 3,456,943 | A | 7/1969 | Brown |
| 3,473,334 | A | 10/1969 | Dexter |
| 3,507,222 | A | 4/1970 | Cirami |
| 3,508,405 | A | 4/1970 | Koch |
| 3,534,413 | A | 10/1970 | Plasseraud |
| 3,598,402 | A | 8/1971 | Frenzl |
| 3,610,160 | A | 10/1971 | Alimanestianu |
| 3,610,527 | A | 10/1971 | Ericson et al. |
| 3,675,259 | A | 7/1972 | Gilchrist |
| 3,676,208 | A | 7/1972 | Griffin |
| 3,690,265 | A | 9/1972 | Horibata |
| 3,717,897 | A | 2/1973 | Amos et al. |
| 3,730,520 | A | 5/1973 | Willis |
| D229,354 | S | 11/1973 | Morgan |
| 3,777,835 | A | 12/1973 | Bourne |
| 3,779,201 | A | 12/1973 | Spahn |
| 3,801,347 | A | 4/1974 | Keller |
| 3,806,156 | A | 4/1974 | Tidwell |
| 3,816,234 | A | 6/1974 | Winfield |
| 3,827,387 | A | 8/1974 | Morgan |
| 3,829,349 | A | 8/1974 | Hermanson |

3,830,161 A 8/1974 Bacon
3,838,648 A 10/1974 Dahlberg et al.
3,841,023 A 10/1974 Carlyon
3,853,067 A 12/1974 Bacon
3,861,514 A 1/1975 Ling
3,865,041 A 2/1975 Bacon
3,890,655 A 6/1975 Mathis
3,892,899 A 7/1975 Klein
3,913,332 A 10/1975 Forsman
3,923,301 A 12/1975 Myers
3,930,450 A 1/1976 Symons
3,934,291 A 1/1976 Hagen
3,945,972 A 3/1976 Sakamoto
3,956,779 A 5/1976 Jewett
4,001,899 A 1/1977 Mathis
4,042,252 A 8/1977 Winter
4,063,517 A 12/1977 Nardozzi
4,073,722 A 2/1978 Grutsch et al.
4,087,870 A 5/1978 Palmer
4,108,813 A 8/1978 Roberts
4,141,187 A 2/1979 Graves
4,145,770 A 3/1979 Zaris
4,147,635 A 4/1979 Crowe
4,149,469 A 4/1979 Bigler
4,149,710 A 4/1979 Rouchard
4,170,943 A 10/1979 Achrekar
4,175,361 A 11/1979 Kumode
4,189,548 A 2/1980 Sakashita et al.
4,194,733 A 3/1980 Whitehouse
4,196,900 A 4/1980 Becker et al.
4,198,043 A 4/1980 Timbes et al.
4,205,785 A 6/1980 Stanley
4,221,170 A 9/1980 Koudelka
4,225,953 A 9/1980 Simon et al.
4,272,093 A 6/1981 Filice et al.
4,278,247 A 7/1981 Joppe et al.
4,299,171 A 11/1981 Larson
4,305,117 A 12/1981 Evans
4,337,704 A 7/1982 Becker et al.
4,348,233 A 9/1982 Simic
4,376,404 A 3/1983 Haddad
D269,082 S 5/1983 Spieldiener
4,386,480 A 6/1983 Horowitz
4,391,201 A 7/1983 Bailey
4,392,434 A 7/1983 Durwald et al.
4,423,864 A 1/1984 Wiik
4,429,867 A 2/1984 Barber
4,477,610 A 10/1984 Ishimura et al.
4,484,739 A 11/1984 Kreinbihl et al.
4,484,836 A 11/1984 Bailard
4,501,434 A 2/1985 Dupuis
4,501,783 A 2/1985 Hiragami et al.
4,516,943 A 5/1985 Spieldiener et al.
4,543,886 A 10/1985 Spieldiener et al.
4,545,574 A 10/1985 Sassak
4,545,583 A 10/1985 Pearman et al.
4,557,634 A 12/1985 Vidal
4,558,474 A 12/1985 Bastenhof
4,564,190 A 1/1986 Frenzl
4,576,512 A 3/1986 Combes et al.
4,607,078 A 8/1986 Dergazarian
4,624,618 A 11/1986 LaBerdia et al.
4,683,686 A 8/1987 Ozdemir
4,695,058 A 9/1987 Carter et al.
4,696,251 A 9/1987 Spieldiener et al.
4,706,307 A 11/1987 Smith
4,716,854 A 1/1988 Bourdon
4,741,388 A 5/1988 Kuroiwa
4,758,934 A 7/1988 Von Kohorn
4,759,545 A 7/1988 Grable
4,778,430 A 10/1988 Goldfarb et al.
4,783,861 A 11/1988 Leurent
4,792,260 A 12/1988 Sauerbier
4,797,027 A 1/1989 Combes et al.
4,797,605 A 1/1989 Palanisamy
4,805,896 A 2/1989 Moody
4,805,897 A 2/1989 Dubeta
4,817,312 A 4/1989 Fuller et al.
4,836,521 A 6/1989 Barber
4,850,896 A 7/1989 Smith et al.
4,854,256 A 8/1989 Hayashi
4,855,167 A 8/1989 Biehl
4,876,828 A 10/1989 Brill
4,882,205 A 11/1989 Valenduc
4,905,987 A 3/1990 Frenzi
4,910,814 A 3/1990 Weiner
4,939,358 A 7/1990 Herman et al.
4,954,014 A 9/1990 Sauerbier et al.
4,960,275 A 10/1990 Magon
4,960,375 A 10/1990 Saito et al.
4,962,922 A 10/1990 Chu
4,963,057 A 10/1990 Fournier
4,979,679 A 12/1990 Downs
4,984,783 A 1/1991 Fujimaki
4,986,784 A 1/1991 French
5,011,134 A 4/1991 Langford
5,011,161 A 4/1991 Galphin
5,020,465 A 6/1991 Langford
5,022,588 A 6/1991 Haase
5,031,356 A 7/1991 Thomsen
5,033,392 A 7/1991 Schemitsch
5,069,387 A 12/1991 Alba
5,069,443 A 12/1991 Shiratori
5,073,082 A 12/1991 Radlik
5,092,268 A 3/1992 Taylor
5,110,657 A 5/1992 Ainslie
5,115,908 A 5/1992 Williams
5,118,196 A 6/1992 Ault et al.
5,137,497 A 8/1992 Dubeta
5,143,107 A 9/1992 Kelley
5,149,314 A 9/1992 Ciolino et al.
D330,579 S 10/1992 Briggs
5,152,210 A 10/1992 Chen
5,156,195 A 10/1992 Wehler et al.
5,167,321 A 12/1992 Brodrick, Sr.
5,171,101 A 12/1992 Sauerbier et al.
5,172,517 A 12/1992 Thomsen
5,183,437 A 2/1993 Millay et al.
5,194,048 A 3/1993 Briggs
5,213,547 A 5/1993 Lochtefeld
5,218,910 A 6/1993 Mesmer et al.
5,219,315 A 6/1993 Fuller et al.
5,224,652 A 7/1993 Kessler
5,230,662 A 7/1993 Langford
5,236,280 A 8/1993 Lochtefeld
5,243,782 A 9/1993 Jones
RE34,407 E 10/1993 Frenzl
5,253,864 A 10/1993 Heege et al.
5,265,373 A 11/1993 Vollebregt
5,265,802 A 11/1993 Hobbs et al.
5,271,692 A 12/1993 Lochtefeld
5,299,964 A 4/1994 Hopkins
5,320,362 A 6/1994 Bear et al.
5,323,307 A 6/1994 Wolf et al.
5,378,197 A 1/1995 Briggs
5,387,158 A 2/1995 Bertrand
5,393,170 A 2/1995 Lochtefeld
5,401,117 A 3/1995 Lochtefeld
5,403,238 A 4/1995 Baxter et al.
5,405,294 A 4/1995 Briggs
5,413,454 A 5/1995 Movsesian
5,421,451 A 6/1995 Easton
5,421,782 A 6/1995 Lochtefeld
5,426,899 A 6/1995 Jones
5,427,574 A 6/1995 Donnelly
5,433,671 A 7/1995 Davis
5,437,463 A 8/1995 Fromm
5,439,170 A 8/1995 Dach
5,450,691 A 9/1995 Christie et al.
5,452,678 A 9/1995 Simpkins
5,453,054 A 9/1995 Langford
5,461,876 A 10/1995 Dressler
5,473,233 A 12/1995 Stull et al.
5,477,750 A 12/1995 Korzan
5,478,281 A 12/1995 Forton
5,480,148 A 1/1996 Bartosik
5,482,510 A 1/1996 Ishii et al.
5,494,729 A 2/1996 Henry et al.

5,499,821 A 3/1996 Rycroft
5,503,597 A 4/1996 Lochtefeld et al.
5,513,470 A 5/1996 Vollebregt
5,536,210 A 7/1996 Barber
5,540,622 A 7/1996 Gold et al.
5,555,676 A 9/1996 Lund
5,558,604 A 9/1996 Hopkins
5,564,859 A 10/1996 Lochtefeld
5,564,984 A 10/1996 Mirabella et al.
5,570,480 A 11/1996 Yeung
5,577,344 A 11/1996 Zaremba et al.
5,581,954 A 12/1996 Vollebregt
5,613,443 A 3/1997 Ariga et al.
5,615,887 A 4/1997 Park
5,623,986 A 4/1997 Wiggs
5,628,584 A 5/1997 Lochtefeld
5,649,867 A 7/1997 Briggs
5,662,525 A 9/1997 Briggs
5,664,910 A 9/1997 Lochtefeld et al.
5,667,445 A 9/1997 Lochtefeld
5,669,858 A 9/1997 Blair et al.
5,678,956 A 10/1997 Freelain
5,685,778 A 11/1997 Sheldon et al.
5,690,582 A 11/1997 Ulrich et al.
5,698,839 A 12/1997 Jagielinski et al.
5,704,294 A 1/1998 Van et al.
5,715,773 A 2/1998 Martelius
5,716,282 A 2/1998 Ring et al.
5,722,874 A 3/1998 Horton et al.
5,724,768 A 3/1998 Ammann
5,732,635 A 3/1998 McKoy
5,735,742 A 4/1998 French
5,735,748 A 4/1998 Meyers et al.
5,738,590 A 4/1998 Lochtefeld
5,741,189 A 4/1998 Briggs
5,755,749 A * 5/1998 Sakano ..... 607/73
5,761,776 A 6/1998 Vollebregt
5,762,024 A 6/1998 Meilahn
5,765,314 A 6/1998 Giglio et al.
5,766,082 A 6/1998 Lochtefeld et al.
5,779,553 A 7/1998 Langford
5,785,592 A 7/1998 Jacobsen
5,791,254 A 8/1998 Mares et al.
5,809,701 A 9/1998 Vollebregt
5,813,952 A 9/1998 Lochbaum
5,816,314 A 10/1998 Wiggs et al.
5,820,471 A 10/1998 Briggs
5,820,472 A 10/1998 Briggs
D403,392 S 12/1998 Briggs et al.
5,853,332 A 12/1998 Briggs
5,860,364 A 1/1999 McKoy
5,860,766 A 1/1999 Lochtefeld et al.
5,864,623 A 1/1999 Messina et al.
5,865,680 A 2/1999 Briggs
5,872,594 A 2/1999 Thompson
D406,871 S 3/1999 Briggs
D407,133 S 3/1999 Briggs
5,899,633 A 5/1999 Lochtefeld
5,899,634 A 5/1999 Lochtefeld
5,902,983 A 5/1999 Crevelt et al.
5,911,190 A 6/1999 Lochtefeld et al.
5,921,892 A 7/1999 Easton
5,923,364 A 7/1999 Rhodes et al.
5,927,478 A 7/1999 Archer
D413,957 S 9/1999 Briggs
5,949,044 A 9/1999 Walker et al.
5,950,253 A 9/1999 Last
5,967,901 A 10/1999 Briggs
D416,066 S 11/1999 Briggs
5,978,593 A 11/1999 Sexton
5,989,126 A 11/1999 Kilbert et al.
6,006,672 A 12/1999 Newfarmer et al.
6,012,832 A 1/2000 Saunders et al.
D421,283 S 2/2000 Briggs et al.
6,019,374 A 2/2000 Breeding
6,036,603 A 3/2000 Mason et al.
6,045,449 A 4/2000 Aragona et al.
6,075,442 A 6/2000 Welch
6,083,110 A 7/2000 Kitchen et al.
6,089,987 A 7/2000 Briggs
6,092,332 A 7/2000 Roess et al.
6,105,527 A 8/2000 Lochtefeld et al.
6,113,506 A 9/2000 Nielsen
6,115,974 A 9/2000 Milanian
6,132,317 A 10/2000 Lochtefeld
6,132,318 A 10/2000 Briggs
6,139,382 A 10/2000 Eschbacher et al.
6,146,282 A 11/2000 McCready et al.
6,161,771 A 12/2000 Henry
6,162,127 A 12/2000 Ochi
6,174,242 B1 * 1/2001 Briggs et al. ..... 472/136
6,178,692 B1 1/2001 Graven
6,183,362 B1 2/2001 Boushy
6,186,902 B1 2/2001 Briggs
6,195,851 B1 3/2001 Vollebregt et al.
6,206,782 B1 3/2001 Walker et al.
6,210,287 B1 4/2001 Briggs
6,231,451 B1 5/2001 Briggs
6,234,900 B1 5/2001 Cumbers
6,237,499 B1 5/2001 McKoy
6,258,037 B1 7/2001 Dowling
6,261,186 B1 7/2001 Henry
6,264,202 B1 7/2001 Briggs
6,265,977 B1 7/2001 Vega et al.
6,269,588 B1 8/2001 Ito
6,272,695 B1 8/2001 Brandner
6,276,353 B1 8/2001 Briggs et al.
6,280,326 B1 8/2001 Saunders
6,280,328 B1 8/2001 Holch et al.
6,280,342 B1 8/2001 Tod
6,283,871 B1 9/2001 Briggs
6,285,021 B1 * 9/2001 Fayfield ..... 250/221
6,286,266 B1 9/2001 Popowych et al.
6,302,793 B1 10/2001 Fertitta et al.
6,319,137 B1 11/2001 Lochtefeld
6,320,495 B1 11/2001 Spogis
6,336,771 B1 1/2002 Hill
6,340,331 B1 1/2002 Saunders et al.
6,347,738 B1 2/2002 Crevelt et al.
6,354,955 B1 3/2002 Stuart et al.
6,362,778 B2 3/2002 Neher
6,371,717 B1 4/2002 Grams et al.
6,375,578 B1 * 4/2002 Briggs ..... 472/117
6,384,409 B1 5/2002 Libbey et al.
6,409,595 B1 6/2002 Uihlein et al.
6,413,191 B1 7/2002 Harris et al.
6,424,264 B1 7/2002 Giraldin et al.
6,443,849 B1 9/2002 Byrd
6,460,201 B1 10/2002 Lochtefeld
6,460,852 B1 10/2002 Tallian
6,463,416 B1 10/2002 Messina
6,471,590 B2 10/2002 Saunders
6,474,557 B2 11/2002 Mullins et al.
6,475,088 B1 11/2002 Jones et al.
6,475,095 B1 11/2002 Henry
6,485,368 B2 11/2002 Jones et al.
6,488,590 B2 12/2002 Katayama
6,491,589 B1 12/2002 Lochtefeld
6,503,146 B2 1/2003 Walker et al.
6,508,710 B1 1/2003 Paravia et al.
6,511,377 B1 1/2003 Weiss
6,513,284 B1 2/2003 Sandlin
6,520,853 B2 2/2003 Suzuki
6,526,158 B1 2/2003 Goldberg
6,527,646 B1 3/2003 Briggs
6,533,191 B1 3/2003 Berger et al.
6,539,101 B1 3/2003 Black
6,540,609 B1 4/2003 Paige
6,547,131 B1 4/2003 Foodman et al.
6,547,664 B2 4/2003 Saunders
6,553,336 B1 4/2003 Johnson et al.
6,554,534 B1 4/2003 Butterfield
6,554,705 B1 4/2003 Cumbers
6,558,256 B1 5/2003 Saunders
6,561,914 B2 5/2003 Henry
6,569,023 B1 5/2003 Briggs
6,579,175 B2 6/2003 Suzuki
6,595,857 B2 7/2003 Soltys et al.

6,601,771 B2 8/2003 Charrin
6,604,327 B1 8/2003 Reville
6,605,044 B2 8/2003 Bimbaum
6,608,563 B2 8/2003 Weston et al.
6,629,019 B2 9/2003 Legge et al.
6,634,942 B2 10/2003 Walker et al.
6,634,949 B1 10/2003 Briggs et al.
6,651,268 B1 11/2003 Briggs
6,663,006 B2 12/2003 Mullins et al.
6,663,490 B2 12/2003 Soltys et al.
6,676,530 B2 1/2004 Lochtefeld
6,678,401 B2 1/2004 Jones et al.
6,699,124 B2 3/2004 Suchocki
6,702,687 B1 3/2004 Henry
6,708,706 B1 3/2004 Robinson
6,712,696 B2 3/2004 Soltys et al.
6,716,107 B2 4/2004 Lochtefeld
6,722,985 B2 4/2004 Criss et al.
6,729,956 B2 5/2004 Wolf et al.
6,729,959 B1 5/2004 Moore et al.
6,738,992 B2 5/2004 Lochtefeld
6,743,098 B2 6/2004 Urie et al.
6,747,562 B2 6/2004 Giraldin et al.
6,755,741 B1 6/2004 Rafaeli
6,758,231 B1 7/2004 Lochtefeld et al.
6,758,751 B2 7/2004 Soltys et al.
6,761,637 B2 7/2004 Weston et al.
6,773,355 B1 8/2004 Lekhtman
6,776,715 B2 8/2004 Price
6,786,824 B2 9/2004 Cannon
6,786,830 B2 9/2004 Briggs et al.
6,789,608 B1 9/2004 Wiggs
6,796,492 B1 9/2004 Gatto
6,796,908 B2 9/2004 Weston
6,811,486 B1 11/2004 Luciano
6,811,488 B2 11/2004 Paravia et al.
6,814,667 B2 11/2004 Jeffway et al.
6,825,766 B2 11/2004 Hewitt et al.
6,830,146 B1 12/2004 Scully et al.
6,832,958 B2 12/2004 Acres et al.
6,843,412 B1 1/2005 Sanford
6,848,994 B1 2/2005 Knust et al.
6,851,607 B2 2/2005 Orus et al.
6,890,260 B2 5/2005 Ollins
6,892,182 B1 5/2005 Rowe et al.
6,896,616 B2 5/2005 Weiss
6,896,619 B2 5/2005 Baltz et al.
6,898,299 B1 5/2005 Brooks
6,928,670 B2 8/2005 Lochtefeld et al.
6,957,662 B2 10/2005 Lochtefeld et al.
6,976,434 B2 12/2005 Roig et al.
7,004,847 B2 2/2006 Henry
7,029,400 B2 4/2006 Briggs
7,040,994 B2 5/2006 Lochtefeld et al.
7,055,282 B2 6/2006 Bryan
RE39,171 E 7/2006 Lochtefeld
7,179,173 B2 2/2007 Henry et al.
7,218,231 B2 5/2007 Higham
7,229,359 B2 6/2007 Henry et al.
7,263,805 B2 9/2007 Chapus
7,278,028 B1 10/2007 Hingoranee
7,285,053 B2 10/2007 Henry et al.
7,370,208 B2 5/2008 Levin et al.
7,371,182 B2 5/2008 Henry et al.
7,371,183 B2 5/2008 Henry et al.
7,401,786 B2 7/2008 Lochtefeld
7,445,550 B2 11/2008 Barney et al.
7,491,128 B2 2/2009 Henry et al.
7,497,784 B2 3/2009 Henry
7,597,630 B2 10/2009 Henry
7,727,077 B2 6/2010 Henry et al.
7,740,542 B2 6/2010 Henry et al.
7,752,815 B2 7/2010 Lauria et al.
7,758,435 B2 7/2010 Henry et al.
7,762,899 B2 7/2010 Henry et al.
7,762,900 B2 7/2010 Henry et al.
7,766,753 B2 8/2010 Henry et al.
7,775,894 B2 8/2010 Henry et al.
7,775,895 B2 8/2010 Henry et al.
7,775,896 B2 8/2010 Henry et al.
7,780,536 B2 8/2010 Henry et al.
7,785,207 B2 8/2010 Henry et al.
7,811,177 B2 10/2010 Henry et al.
7,815,514 B2 10/2010 Henry et al.
7,828,667 B2 11/2010 Henry et al.
7,850,527 B2 12/2010 Barney et al.
7,857,704 B2 12/2010 Henry et al.
7,921,601 B2 4/2011 Henry et al.
7,942,752 B2 5/2011 Henry
2002/0072317 A1 6/2002 Livingston et al.
2002/0082097 A1 6/2002 Henry et al.
2002/0180155 A1 12/2002 Lochtefeld
2003/0031547 A1 2/2003 Stumvoll et al.
2003/0139218 A1 7/2003 Hlynka
2003/0190967 A1 10/2003 Henry
2003/0203760 A1 10/2003 Henry et al.
2004/0033833 A1 2/2004 Briggs et al.
2004/0077423 A1 4/2004 Weston et al.
2004/0197221 A1 10/2004 Stanley
2005/0034768 A1 2/2005 Lochtefeld et al.
2005/0047869 A1 3/2005 Lochtefeld
2005/0085306 A1 4/2005 Henry et al.
2005/0090318 A1 4/2005 Henry et al.
2005/0090319 A1 4/2005 Henry et al.
2005/0090320 A1 4/2005 Henry et al.
2005/0090321 A1 4/2005 Henry et al.
2005/0090322 A1 4/2005 Henry et al.
2005/0143173 A1 6/2005 Barney et al.
2005/0148398 A1 7/2005 Lochtefeld
2005/0286976 A1 12/2005 Lochtefeld et al.
2005/0288111 A1 12/2005 Cowan et al.
2006/0052171 A1 3/2006 Henry et al.
2006/0111195 A1 5/2006 Henry
2006/0111196 A1 5/2006 Henry
2006/0135274 A1 6/2006 Henry
2006/0142090 A1 6/2006 Henry
2006/0154726 A1 7/2006 Weston et al.
2006/0178222 A1 8/2006 Henry et al.
2006/0214805 A1 9/2006 Boujon
2006/0229134 A1 10/2006 Briggs et al.
2006/0258471 A1 11/2006 Briggs et al.
2006/0260697 A1 11/2006 Lochtefeld et al.
2006/0287030 A1 12/2006 Briggs et al.
2007/0033866 A1 2/2007 Henry
2007/0033867 A1 2/2007 Henry
2007/0033868 A1 2/2007 Henry
2007/0049385 A1 3/2007 Henry
2007/0049386 A1 3/2007 Henry
2007/0049387 A1 3/2007 Henry
2007/0049388 A1 3/2007 Henry
2007/0051036 A1 3/2007 Henry
2007/0051037 A1 3/2007 Henry
2007/0051038 A1 3/2007 Henry
2007/0051039 A1 3/2007 Henry
2007/0054745 A1 3/2007 Henry et al.
2007/0060402 A1 3/2007 Henry
2007/0060403 A1 3/2007 Henry
2007/0060404 A1 3/2007 Henry et al.
2007/0066396 A1 3/2007 Weston et al.
2007/0066410 A1 3/2007 Henry
2007/0078016 A1 4/2007 Henry et al.
2007/0087849 A1 4/2007 Henry et al.
2007/0087850 A1 4/2007 Henry et al.
2007/0087851 A1 4/2007 Henry et al.
2007/0087852 A1 4/2007 Henry et al.
2007/0087853 A1 4/2007 Henry et al.
2007/0087854 A1 4/2007 Henry et al.
2007/0197304 A1 8/2007 Henry et al.
2007/0199722 A1 8/2007 Bridge
2007/0219004 A1 9/2007 Henry et al.
2007/0249425 A1 10/2007 Weston et al.
2008/0014835 A1 1/2008 Weston et al.
2008/0021776 A1 1/2008 Lochtefeld
2008/0216427 A1 9/2008 Lochtefeld
2010/0160054 A1 6/2010 Henry
2011/0014988 A1 1/2011 Henry et al.
2011/0118039 A1 5/2011 Henry et al.

FOREIGN PATENT DOCUMENTS

| | | | |
|---|---|---|---|
| DE | 129145 | | 3/1902 |
| DE | 893778 | | 10/1953 |
| DE | 4239303 | A1 | 5/1994 |
| DE | 4243812 | A1 | 6/1994 |
| EP | 1604712 | | 12/2005 |
| WO | 92/03201 | | 3/1992 |
| WO | 92/04087 | | 3/1992 |
| WO | 97/33668 | | 9/1997 |
| WO | WO 98/45006 | | 10/1998 |
| WO | 01/10184 | | 2/2001 |
| WO | 02/22226 | | 3/2002 |
| WO | 02/22227 | | 3/2002 |
| WO | 2005/042124 | | 5/2005 |
| WO | 2006/057970 | | 6/2006 |
| WO | 2006/113936 | | 10/2006 |
| WO | 2007/019278 | | 2/2007 |
| WO | 2007/027841 | | 3/2007 |
| WO | 2007/028040 | | 3/2007 |
| WO | 2007/028042 | | 3/2007 |
| WO | 2007/028043 | | 3/2007 |
| WO | 2007/035524 | | 3/2007 |
| WO | 2007/106717 | | 9/2007 |

OTHER PUBLICATIONS

"Classic PLC-5 Programmable Controllers", Dec. 1994, Product informational material, Allen-Bradley Company Inc. 12 pages.
SmartToy™ Systems promotional material, Jan. 2002, 4 pages.
OPTO-TOUCH OTB Series informational material, Jan. 2002, 4 pages.
Co-Pending U.S. Appl. No. 11/364,896 entitled, "Water Amusement System and Method" to Henry filed Feb. 28, 2006.
Engineering drawing (as well as photographs of the finished product) for the Silver Dollar City water slide in Branson, Missouri, the date is unknown, however there is a 1986 copyright on the engineering drawing.
Office Action for U.S. Appl. No. 10/693,654 mailed on Dec. 7, 2004.
Office Action for U.S. Appl. No. 10/693,654 mailed on Jun. 10, 2005.
Office Action for U.S. Appl. No. 10/985,178 mailed on Apr. 20, 2005.
Office Action for U.S. Appl. No. 10/985,178 mailed on Oct. 3, 2005.
Office Action for U.S. Appl. No. 10/985,178 mailed on May 18, 2006.
Office Action for U.S. Appl. No. 10/985,178 mailed on Feb. 20, 2007.
Examiner's Answer to Applicant's Appeal Brief for U.S. Appl. No. 10/985,178 mailed on May 23, 2008.
Office Action for U.S. Appl. No. 10/987,727 mailed on Feb. 20, 2007.
Office Action for U.S. Appl. No. 10/987,727 mailed on Sep. 13, 2007.
Office Action for U.S. Appl. No. 10/987,727 mailed on Apr. 1, 2008.
Office Action for U.S. Appl. No. 10/987,727 mailed on Sep. 11, 2008.
Office Action for U.S. Appl. No. 10/987,727 mailed on May 28, 2009.
Office Action for U.S. Appl. No. 10/987,727 mailed on Sep. 17, 2009.
International Search Report and Written Opinion for PCT/US04/35089 mailed Jul. 31, 2008.
International Preliminary Examination Report for PCT/US04/35089 mailed Feb. 19, 2009.
Examiner's Report for Australian Patent Application No. 2004285488 mailed Sep. 19, 2008.
Office Action for Canadian Patent Application No. 2,543,542 mailed on Dec. 29, 2010.
Supplementary European Search Report for EP 04 79 6139 mailed Jun. 4, 2010.
Communication pursuant to Article 94(3) for EP 04 796 139.6-2318 mailed Mar. 15, 2011.
Office Action for U.S. Appl. No. 11/636,406 mailed on Mar. 19, 2010.
Final Office Action for U.S. Appl. No. 11/636,406 mailed on Sep. 15, 2010.
Office Action for U.S. Appl. No. 11/636,406 mailed on Jan. 21, 2011.
Office Action for U.S. Appl. No. 10/997,791 mailed on Aug. 11, 2005.
Office Action for U.S. Appl. No. 10/997,791 mailed on Feb. 14, 2007.
Office Action for U.S. Appl. No. 10/997,791 mailed on Sep. 14, 2007.
Office Action for U.S. Appl. No. 10/997,791 mailed on May 28, 2008.
Office Action for U.S. Appl. No. 10/997,790 mailed on Jan. 19, 2007.
Office Action for U.S. Appl. No. 10/997,790 mailed on Jul. 18, 2007.
Office Action for U.S. Appl. No. 10/997,790 mailed on Jan. 11, 2008.
Office Action for U.S. Appl. No. 11/244,866 mailed on Mar. 26, 2008.
Office Action for U.S. Appl. No. 11/244,866 mailed on Sep. 23, 2008.
Office Action for U.S. Appl. No. 11/244,866 mailed on Feb. 24, 2009.
Office Action for U.S. Appl. No. 11/244,866 mailed on Jun. 26, 2009.
Office Action for U.S. Appl. No. 11/244,866 mailed on Oct. 21, 2009.
Office Action for U.S. Appl. No. 11/244,866 mailed on Mar. 26, 2010.
Advisory Action for U.S. Appl. No. 11/244,866 mailed on Jun. 15, 2010.
Office Action for U.S. Appl. No. 11/244,866 mailed on Aug. 20, 2010.
Notice of Allowance for U.S. Appl. No. 11/244,866 mailed on Jan. 3, 2011.
Office Action for U.S. Appl. No. 11/244,869 mailed on Apr. 8, 2008.
Office Action for U.S. Appl. No. 11/244,869 mailed on Nov. 13, 2008.
Office Action for U.S. Appl. No. 11/244,869 mailed on Apr. 14, 2009.
Office Action for U.S. Appl. No. 11/244,869 mailed on Sep. 24, 2009.
Office Action for U.S. Appl. No. 11/244,869 mailed on Jan. 29, 2010.
Office Action for U.S. Appl. No. 11/244,869 mailed on May 27, 2010.
Office Action for U.S. Appl. No. 11/244,869 mailed on Nov. 3, 2010.
Final Office Action for U.S. Appl. No. 11/244,869 mailed on Mar. 10, 2011.
Advisory Action for U.S. Appl. No. 11/244,869 mailed on Jun. 6, 2011.
International Search Report and Written Opinion for PCT/US05/42185 mailed Mar. 23, 2007.
Examiner's First Report for Australian Patent Application No. 2005309695 mailed Jun. 16, 2010.
European Search Report for EP 05019093.3 mailed Oct. 28, 2005.
European Office Action for EP 05019093.3 mailed Aug. 4, 2009.
Communication pursuant to Article 94(3) for EP 05019093.3 mailed Aug. 12, 2010.
Communication pursuant to Article 94(3) for EP 05019093.3 mailed May 3, 2011.
Office Action for U.S. Appl. No. 11/283,503 mailed on Mar. 28, 2008.
Office Action for U.S. Appl. No. 11/283,503 mailed on Sep. 26, 2008.
Office Action for U.S. Appl. No. 11/283,503 mailed on Mar. 10, 2009.
Office Action for U.S. Appl. No. 11/283,503 mailed on Aug. 13, 2009.
Advisory Action for U.S. Appl. No. 11/283,503 mailed on Oct. 27, 2009.
Office Action for U.S. Appl. No. 11/283,503 mailed on Jan. 12, 2010.
Office Action for U.S. Appl. No. 11/283,503 mailed on May 18, 2010.
Advisory Action for U.S. Appl. No. 11/283,503 mailed on Aug. 9, 2010.
Final Office Action for U.S. Appl. No. 11/283,503 mailed on Mar. 25, 2011.
Notice of Allowance for U.S. Appl. No. 11/283,503 mailed on Jul. 15, 2011.
Examiner Requisition for Canadian Patent Application No. 2,654,714 mailed Jun. 9, 2010.
Office Action for U.S. Appl. No. 11/708,644 mailed on May 28, 2010.
Office Action for U.S. Appl. No. 11/708,644 mailed on Nov. 26, 2010.
Final Office Action for U.S. Appl. No. 11/708,644 mailed on May 11, 2011.
Advisory Action for U.S. Appl. No. 11/708,644 mailed on Sep. 6, 2011.
International Search Report for PCT/US01/28535 mailed Mar. 27, 2002.
Written Opinion for PCT/US01/28535 mailed May 2, 2002.
Written Opinion for PCT/US01/28535 mailed Aug. 6, 2002.
International Preliminary Examination Report for PCT/US01/28535 issued Jan. 13, 2003.
Exhibits related to the "Gravity Groove" slide (Sep. 1995).
Exhibits related to the "Mountain Slidewinder" ride (1987).

International Search Report and Written Opinion for PCT/US06/30375 mailed Jul. 7, 2008.
Office Action for U.S. Appl. No. 11/512,713 mailed on Jun. 26, 2008.
Office Action for U.S. Appl. No. 11/512,713 mailed on Jan. 9, 2009.
Office Action for U.S. Appl. No. 11/512,713 mailed on Jun. 23, 2009.
International Search Report and Written Opinion for PCT/US06/34267 mailed Jul. 7, 2008.
Office Action for U.S. Appl. No. 11/512,710 mailed on Jan. 27, 2010.
Office Action for U.S. Appl. No. 11/512,710 mailed on Jul. 13, 2010.
Office Action for U.S. Appl. No. 11/512,710 mailed on Oct. 29, 2010.
Final Office Action for U.S. Appl. No. 11/512,710 mailed on May 26, 2011.
Advisory Action for U.S. Appl. No. 11/512,710 mailed on Sep. 6, 2011.
International Search Report and Written Opinion for PCT/US06/34264 mailed Jul. 24, 2007.
Office Action for U.S. Appl. No. 11/522,056 mailed on Jun. 12, 2008.
Office Action for U.S. Appl. No. 11/522,056 mailed on Mar. 9, 2009.
Advisory Action for U.S. Appl. No. 11/522,056 mailed on Jun. 5, 2009.
Office Action for U.S. Appl. No. 11/522,056 mailed on Jul. 20, 2009.
Office Action for U.S. Appl. No. 11/522,056 mailed on Mar. 18, 2010.
International Search Report and Written Opinion for PCT/US06/36096 mailed Jun. 13, 2008.
Office Action for U.S. Appl. No. 11/375,361 mailed on Aug. 23, 2007.
Office Action for U.S. Appl. No. 11/375,361 mailed on Feb. 20, 2008.
Office Action for U.S. Appl. No. 11/375,361 mailed on Jul. 21, 2008.
Office Action for U.S. Appl. No. 11/375,361 mailed on Apr. 27, 2009.
Office Action for U.S. Appl. No. 11/375,361 mailed on Sep. 16, 2009.
International Search Report and Written Opinion for PCT/US2007/063611 mailed Nov. 10, 2008.
Office Action for U.S. Appl. No. 12/838,136 mailed on Sep. 7, 2011.
Office Action for U.S. Appl. No. 12/338,535 mailed on Oct. 19, 2010.
Office Action for U.S. Appl. No. 12/338,535 mailed on Apr. 1, 2011.
Office Action for U.S. Appl. No. 09/952,036 mailed on Feb. 9, 2006.
Written Opinion for PCT/US01/28542 mailed May 2, 2002.
Written Opinion for PCT/US01/28542 issued Aug. 5, 2002.
International Preliminary Examination Report for PCT/US01/28542 issued Dec. 2, 2002.
Written Opinion for 01 970 881.7-2307 mailed Apr. 13, 2004.
Written Opinion for 01 970 881.7-2307 mailed Oct. 21, 2004.
Office Action for U.S. Appl. No. 10/986,720 mailed on Jan. 19, 2007.
Office Action for U.S. Appl. No. 10/986,720 mailed on Jul. 18, 2007.
Office Action for U.S. Appl. No. 10/986,720 mailed on Jan. 11, 2008.
Office Action for U.S. Appl. No. 10/987,099 mailed on Jan. 19, 2007.
Office Action for U.S. Appl. No. 10/987,099 mailed on Jul. 16, 2007.
Office Action for U.S. Appl. No. 10/987,994 mailed on Jun. 4, 2007.
Office Action for U.S. Appl. No. 10/987,994 mailed on Feb. 14, 2008.
Office Action for U.S. Appl. No. 10/987,994 mailed on Jul. 24, 2008.
Office Action for U.S. Appl. No. 10/987,994 mailed on Jan. 22, 2009.
Office Action for U.S. Appl. No. 10/987,994 mailed on Jul. 23, 2009.
Office Action for U.S. Appl. No. 11/218,330 mailed on Mar. 25, 2008.
Office Action for U.S. Appl. No. 11/218,330 mailed on Sep. 23, 2008.
Office Action for U.S. Appl. No. 11/218,330 mailed on Mar. 20, 2009.
Office Action for U.S. Appl. No. 11/218,330 mailed on Jul. 22, 2009.
Advisory Action for U.S. Appl. No. 11/218,330 mailed on Nov. 9, 2009.
Office Action for U.S. Appl. No. 11/218,330 mailed on Feb. 17, 2010.
Final Office Action for U.S. Appl. No. 11/218,330 mailed on Jun. 15, 2010.
Office Action for U.S. Appl. No. 11/218,330 mailed on Dec. 30, 2010.
Examiner's Second Report for Australian Patent Application No. 2005309695 mailed Apr. 29, 2011.
Extended European Search Report for European Application No. 05 851 944.8 mailed on Jan. 13, 2010.
Communication Pursuant to Article 94(3) EPC for European Application No. 05 851 944.8 mailed on Aug. 16, 2010.
Office Action for U.S. Appl. No. 11/407,862 mailed on Aug. 27, 2008.
Office Action for U.S. Appl. No. 11/407,862 mailed on Jun. 24, 2009.
Office Action for U.S. Appl. No. 11/407,862 mailed on Nov. 30, 2009.
Final Office Action for U.S. Appl. No. 11/407,862 mailed on Apr. 29, 2010.
Office Action for U.S. Appl. No. 11/407,862 mailed on Sep. 9, 2010.
Final Office Action for U.S. Appl. No. 11/407,862 mailed on May 2, 2011.
Advisory Action for U.S. Appl. No. 11/407,862 mailed on Aug. 10, 2011.
Office Action for U.S. Appl. No. 11/407,862 mailed on Aug. 19, 2011.
Office Action for U.S. Appl. No. 11/407,861 mailed on Nov. 7, 2008.
Office Action for U.S. Appl. No. 11/407,861 mailed on Mar. 12, 2009.
Office Action for U.S. Appl. No. 11/407,861 mailed on Oct. 15, 2009.
Office Action for U.S. Appl. No. 11/407,861 mailed on Mar. 17, 2010.
Final Office Action for U.S. Appl. No. 11/407,861 mailed on Sep. 30, 2010.
Office Action for U.S. Appl. No. 11/407,861 mailed on Feb. 14, 2011.
Office Action for U.S. Appl. No. 11/407,861 mailed on Aug. 5, 2011.
Office Action for U.S. Appl. No. 11/407,875 mailed on Jan. 8, 2009.
Office Action for U.S. Appl. No. 11/407,875 mailed on Jul. 22, 2009.
Office Action for U.S. Appl. No. 11/407,875 mailed on Dec. 10, 2009.
Office Action for U.S. Appl. No. 11/407,874 mailed on Sep. 8, 2008.
Office Action for U.S. Appl. No. 11/407,874 mailed on Jul. 14, 2009.
Office Action for U.S. Appl. No. 11/407,874 mailed on Dec. 1, 2009.
Office Action for U.S. Appl. No. 11/407,874 mailed on Apr. 30, 2010.
Office Action for U.S. Appl. No. 11/407,874 mailed on Sep. 9, 2010.
Final Office Action for U.S. Appl. No. 11/407,874 mailed on Mar. 17, 2011.
Office Action for U.S. Appl. No. 11/407,886 mailed on Sep. 9, 2008.
Office Action for U.S. Appl. No. 11/407,886 mailed on Jul. 13, 2009.
Office Action for U.S. Appl. No. 11/407,886 mailed on Nov. 18, 2009.
Office Action for U.S. Appl. No. 11/407,886 mailed on May 20, 2010.
Notice of Allowance for U.S. Appl. No. 11/407,886 mailed on Nov. 17, 2010.
Office Action for U.S. Appl. No. 11/407,845 mailed on Jul. 30, 2008.
Office Action for U.S. Appl. No. 11/407,845 mailed on Oct. 17, 2008.
Office Action for U.S. Appl. No. 11/407,845 mailed on Apr. 16, 2009.
Office Action for U.S. Appl. No. 11/407,845 mailed on Oct. 16, 2009.
Office Action for U.S. Appl. No. 11/407,845 mailed on Apr. 5, 2010.
Office Action for U.S. Appl. No. 11/407,845 mailed on Aug. 24, 2010.
Final Office Action for U.S. Appl. No. 11/407,845 mailed on Jan. 31, 2011.
Office Action for U.S. Appl. No. 11/407,845 mailed on Aug. 24, 2011.
Office Action for U.S. Appl. No. 11/407,885 mailed on Jul. 29, 2008.
Office Action for U.S. Appl. No. 11/407,885 mailed on Sep. 5, 2008.
Office Action for U.S. Appl. No. 11/407,885 mailed on Jan. 30, 2009.
Office Action for U.S. Appl. No. 11/407,885 mailed on Dec. 2, 2009.
Final Office Action for U.S. Appl. No. 11/407,885 mailed on Apr. 28, 2010.
Office Action for U.S. Appl. No. 11/407,885 mailed on Sep. 9, 2010.
Final Office Action for U.S. Appl. No. 11/407,885 mailed on Mar. 10, 2011.
Advisory Action for U.S. Appl. No. 11/407,885 mailed on Jun. 9, 2011.
International Search Report and Written Opinion for PCT/US06/15503 mailed Jul. 6, 2007.
Office Action for U.S. Appl. No. 11/512,709 mailed on Jun. 24, 2009.
Office Action for U.S. Appl. No. 11/513,314 mailed on Oct. 7, 2009.
Office Action for U.S. Appl. No. 11/512,708 mailed on Jun. 23, 2009.
Office Action for U.S. Appl. No. 11/512,708 mailed on Dec. 10, 2009.
Office Action for U.S. Appl. No. 11/513,315 mailed on Oct. 5, 2009.
Office Action for U.S. Appl. No. 11/513,338 mailed on Jun. 12, 2008.

Office Action for U.S. Appl. No. 11/513,338 mailed on Dec. 10, 2008.
Office Action for U.S. Appl. No. 11/513,338 mailed on Aug. 21, 2009.
Office Action for U.S. Appl. No. 11/513,338 mailed on Dec. 10, 2009.
Office Action for U.S. Appl. No. 11/513,338 mailed on Jun. 24, 2010.
Office Action for U.S. Appl. No. 11/513,338 mailed on Oct. 14, 2010.
Final Office Action for U.S. Appl. No. 11/513,338 mailed on Mar. 24, 2011.
Advisory Action for U.S. Appl. No. 11/513,338 mailed on Jun. 3, 2011.
Office Action for U.S. Appl. No. 11/512,737 mailed on Oct. 5, 2009.
International Search Report and Written Opinion for PCT/US06/34266 mailed Jul. 7, 2008.
Office Action for U.S. Appl. No. 11/215,357 mailed on Jul. 16, 2007.
Office Action for U.S. Appl. No. 11/215,736 mailed on Mar. 9, 2007.
Office Action for U.S. Appl. No. 11/215,736 mailed on Aug. 23, 2007.
Office Action for U.S. Appl. No. 11/215,736 mailed on Jan. 25, 2008.
Office Action for U.S. Appl. No. 11/215,736 mailed on Aug. 7, 2008.
Office Action for U.S. Appl. No. 11/215,736 mailed on Mar. 17, 2009.
Office Action for U.S. Appl. No. 11/215,736 mailed on Aug. 21, 2009.
Notice of Allowance for U.S. Appl. No. 11/215,736 mailed on Feb. 19, 2010.
Office Action for U.S. Appl. No. 11/215,747 mailed on Mar. 18, 2008.
Office Action for U.S. Appl. No. 11/215,747 mailed on Oct. 24, 2008.
Office Action for U.S. Appl. No. 11/215,747 mailed on May 18, 2009.
Office Action for U.S. Appl. No. 11/215,747 mailed on Oct. 23, 2009.
Office Action for U.S. Appl. No. 11/215,747 mailed on Feb. 25, 2010.
Final Office Action for U.S. Appl. No. 11/215,747 mailed on Sep. 20, 2010.
Office Action for U.S. Appl. No. 11/215,747 mailed on Jan. 28, 2011.
Final Office Action for U.S. Appl. No. 11/215,747 mailed on Aug. 15, 2011.
Office Action for U.S. Appl. No. 11/215,795 mailed on Mar. 17, 2008.
Office Action for U.S. Appl. No. 11/215,795 mailed on Oct. 9, 2008.
Office Action for U.S. Appl. No. 11/215,795 mailed on Feb. 26, 2009.
Office Action for U.S. Appl. No. 11/215,795 mailed on Jun. 23, 2009.
Office Action for U.S. Appl. No. 11/215,795 mailed on Nov. 18, 2009.
Final Office Action for U.S. Appl. No. 11/215,795 mailed on Jun. 15, 2010.
Office Action for U.S. Appl. No. 11/215,795 mailed on Oct. 20, 2010.
Final Office Action for U.S. Appl. No. 11/215,795 mailed on May 2, 2011.
Advisory Action for U.S. Appl. No. 11/215,795 mailed on Aug. 25, 2011.
Office Action for U.S. Appl. No. 11/215,351 mailed on May 30, 2008.
Office Action for U.S. Appl. No. 11/215,351 mailed on Nov. 17, 2008.
Office Action for U.S. Appl. No. 11/215,351 mailed on Apr. 21, 2009.
International Search Report and Written Opinion for PCT/US06/33955 mailed Apr. 4, 2008.
Office Action for U.S. Appl. No. 11/244,864 mailed on Jun. 26, 2008.
Office Action for U.S. Appl. No. 11/244,864 mailed on Jan. 8, 2009.
Office Action for U.S. Appl. No. 11/244,864 mailed on Jun. 2, 2009.
Office Action for U.S. Appl. No. 11/244,872 mailed on Jun. 27, 2008.
Office Action for U.S. Appl. No. 11/244,872 mailed on Jan. 8, 2009.
Office Action for U.S. Appl. No. 11/244,872 mailed on May 28, 2009.
Notice of Allowance for U.S. Appl. No. 11/244,872 mailed on Mar. 25, 2010.

* cited by examiner

CONTROL SYSTEM FOR WATER AMUSEMENT DEVICES

PRIORITY CLAIM

This application is a continuation of U.S. patent application Ser. No. 10/105,865 entitled "CONTROL SYSTEM FOR WATER AMUSEMENT DEVICES" filed on Mar. 25, 2002 now U.S. Pat. No. 7,179,173.

BACKGROUND OF THE INVENTION

1. Field of the Invention

The present disclosure generally relates to water amusement attractions and rides. More particularly, the disclosure generally relates to a system and method in which participants may be actively involved in a water attraction.

2. Description of the Relevant Art

Water recreation facilities have become a popular form of entertainment in the past few decades. Conventional water attractions at amusement parks typically involve using gravity to make water rides work, or they involve spraying water to create a fountain. The water rides that use gravity typically involve water flowing from a high elevation to a low elevation along a water ride surface. These gravity induced rides are generally costly to construct, and they usually have a relatively short ride time. Conventional fountains in water parks are generally passive attractions for people because guests of the parks usually cannot control the water flow in these fountains.

One water attraction that allows guests to become more actively involved with water spraying objects is described in U.S. Pat. No. 5,194,048 to Briggs. This attraction relates to an endoskeletal or exoskeletal participatory water play structure whereupon participants can manipulate valves to cause controllable changes in water effects that issue from various water forming devices.

A class of water attraction rides which are not gravity induced has been added to the theme park market. U.S. Pat. No. 5,213,547 to Lochtefeld discloses a method and apparatus for controllably injecting a high velocity of water over a water ride surface. A rider that rides into such injected flow can either be accelerated, matched, or de-accelerated in a downhill, horizontal or uphill straight or curvilinear direction by such injected flow. U.S. Pat. No. 5,503,597 to Lochtefeld et al. discloses a method and apparatus for controllably injecting high velocity jets of water towards a buoyant object to direct buoyant object movement irrespective of the motion of water upon which the buoyant object floats. U.S. Pat. Nos. 5,194,048, 5,213,547 and 5,503,597 are incorporated by reference as if fully set forth herein.

SUMMARY

I. Control System

Embodiments disclosed herein provide an interactive control system for water features. In one embodiment, the control system may include a programmable logic controller. The control system may be coupled to one or more activation points, participant detectors, and/or flow control devices. In addition, one or more other sensors may be coupled to the control system. The control system may be utilized to provide a wide variety of interactive and/or automated water features. In an embodiment, participants may apply a participant signal to one or more activation points. The activation points may send activation signals to the control system in response to the participant signals. The control system may be configured to send control signals to a water system, a light system, and/or a sound system in response to a received activation signal from an activation point. A water system may include, for example, a water effect generator, a conduit for providing water to the water effect generator, and a flow control device. The control system may send different control signals depending on which activation point sent an activation signal. The participant signal may be applied to the activation point by the application of pressure, moving a movable activating device, a gesture (e.g., waving a hand), interrupting a light beam, or by voice activation. Examples of activation points include, but are not limited to, hand wheels, push buttons, optical touch buttons, pull ropes, paddle wheel spinners, motion detectors, sound detectors, and levers.

The control system may be coupled to sensors to detect the presence of a participant proximate to the activation point. The control system may be configured to produce one or more control systems to activate a water system, sound system, and/or light system in response to a detection signal indicating that a participant is proximate to an activation point. The control system may also be coupled to flow control devices, such as, but not limited to: valves and pumps. Valves may include air valves and water valves configured to control the flow air or water, respectively, through a water feature. The control system may also be coupled to one or more indicators located proximate to one or more activation points. The control system may be configured to generate and send indicator control signals to turn an indicator on or off. The indicators may signal a participant to apply a participant signal to an activation point associated with each indicator. An indicator may signal a participant via a visual, audible, and/or tactile signal. For example, an indicator may include an image projected onto a screen.

In some embodiments, the control system may be configured to generate and send one or more control signals in the absence of an activation signal. For example, if no activation signal is received for a predetermined amount of time, the control system may produce one or more control signals to activate a water system, sound system, and/or light system.

II. Water Fountain System

A water fountain system including a control system as described above may include a rotatable roof that may rotate in response to a stream of fluid. An embodiment of a water fountain system may include a roof having a friction surface. The roof may be movably coupled to a support member. The roof may rotate about an axis when a jet of water hits the friction surface. To facilitate rotation of the roof, the roof may be coupled to the support member via a bearing or bushing. The friction surface may include a plurality of protrusions (e.g., radially extending ribs, curved radially extending ribs, indentions, or protruding structures) providing a contact surface for receiving the water. A first conduit may direct water from a water source to a first nozzle located near the roof. For example, the first nozzle may direct a jet of water in a first direction toward the roof to cause the roof to rotate in a first direction (e.g., clockwise). A second conduit may direct water to a second nozzle also located near the roof. The second nozzle may direct a jet of water in a second direction toward the roof to cause the roof to rotate in a second direction (e.g., counterclockwise). The water source may include a reservoir for collecting and recycling at least a portion the water directed to the roof. The first and/or second conduits may include a nozzle. Additionally, the first and/or second conduits may be configured to direct water at an upper surface of the roof, or a lower surface of the roof. If a conduit is configured to direct water onto an upper surface of the roof, the roof may include an opening through which the conduit may extend. In some embodiments, only a single conduit may be present. In some embodiments, the first and/or second conduits may be moveably mounts such that one or both of the conduits may be moved to change the direction of rotation of the roof.

A flow control device (e.g., a pump or diverter valve) may be disposed upstream from the first conduit and the second conduit. The flow control device may direct water to one of the first or second conduits while restricting water flow through the other conduit. The flow control device may be located near the ground so that it may be adjusted by a participant.

A control system may be coupled to the flow control device. The control system may be manipulated by one or more participants to operate the flow control device. For example, the participant may apply a participant signal to an activation point. The activation point may include, for example, an optical touch button. The activation point may send an activation signal to the control system. In response to the activation signal, the control system may produce one or more control signals directed to one or more flow control devices. Additionally, the control system may produce one or more control signals directed to a sound system and/or a light system. In some embodiments, a plurality of movable roofs may be present. The control system may be configured to control each roof independently, or in conjunction with the others. The roofs may be co-planar, or distributed over several levels. In some embodiments, one or more activation points may be coupled to electrical control devices, such as switches or relays. In such embodiments, an activation point may send an activation signal to the electrical control device. The electrical control device may activate the flow control device in response to a received activation signal.

After a certain predetermined amount of time with no participant signal received, the control system may activate into an attract mode. This may consist of operating the water fountain system in a random, arbitrary, or pre-programmed manner. This operation may act to attract attention from onlookers or passersby, who may be enticed to interact with the water fountain system.

III. Water Cannon System

A water cannon system may include a tube from which water may be ejected in response to a control signal. A control system as described above may be coupled to the water cannon to control the operation of the water cannon. A water cannon may include a first hollow member including a closed end and an opposite end having an opening therein; and a second hollow member including first and second opposing open ends. The second hollow member is of smaller cross-sectional area than the first hollow member. The first and/or second hollow members may have a substantially circular cross-section, or some other shape. During use, the second hollow member is disposed in the opening in the first hollow member to form an airtight seal within the opening. The first open end of the second hollow member is outside or coplanar with the open end of the first hollow member. The second open end of the second hollow member is inside the first hollow member. In some embodiments the second hollow member may be bent or curved so that its second open end is lower than its first open end when the water cannon is parallel to the ground. Such a configuration may ensure that the second open end is below the water level in the cannon throughout the range of motion of the water cannon. The water cannon may also include a partition member with an opening therein. During use, the partition member may be disposed inside the first hollow member with the second hollow member disposed in the opening in the partition member. The partition member may be slidable along at least of a portion of the second hollow member. One or more stops may limit the range of motion of the partition member. The partition member may substantially form a partition from the exterior surface of the second hollow member to the interior surface of the first hollow member. The water cannon may also include one or more fluid inlets connected to a fluid source and effective to release fluid into the first hollow member during use. Additionally, one or more gas inlets connected to a source of pressurized gas, and effective to release a gas into the first hollow member during use may be present. The partition member may be disposed between a gas inlet and the closed end of the first hollow member during use. The control system may be in communication with a gas inlet and one or more activation points and one or more sensors. Additionally, one or more gas release valves may be provided. The gas release valves may be opened to release gas pressure when the water cannon is spent (e.g., substantially empty of water). The gas release valves may be closed when the water cannon is loaded (e.g., at a predetermined operational fluid level). The control system may control the opening and closing of the gas release valves.

In certain embodiments, a water cannon system may include a support apparatus configured to support the water cannon during use. The support apparatus may include a base and an upright member coupling the base to the first hollow member. The water cannon may be moveably coupled to the support apparatus. For example, the upright member may be coupled to the water cannon, or the base by a semispherical ball and cup connector. A sight may be coupled to the water cannon. A seat may be coupled to the base.

The act of applying a participant signal to an activation point may cause a projectile of water to be ejected from the water cannon. The activation points may be configured to signal the control system in response to the participant signal. The activation points may be located on or adjacent to the water cannon, or remote from the water cannon. The activation points may include an optical touch button. In some embodiments, one or more activation points may be coupled to electrical control devices, such as switches or relays. In such embodiments, an activation point may send an activation signal to the electrical control device. The electrical control device may activate the water cannon in response to a received activation signal.

The water cannon system may include a sensor in the vicinity of the activation points configured to signal the control system when a participant is near the activation points. The control system may be programmed to activate into an attract mode after a predetermined amount of time with no participant signal and/or no signal from the proximity sensor. This mode may include operating the cannon in a random, arbitrary, or preprogrammed fashion. This operation may serve to entice passersby to approach the activation points and participate with the water cannon system.

IV. Musical Water Fountain System

A musical water fountain system including a control system as described above may include a sound system for playing one or more musical notes, a water system for producing water effects, a light system for displaying lights, and a plurality of activation points for activating the sound system, the water system, and/or the light system. The water system may include a water effect generator, a conduit for carrying water to the water effect generator, and a flow control device. The flow control device may be configured to control the flow of water through the conduit. The flow control device may be operable in response to the water system control signals generated by the control system.

The act of applying a participant signal to the activation points may cause one or more of the following: a sequence of music notes may be produced, a water effect may be produced, and/or lights may be activated. A participant signal may be applied by the application of pressure, a gesture (e.g., waving a hand in front of a motion sensor), interrupting a light beam, or voice activation. At least one activation point may include an optical touch button. The activation points may be coupled to the control system. The activation points may be configured to sense a participant signal. The activation points preferably respond to a participant signal applied by a participant(s) and send an activation signal to the control system. The control system processes the signal. Depending on the programming of the control system, the control system may send a signal to the fountain system, and/or a second signal to the light system, and/or a third signal to the sound system.

The control system may be configured to provide participants with a visual, audio, and/or tactile indication at a predetermined time to alert the participants to apply a participant signal to a specific activation point. For example, an indicator associated with the control system may include an image projected on a screen. There may be a participant detection sensor in the vicinity of the activation point configured to signal the control system when a participant is near the activation point. When the sensor signals the control system, a light, sound, and/or tactile signal may be activated by the control system to indicate to the participants to apply a participant signal to the activation points. In some embodiments, one or more activation points may be coupled to electrical control devices, such as switches or relays. In such embodiments, an activation point may send an activation signal to the electrical control device. The electrical control device may activate the water system, sound system, and/or light system in response to a received activation signal.

After a certain predetermined amount of time with no participant signal received, the control system may activate an attract mode. This may consist of operating any combination of the light, sound, and/or water effects in a random, arbitrary, or pre-programmed manner. This operation may act to attract attention from onlookers or passersby, who may be enticed to interact with the musical water fountain system. After a predetermined amount of time with no participant detection signal, the control system may cease producing control signals, effectively turning the musical water fountain system off.

V. Interactive Water Game

An interactive water game including a control system as described above may include a water effect generator, and a water target coupled to the control system. In an embodiment, the water effect generator may include but is not limited to: a water cannon, a nozzle, and/or a tipping bucket feature. The water effect generator may be coupled to a play structure. During use, a participant may direct the water effect generator toward the water target to strike the water target with water. Upon being hit with water, the water target may send an activation signal to the control system. Upon receiving an activation signal from the water target, the control system may send one or more control signals to initiate or cease predetermined processes.

The water target may include a water retention area, and an associated liquid sensor. In an embodiment, the liquid sensor may be a capacitive liquid sensor. The water target may further include a target area and one or more drains. The water target may be coupled to a play structure.

In some embodiments, the interactive water game may include one or more additional water effect generators coupled to the control system. Upon receiving an activation signal from the water target, the control system may send one or more control signals to the additional water effect generator. The additional water effect generator may be configured to create one or more water effects upon receiving the one or more control signals from the control system. For example, the one or more water effects created by the additional water effect generator may be directed toward a participant. The additional water effect generator may include, but is not limited to: a tipping bucket feature, a water cannon, and/or a nozzle. The additional water effect generator may be coupled to a play structure.

A method of operating an interactive water game may include applying a participant signal to an activation point associated with a water system. An activation signal may be produced in response to the applied participant signal. The activation signal may be sent to a control system. A water system control signal may be produced in the control system in response to the received activation signal. The water system control signal may be sent from the control system to the water system. The water system may include the water effect generator. The water effect generator may produce a water effect in response to the water system control signal. The water effect generator may be directed toward a water target to strike the water target with water. An activation signal may be produced in the water target, if the water target is hit with water. The water target may send the activation signal to the control system. A control signal may be produced in the control system in response to the received water target activation signal. In an embodiment, the interactive water game may include an additional water effect generator. The control system may direct a control signal to the additional water effect generator if the water target is struck by water. The additional water effect generator may include, but is not limited to: a water cannon, a nozzle, or a tipping bucket feature. The additional water effect generator may produce a water effect in response to a received control signal. The water effect may be directed toward a participant.

Each of the inventions I-V discussed above may be used individually or combined with any one or more of the other inventions.

BRIEF DESCRIPTION OF THE DRAWINGS

Other objects and advantages of the invention will become apparent upon reading the following detailed description and upon reference to the accompanying drawings in which.

Figure 1:
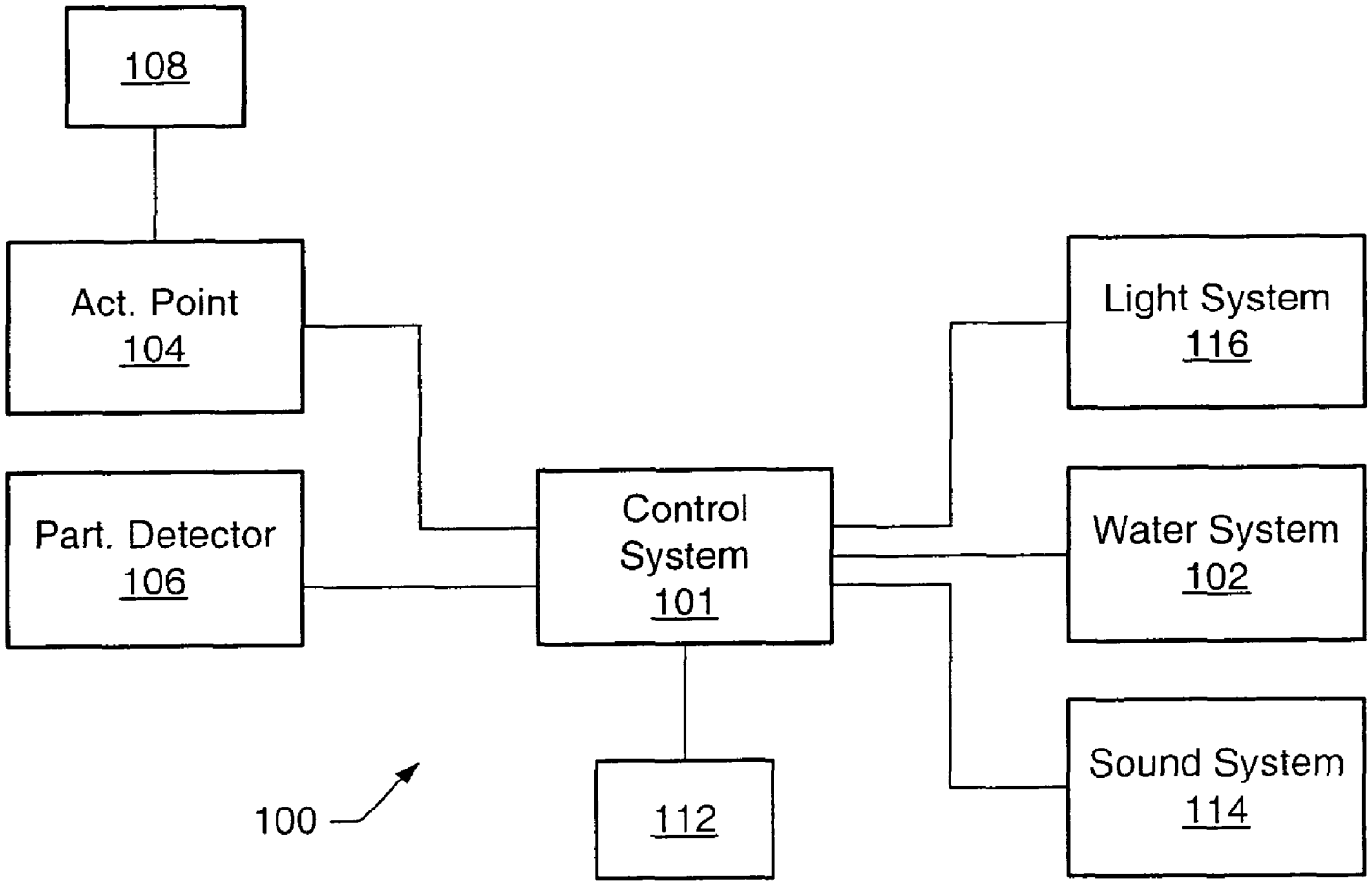
FIG. 1 depicts a schematic of a control system for a water amusement system.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

I. Control System

FIG. 1 depicts a schematic of one embodiment of a water amusement system 100. Water amusement system 100 may include a water system 102. Water system 102 may be configured to produce one or more water effects. A control system 101 may be coupled to water system 102. Control system 101 may be configured to generate water system control signals and send the water system control signals to water system 102. Water system 102 may be configured to generate a water effect in response to receiving a water system control signal. Control system 101 may be configured to generate a plurality of different water system control signals. Water system 102 may be configured to generate different water effects in response to different water system control signals.

In some embodiments, water amusement system 100 may also include a light system 116. Light system 116 may be configured to produce one or more light effects. Control system 101 may be coupled to light system 116. Control system 101 may be configured to generate light system control signals and send the light system control signals to light system 116. Light system 116 may be configured to generate a light effect in response to receiving a light system control signal. Control system 101 may be configured to generate a plurality of different light system control signals. Light system 116 may be configured to generate different light effects in response to different light system control signals.

In some embodiments, water amusement system 100 may include a sound system 114. Sound system 114 may be configured to produce one or more sound effects. In some embodiments, sound system 114 and water system 102 may be integrated together such that the sounds appear to be emanating from the water effects during use. Control system 101 may be coupled to sound system 114. Control system 101 may be configured to generate sound system control signals and send the sound system control signals to sound system 114. Sound system 114 may be configured to generate a sound effect in response to receiving a sound system control signal. Control system 101 may be configured to generate a plurality of different sound system control signals. Sound system 114 may be configured to generate different sound effects in response to different sound system control signals.

Collectively, water system 102, light system 116, and sound system 114 may be referred to as "water amusement features." Water amusement system 100 may include one or more water amusement features as described above.

In an embodiment, water amusement system 100 may include one or more activation points 104 coupled to control system 101. Activation point 104 may be configured to receive a participant signal. A participant signal may be applied to activation point 104 by a participant who desires to activate the water amusement system. As used herein, a "participant" may refer to an individual interacting with the water amusement system primarily for entertainment, as distinguished from a system operator. As used herein, an "operator" may generally refer to an individual interacting with the water amusement system primarily as an agent of the owner of the water amusement system to coordinate the function of the water amusement system. In response to the participant signal, activation point 104 may generate one or more activation signals. Activation signals may be sent to control system 101. The activation signals may indicate that a participant has signaled the activation point. In response to the activation signal, control system 101 may generate one or more water amusement feature control signals. In some embodiments, activation point 104 may include a one or more of input devices 108. Input device 108 may be configured to receive a participant signal and transfer that signal to activation point 104. For example, input device 108 may include a hand wheel movably mounted in proximity to activation point 104. The wheel may not be directly coupled to activation point 104. Rather a sensor of activation point 104 may sense rotation of the wheel. For example, activation point 104 may include a capacitive proximity detector. The proximity detector may detect movement of one or more spokes of the wheel, or of a flat area, or flap coupled to an axle of the wheel. Movement of a sensed feature past the sensor may correspond to a participant signal. Activation point 104 may be configured to generate a plurality of activation signals in response to a plurality of participant signals. Control system 101 may also be configured to generate a plurality of control signals in response to the activation signals.

A participant detector 106 may be coupled to control system 101. Participant detector 106 may be configured to generate a detection signal when a participant is within a detection range of participant detector 106. The detection signal may be sent to control system 101. In response to a received detection signal, control system 101 may generate one or more water amusement feature control signals. This "attract" mode may entice participants that are in the proximity of water amusement system 100 to approach the system and interact with the system via activation point 104.

In an embodiment, control system 101 may be configured to stop the production of water amusement feature control signals in the absence of an activation and/or detection signal. In this manner, water amusement system 100 may be "turned off" in the absence of participants.

In an embodiment, control system 101 may be configured to produce random, arbitrary or predetermined water amusement feature control signals in the absence of a detection signal and/or activation signal. Thus, when no participants are present at activation point 104, control system 101 may revert to an attract mode, producing water amusement feature control signals to activate one or more of the water amusement features such that participants may be attracted to water amusement system 100. Control system 101 may be configured to generate water amusement feature control signals in the absence of an activation signal and/or a detection signal after a predetermined amount of time. When a participant begins to interact with activation point 104, control system 101 may resume generating water amusement feature control signals in response to the participant's input.

Activation point 104 may be configured to receive a participant signal by sensing pressure, motion, proximity, sound, or position of a movable activating device (e.g., a switch or trigger). Activation point 104 may be configured to respond to the participant signal. In one embodiment, activation point 104 may be configured to respond to a participant's touching of the activation point. In such an embodiment, activation point 104 may respond to varying amounts of pressure, from a very light touch to a strong application of pressure.

Figure 2:
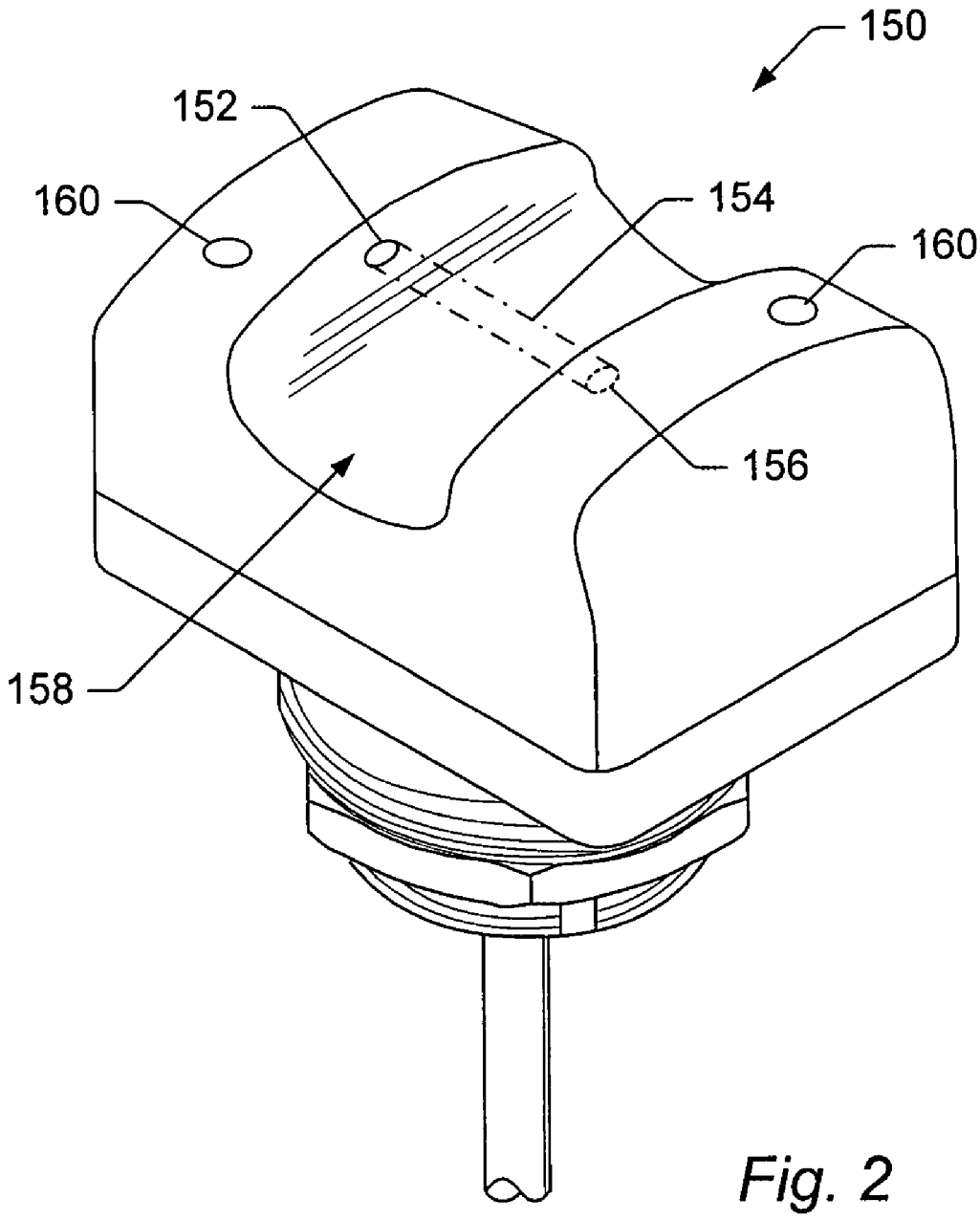
FIG. 2 depicts an embodiment of an optical touch button.

FIG. 2 depicts an embodiment of an optical touch button, suitable for use as an activation point. In the embodiment depicted in FIG. 2, optical touch button 150 may detect a participant's touch or proximity by use of a light detector 152. A light beam 154 may be directed from a light source 156 on one side of a recess 158, to light detector 152 on the other side of recess 158. To provide a participant signal, a participant may place a finger, thumb, or other object in recess 158, thereby blocking light beam 154. Upon interruption of light beam 154, optical touch button 150 may send an activation signal to a control system. An advantage of such an optical touch button may be that it may have no moving parts. Additionally, optical touch button 150 may include one or more indicators 160, such as light emitting diodes. Depending on the configuration of the optical touch button, each indicator 160 may indicate different information. For example, in an embodiment, a first indicator may indicate that the optical touch button is on (e.g., receiving power), while a second indicator may indicate when a participant signal has been received by optical touch button 150. In another embodiment, one or more of indicators 160 may be configured to provide indication to a participant to provide a participant signal (e.g., as described with reference to FIG. 20). A water amusement system may be used very frequently, as such; a device with no moving parts may provide both increased safety (e.g., by reduction in the number of pinch points) and increased reliability and up time (e.g., by reduced mechanical wear). An optical proximity detector is further described in U.S. Pat. No. 4,939,358, which is incorporated by reference as though full set forth herein. A suitable optical proximity detector may be purchased from Banner Engineering Corp. of Minneapolis, Minn., under the name Optical Touch Buttons.

In another embodiment, activation point 104 may include a button that may be depressed by the participant to signal the activation point. In another embodiment, activation point 104 may include another type of movable activation device. For example, the activation point may be a lever or a rotatable wheel. In such embodiments, the participant may signal the activation point by moving the lever (e.g., reciprocating the lever) or rotating the wheel. In another embodiment, the activation point may respond to a gesture. For example, the activation point may be a motion detector. The participant may signal the activation point by creating movement within a detection area of the motion detector. The movement may be created by passing an object (e.g., an elongated member) or a body part (e.g., waving a hand) in front of the motion detector. In another embodiment, activation point 104 may be sound activated. The participant may signal the sound-activated activation point by creating a sound. For example, by speaking, shouting or singing into a sound sensitive activation point (e.g., a microphone), the activation point may become activated.

In another embodiment, activation point 104 may include a hand wheel. A hand wheel may be a rotary activated input device. In one embodiment, the hand wheel may include at least one sensor to determine the direction and number of times the hand wheel is rotated. In one embodiment, the hand wheel may produce a signal to turn "on" a feature or turn "off" a feature based on the number of turns of the wheel detected by the sensor. The signal to turn "on" and/or "off" may be sent based on a predetermined number of turns of the wheel. The signal to turn "on" or "off" may be produced by the same number of turns for each signal, or by a different number of turns. In another embodiment, the signal to turn "on" or "off" may be determined by the direction of rotation. The use of multiple sensors coupled to a hand wheel may allow the direction of rotation of the hand wheel to be determined. For example, a clockwise rotation of the wheel may produce an "on" signal, while a counterclockwise rotation of the wheel may produce an "off" signal. In another embodiment, the programmable control system may be configured to turn "on" successive features with each turn of the wheel (e.g., in a clockwise direction), and turn "off" the successive features in a reverse sequence with each turn of the wheel in the opposite direction (e.g., in a counterclockwise direction. Alternatively, the wheel may produce a signal to turn "on" features in a random or arbitrary manner with each turn of the wheel (e.g., in a clockwise direction), and turn "off" the features in a random or arbitrary sequence with each turn of the wheel in the opposite direction (e.g., in a counterclockwise direction).

Water system 102 may include one or more flow control devices coupled to one or more water effect generators. The flow control devices may allow control over the operation of the water effect. For example, flow control devices may include valves, such as solenoid-actuated valves. In some embodiments, a flow control device may include a pump. A valve used in a flow control device may be an air valve or a water valve. A water valve may allow the flow of water to a water effect generator to be altered. An air valve may allow the flow of air to a water effect generator to be altered. Generally, a flow control device may be capable of receiving a water system control signal from control system 101 and performing some action in response to the water system control signal to initiate, cease, and/or otherwise alter a fluid flow.

In one embodiment, a water valve may be opened, releasing a stream of water or closed, cutting off a stream of water based on the type of water system control signal received from control system 101. In addition to turning the flow of water on or off, a water valve may be configured to vary the volume, pressure, and/or direction of the water stream in response to a water system control signal from control system 101.

In one embodiment, a valve may be a diaphragm valve that may be actuated by a solenoid. Such valves may be used to control the flow of water or air through water system 102. The size of the valve may vary depending on the design of the water feature. For example, valve sizes may vary from about ½ in. to about 2 in. depending on the design of the feature.

A variety of water effect generators may be included in water system 102. Examples of water effect generators may include, but are not limited to: nozzles, water falls, water cannons, water fountains, water geysers, etc. Nozzles may be used to create a spray pattern. Spray patterns may include, but are not limited to, fan sprays, cone sprays, streams, or spirals. One or more water valves may also be coupled to a system of nozzles for producing a waterfall effect. The valves may be used to control the flow of water to the waterfall. A rain curtain effect may be produced by the system of nozzles. The nozzles may create streams of falling droplets that appear as a "curtain" of water. Combinations of valves activated in sequence may be used to produce an "explosion" of water in certain water effect generators. For example, geysers or cannons may use valves to control both air and water flow to produce a "pulse" of water. Another type of water effect generator may be a water container. For example, a water feature may include a rotatable water container. The water feature may be configured to at least partially fill the water container. At a predetermined time or level of water, the water container may be tilted such that some or all of the water in the container is poured out. Moving water features, such as the spinning roof water features described in more detail below, may also include flow control devices and water effect generators. For example, the direction of rotation of a spinning roof water feature may be determined by which of the nozzles are activated. A paddlewheel water feature may operate in a similar manner.

Flow control devices in water system 102 may be activated in sequence to control the flow of water and air to a water feature. In some embodiments, a plurality of flow control devices may be controlled by a single actuator. For example, in a geyser or cannon an actuator may control two or more valves in response to a single water system control signal to generate the pulse of water. In another example, a rotatable water container may include one or more actuators coupled to pneumatic or hydraulic cylinders and to water valves. The water valves may control filling of the container, while the pneumatic or hydraulic cylinders may control rotating the container.

Participant detector 106 may include any device capable of detecting a change in the surroundings and sending a signal to control system 101 in response. For example, participant detector 106 may include a photoelectric eye, an inductive proximity sensor, a motion sensor, a microphone, a flow sensor, a water level sensor, or any of many other sensors well known to one skilled in the art. In an embodiment, the participant detector 106 is a photoelectric eye. In such an embodiment, the photoelectric eye may send a signal to control system 101 in response to an object intersecting a projected beam of light. Participant detector 106 may produce a signal when a participant passes into the detection range of the detector. Control system 101 may send one or more control signals to water system 102, light system 116, and/or sound system 114 in response to a signal from participant detector 106. For example, control system 101 may direct the water amusement features to produce a variety of effects to attract the attention of the participant in the detection range of participant detector 106.

A control system input device 112 may be coupled to control system 101. Control system input device 112 may include, but is not limited to: a keyboard, an electronic display screen, a touch pad, a touch screen, any combination of these devices, or any other input device known in the art. Generally, control system input device 112 may include one or more devices capable of transmitting signals to and receiving signals from control system 101. In one embodiment, control system input device 112 may be a touch screen capable of displaying information to an operator and receiving input from the operator in the form of contact with the screen. For example, the screen may display a series of menus with different programming options for control system 101. The operator may choose a desired option by touching the appropriate area of the screen. Control system input device 112 may then transmit a signal to control system 101 corresponding to input provided by the operator. In this manner, the actions of control system 101 may be configured by the operator of water amusement system 100.

Control system 101 may include a processing unit capable of receiving one or more input signals, processing the signals, and sending one or more output signals in response. Control system 101 may be capable of being programmed, that is, configured by an operator to perform a variety of tasks. For example, tasks may include, controlling one or more features based on predetermine and/or random control parameters, and generating reports for an operator. Controlling one or more features may include, but is not limited to: receiving activation and/or detection signals, sending feature control signals to features based on received input signals, randomly, or according to a predetermined schedule. Additionally, controlling one or more features may include inhibiting a feature from performing one or more actions. For example, control system 101 may be configured to determine if a requested action would conflict with a preprogrammed control parameter. If such a conflict exists, control system 101 may inhibit the action from being performed. For example, a water feature may be inhibited from activating if a participant is detected too close to the water feature. Controlling features may also include monitoring feature control parameters. Data from monitoring control parameters may be used to generate an automatic notification to an operator if maintenance of a feature is required and/or to track feature use or performance.

Control system 101 may be programmed to turn on and/or turn off a feature after a determined period of time. For example, control system 101 may be programmed to open and close a fountain valve every 60 seconds. Control system 101 may also be programmed to turn on and/or turn off a feature after a determined period of time with no input from any activation point and/or participant detector. For example, if an activation point and/or participant detector has not been signaled for 5 minutes, control system 101 may be programmed to open one or more water valves and turn on one or more lights to display the capabilities of water amusement system 100. Programming control system 101 in this manner may serve to attract participants to interact with water amusement system 100. Control system 101 may also be configured to turn one or more features off if left on for a predetermined amount of time. In one embodiment, a variety of "on" and "off" time limits may be programmed into control system 101 such that water amusement system 100 may become an automated system in the absence of activation and/or detection signals. Other actions and combinations of actions, which are well known to one skilled in the art, may be programmed into control system 101.

Control system 101 may also be configured to generate and send indicator control signals. Indicator control signals may be sent to one or more indicators associated with one or more activation points (as described with referenced to FIG. 20). Indicator control signals may direct the one or more indicators to turn on or off, thereby providing or ceasing to provide an indication signal to a participant.

Control system 101 may include a logic controller. For example, the logic controller may include, but is not limited to: a programmable logic controller (PLC), an application specific integrated circuit, a general purpose computer configured to perform control system functions, and/or a facility control system. A logic controller may be used to monitor input signals from a variety of input points (e.g., sensors), which report various events and/or conditions. In response to input signals provided by input sensors, the logic controller may derive and generate output signals which may be transmitted via output points to various output devices (e.g., actuators, relays, etc.) to control the water amusement system. A logic controller may control a plurality of output devices.

Logic controllers may be configured in a plurality of ways with regard to voltage input and output, memory availability and programmability. For example, a logic controller may be configured to utilize input power of 120 VAC. In such a case, one or more actuators associated with the logic controller may be configured to utilize input power of 12 or 24 VDC. However, these power values should not be considered limiting. In an embodiment, a logic controller may include a plurality of PLCs combined in an Input/Output (I/O) chassis. In such an embodiment, each PLC may communicate with a supervisory processor or other PLCs while communicating with its own local I/O devices. The logic controller may be remotely programmed and/or controlled from a central computer system. For example, PLCs with the aforementioned capabilities may be obtained commercially from a plurality of vendors. Further information on PLCs may be found in U.S. Pat. No. 5,978,593 to Sexton, which is incorporated herein by reference.

II. Water Fountain System

Figure 3:
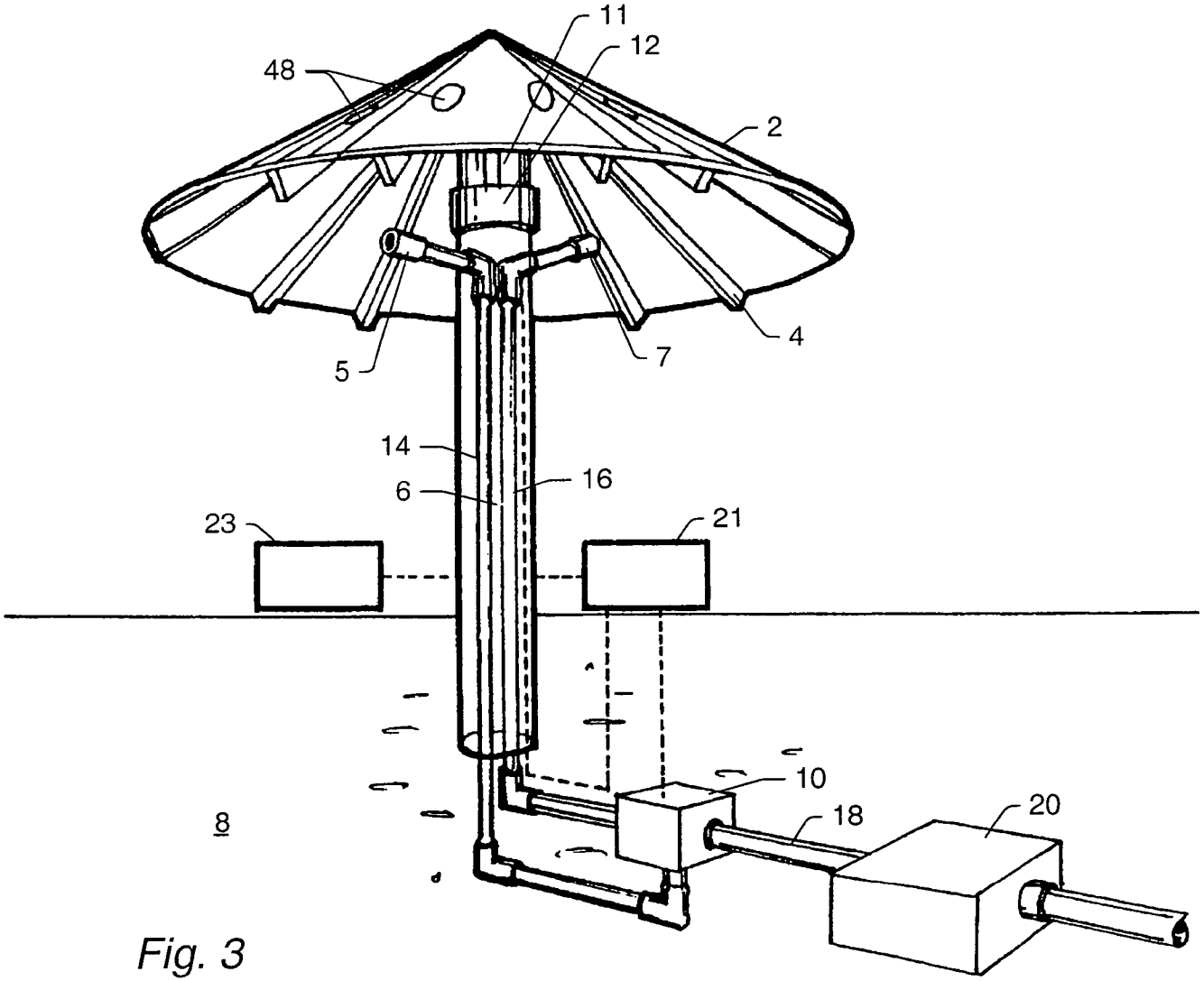
FIG. 3 is a perspective view of one embodiment of a water fountain system having an exoskeletal support member.

Turning to FIG. 3, one embodiment of a water system for participatory play is illustrated. The water system may include a roof 2 which may have protruding members or protrusions 4 attached to its lower surface. A bearing 12 may allows roof 2 to rotate about a substantially vertical axis. Bearing 12 may instead be a bushing. Roof 2 may include a lip 11, which may be a cylindrically shaped shell. Lip 11 may extend vertically from the bottom of roof 2. Lip 11 may be seated within bearing 12 and may rotate in a substantially clockwise direction or a substantially counterclockwise direction. The rotation of lip 11 may be facilitated because there may be little or no friction between the outer surface of lip 11 and the inner portion of bearing 12. In an alternative embodiment, lip 11 may include a bearing on its inner surface that substantially surrounds the upper end of support member 6.

In an embodiment, an elongated support member 6 may support roof 2. Support member 6 may extend from a reservoir 8 to roof bearing 12. Reservoir 8 may hold water used in the water system. As depicted in FIG. 3, support member 6 may be an "exoskeletal" support member whereby a first conduit 14 and a second conduit 16 are mounted to support member 6 for conveying water to roof 2. Conduits 14 and 16 may be mounted on an inner surface of support member 6 (as depicted in FIG. 3) or on an outer surface of the support member. A first nozzle 5 may be coupled to first conduit 14. A second nozzle 7 may be coupled to second conduit 16. First nozzle 5 may be configured to direct a jet of water to the lower surface of roof 2 such that roof 2 rotates about support member 6 in a clockwise direction (as viewed from above roof 2). Second nozzle 7 may be configured to direct a jet of water to another portion of the lower surface of roof 2 such that roof 2 rotates in a counterclockwise direction (as viewed from above roof 2).

As used herein, a "protrusion" may generally refer to a feature located on the roof that is configured to increase friction or contact area between the roof and water that is directed toward the roof. Protrusions 4 may cause the surface of roof 2 to be uneven. Protrusions 4 may be protruding structures or indented portions of roof 2 that facilitate rotation of the roof by providing a contact surface for water directed at the roof. In an embodiment, protrusions 4 may be rib-like members. As used herein, a "friction surface" may generally refer to any surface that is configured to provide substantial resistance to a stream of water. An upper and/or lower surface of roof 2 may include a friction surface such that the roof may be contacted by water to cause rotation of roof 2. A friction surface may include protrusions 4.

A third conduit 18 may be coupled to first conduit 14 and second conduit 16 to supply water to the first and second conduits. Flow control device 10 may be located at a junction where the third conduit is coupled to the first and second conduits. Flow control device 10 may be a diverter valve, which directs water flow to either first conduit 14 or second conduit 16. Flow control device 10 may be located at any point on or before nozzles 5 and/or 7. Third conduit 18 may extend into reservoir 8 to a location below the water level in the reservoir. Pump 20 may be disposed along third conduit 18 to force water from the reservoir through the conduits. If flow control device 10 is adjusted to direct water from third conduit 18 to first conduit 14, water may be pumped to nozzle 5. Nozzle 5 may then direct a jet of water in a first direction at the bottom of roof 2. The jet of water from nozzle 5 may cause the roof to rotate in a clockwise direction. If instead flow control device 10 is adjusted to direct water to second conduit 16, nozzle 7 may direct a jet of water in a second direction to the bottom of roof 2. The jet of water from nozzle 7 may cause roof 2 to rotate in a counterclockwise direction. When water hits roof 2, it may be directed off in droplets to create a visual water effect. In an embodiment, the water passes from roof 2 back into reservoir 8 so that it may be recycled through the water system. In any of the embodiments described herein, nozzle 5 and/or nozzle 7 may include a plurality of nozzles.

In various embodiments, roof 2 may be composed of fiberglass, metal, plastic, or other suitable materials. Roof 2 may be substantially flat or it may be non-planar. Roof 2 may have a shape that resembles a figure such as, for example, a square, a circle, a triangle, a cone, a sphere, an umbrella, a pyramid, an animal, an insect, a plant, a dinosaur, a space ship, an inner tube, a boat, an auto, an airplane, etc. First conduit 14, second conduit 16, and third conduit 18 may be made of, for example, PVC, polyethylene, or galvanized steel pipes.

Figure 4:
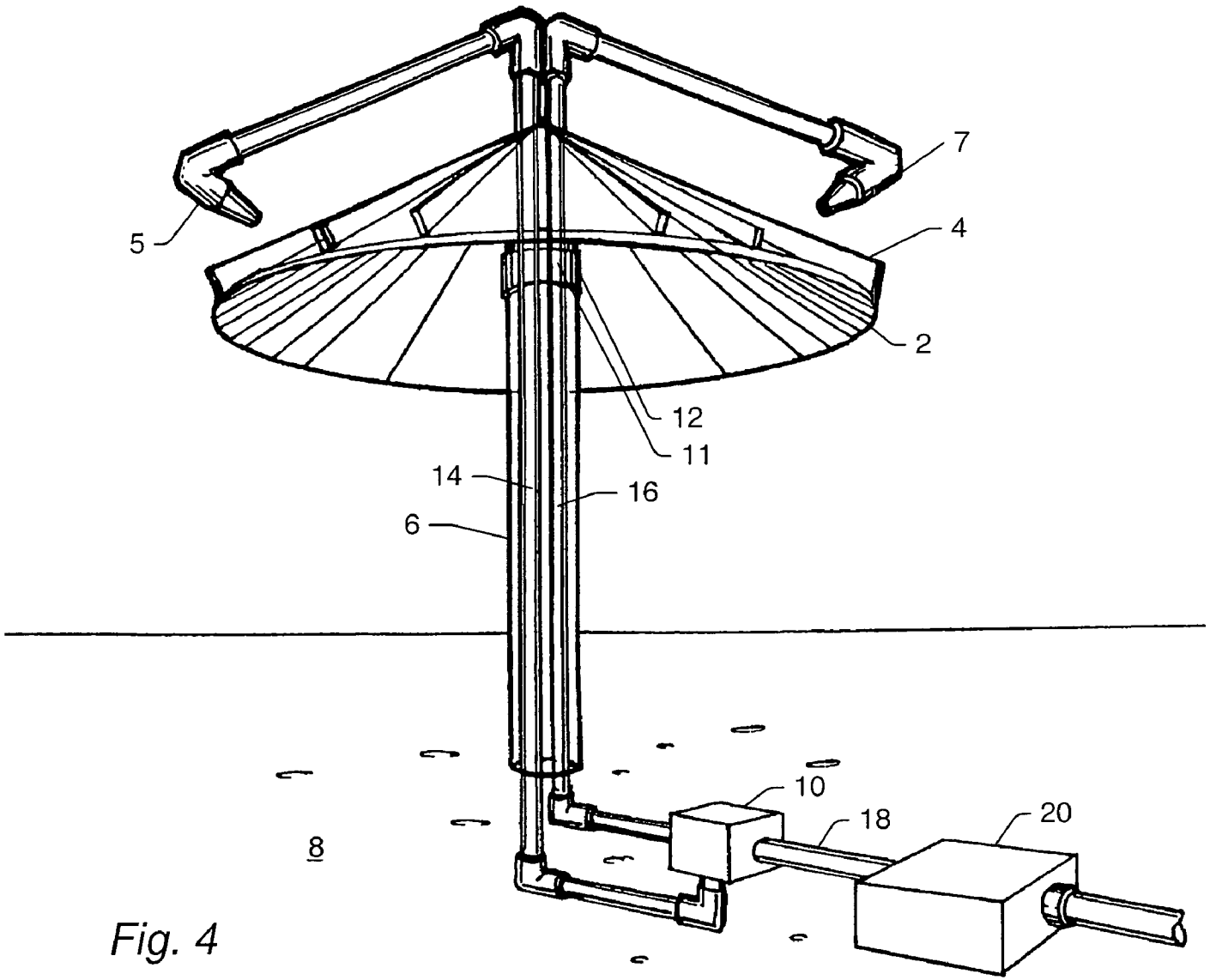
FIG. 4 is a perspective view of one embodiment of a water fountain system having an exoskeletal support member.

Turning to FIG. 4, another embodiment of a water system for participatory play similar to the embodiment of FIG. 3 is depicted. The water system may include the same components as the water system discussed above with reference to FIG. 3. However, first conduit 14 and second conduit 16 may extend upwardly through an opening in roof 2 so that nozzles 5 and 7 are positioned above roof 2. The opening in roof 2 may be located substantially in the center of lip 11. First nozzle 5 may be configured to direct water in a first direction at the upper surface of roof 2 to cause the roof to rotate in a clockwise direction. Roof 2 may have protrusions 4 located on its upper surface to create a friction surface for receiving water. Second nozzle 7 may be configured to direct water at the upper surface of roof 2 in a second direction to cause the roof to rotate in a counterclockwise direction. First and second nozzles 5 and 7 may be located at any point of the conduits 14 and 16 (e.g., near the center of roof 2, near the edge of roof 2, or any point between).

Figure 5:
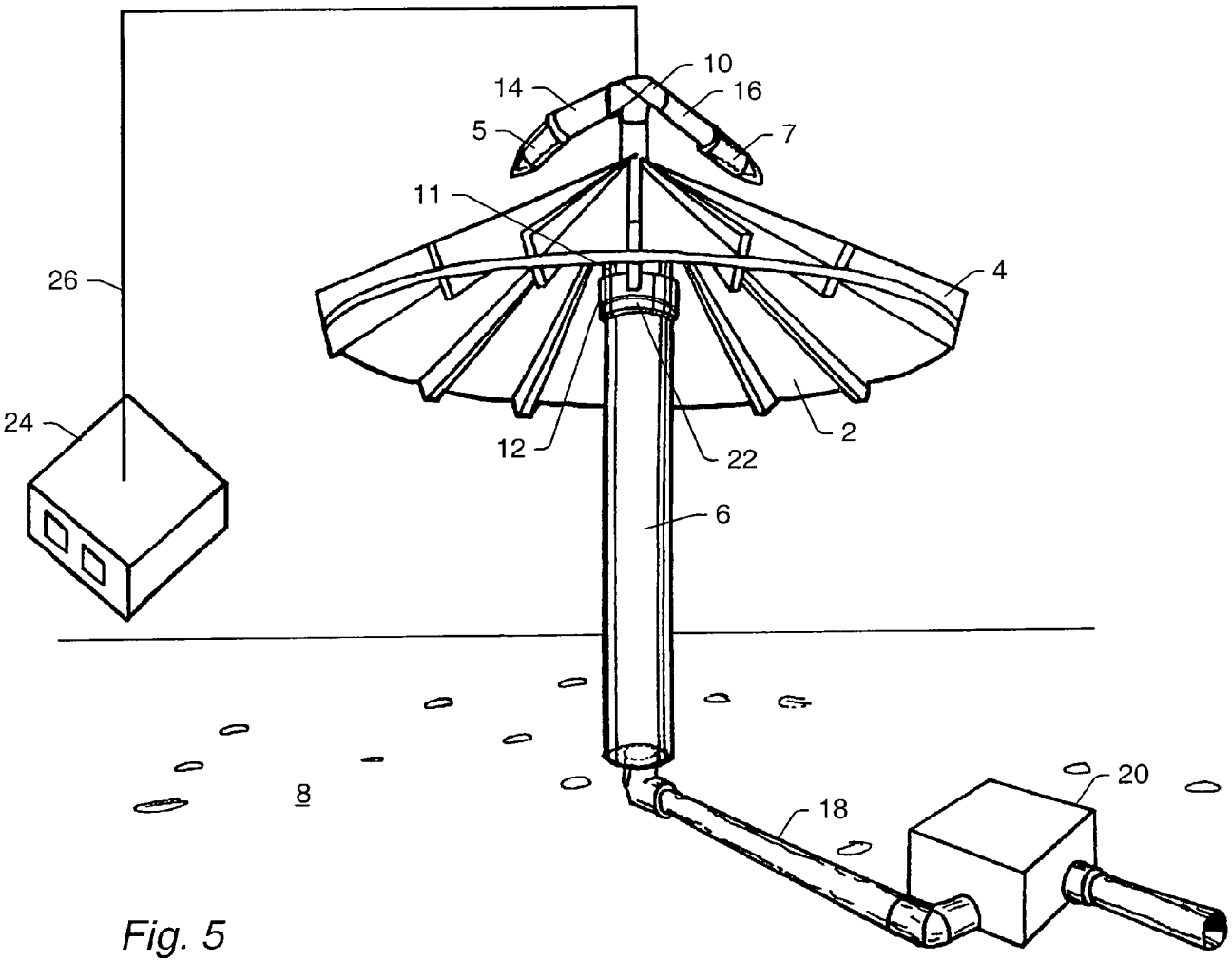
FIG. 5 is a perspective view of one embodiment of a water fountain system having an endoskeletal support member.

FIG. 5 depicts another embodiment of a water system similar to the water system depicted in FIG. 3. In the embodiment depicted in FIG. 5, support member 6 is an "endoskeletal" support member. As used herein, an "endoskeletal" support member may generally refer to a support member that serves as both a support member and a conduit for passing water to roof 2. For example, in FIG. 5, support member 6 coincides with a portion of third conduit 18. Third conduit 18 may extend upwardly through an opening in roof 2. A ring 22 may be attached about third conduit 18 underneath bearing 12 to mount bearing 12 to third conduit 18. Flow control device 10, first conduit 14, second conduit 16, first nozzle 5, and second nozzle 7 may be located above roof 2. Protrusions 4 may be located on the upper surface of roof 2 to form a friction surface at which water may be directed to cause roof 2 to rotate. Components of this embodiment may perform the same functions as previously discussed with reference to FIG. 3. Flow control device 10 may be controlled from the ground using control point 24. Control point 24 may be operated electrically, mechanically, hydraulically, or pneumatically. Signal lines 26 may convey signals to flow control device 10 or to a control system, as discussed with reference to FIG. 1. Control point 24 may include a participant detector as described with reference to FIG. 1. Alternately, control point 24 may include an activation point as discussed with reference to FIG. 1. In an embodiment where control point 24 includes an activation point, an input device may be associated with the activation point. The control system may convey control signals to flow control device 10 based on activation signals received from the activation point. For example, the input device may be one or more buttons configured to cause water to flow through either first conduit 14 or second conduit 16. In other embodiments, an optical touch button, as discussed with reference to FIG. 2 may be used as an activation point. Signal lines 26 may pass through or outside of support member 6. In some embodiments, physical signal lines may be replaced by a wireless communications system. In some embodiments, one or more activation points may be coupled to electrical control devices, such as switches or relays. In such embodiments, an activation point may send an activation signal to the electrical control device. The electrical control device may activate the flow control device in response to a received activation signal.

Figure 6:
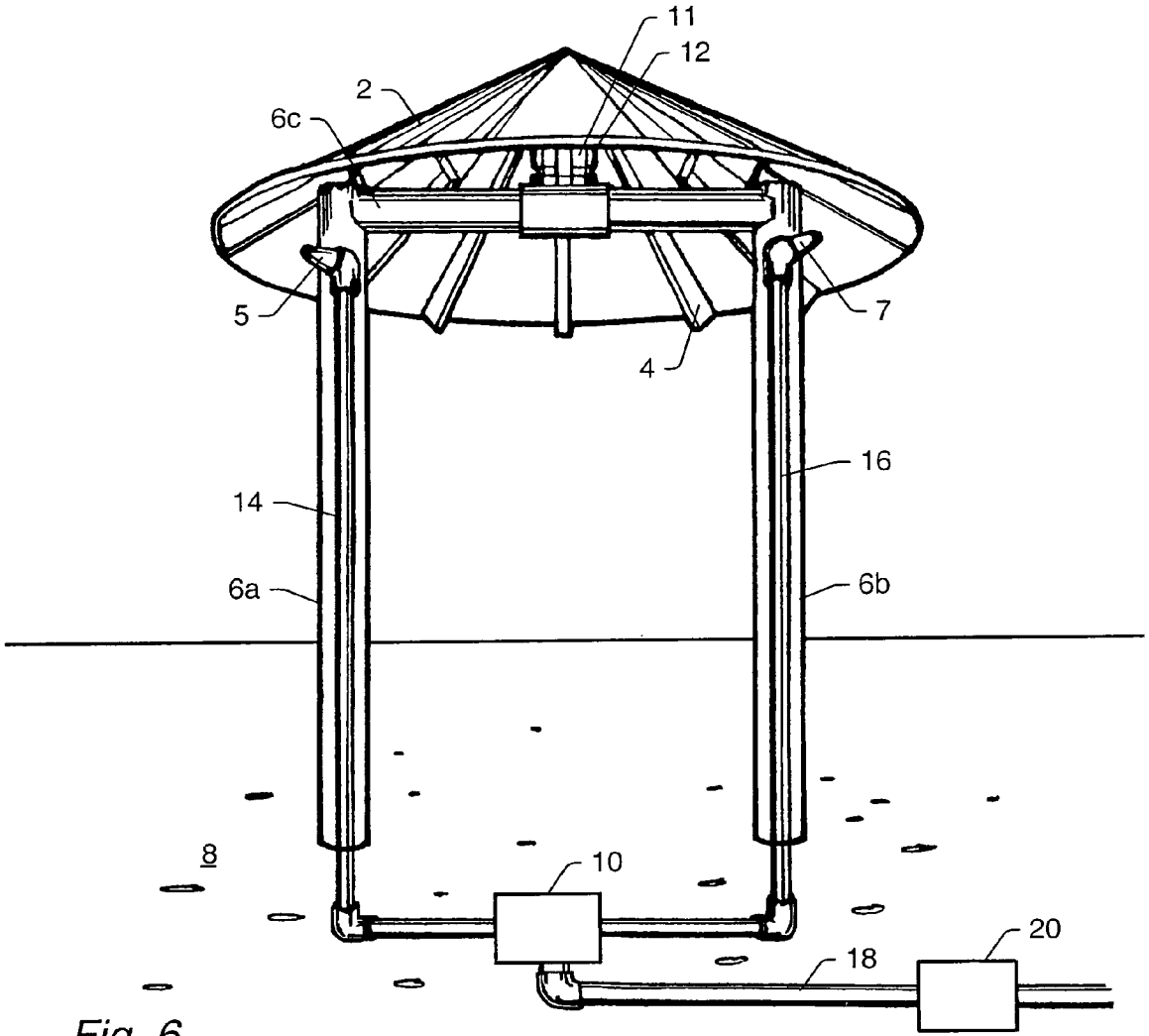
FIG. 6 is a perspective view of one embodiment of a water fountain system having an exoskeletal support member.

FIG. 6 illustrates another embodiment of a water system in which the support member is an exoskeletal support member. All of the components of this embodiment may have the same functions as previously discussed with reference to FIG. 3. In an embodiment, the support member may have three or more members. For example, a first member 6*a* and second member 6*b* may be substantially parallel to one another. In some embodiments, first member 6*a* and second member 6*b* may be coupled to reservoir 8 at their bottom ends. First member 6*a* and second member 6*b* may extend upwardly to an elevational level below roof 2. Third member 6*c* may connect the upper end of first member 6*a* to the upper end of second member 6*b*. Third member 6*c* may be substantially perpendicular to members 6*a* and 6*b*. Third member 6*c* may be coupled to bearing 12. First conduit 14 may be mounted to first member 6*a*. First nozzle 5 may be coupled to first conduit 14 near the upper end of first member 6*a*. Second conduit 16 may be mounted to second member 6*b*. Second nozzle 7 may be connected to second conduit 16 near the upper end of second member 6*b*. Roof 2 may have protrusions 4 located on its lower surface to form a friction surface thereon. Third conduit 18 may extend from within the water of reservoir 8 to flow control device 10.

Figure 7:
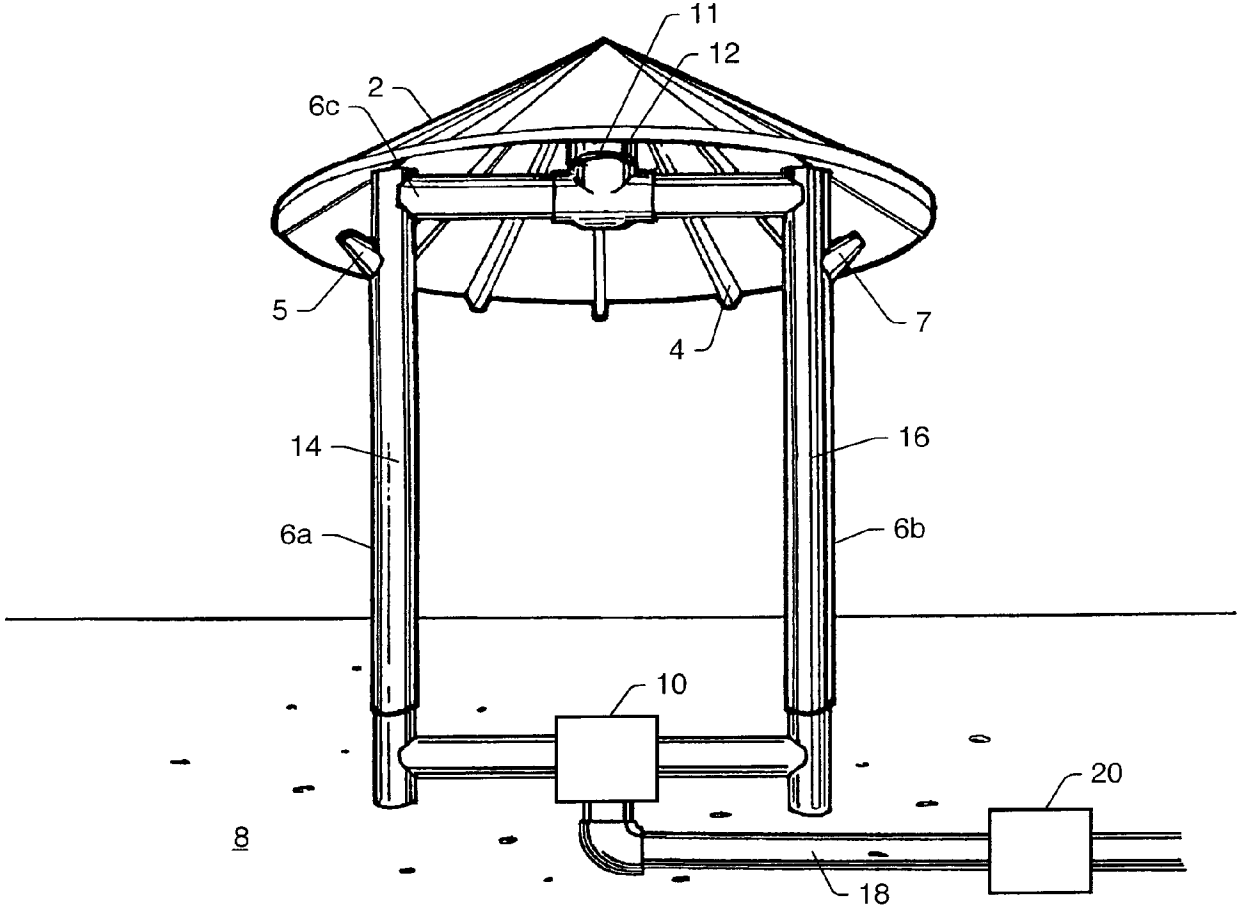
FIG. 7 is a perspective view of one embodiment of a water fountain system having an endoskeletal support member.

FIG. 7 depicts another embodiment of a water system in which the support member is an endoskeletal support member. All of the components of this embodiment may have the same functions as previously discussed with reference to FIG. 3. The support member may have a plurality of members as discussed with reference to FIG. 6. First member 6*a*, however, may form a portion of first conduit 14. That is, water may pass through a section of first member 6*a*. First nozzle 5 may extend from first member 6*a* toward roof 2 so that water may be directed toward the lower surface of roof 2. Furthermore, second member 6*b* may form a portion of second conduit 16. Second nozzle 7 may extend from second member 6*b* toward roof 2 so that water may be directed toward the lower surface of the roof. Protrusions 4 may be located on the bottom of roof 2 to form a friction service for receiving water to cause roof 2 to rotate.

Figure 8:
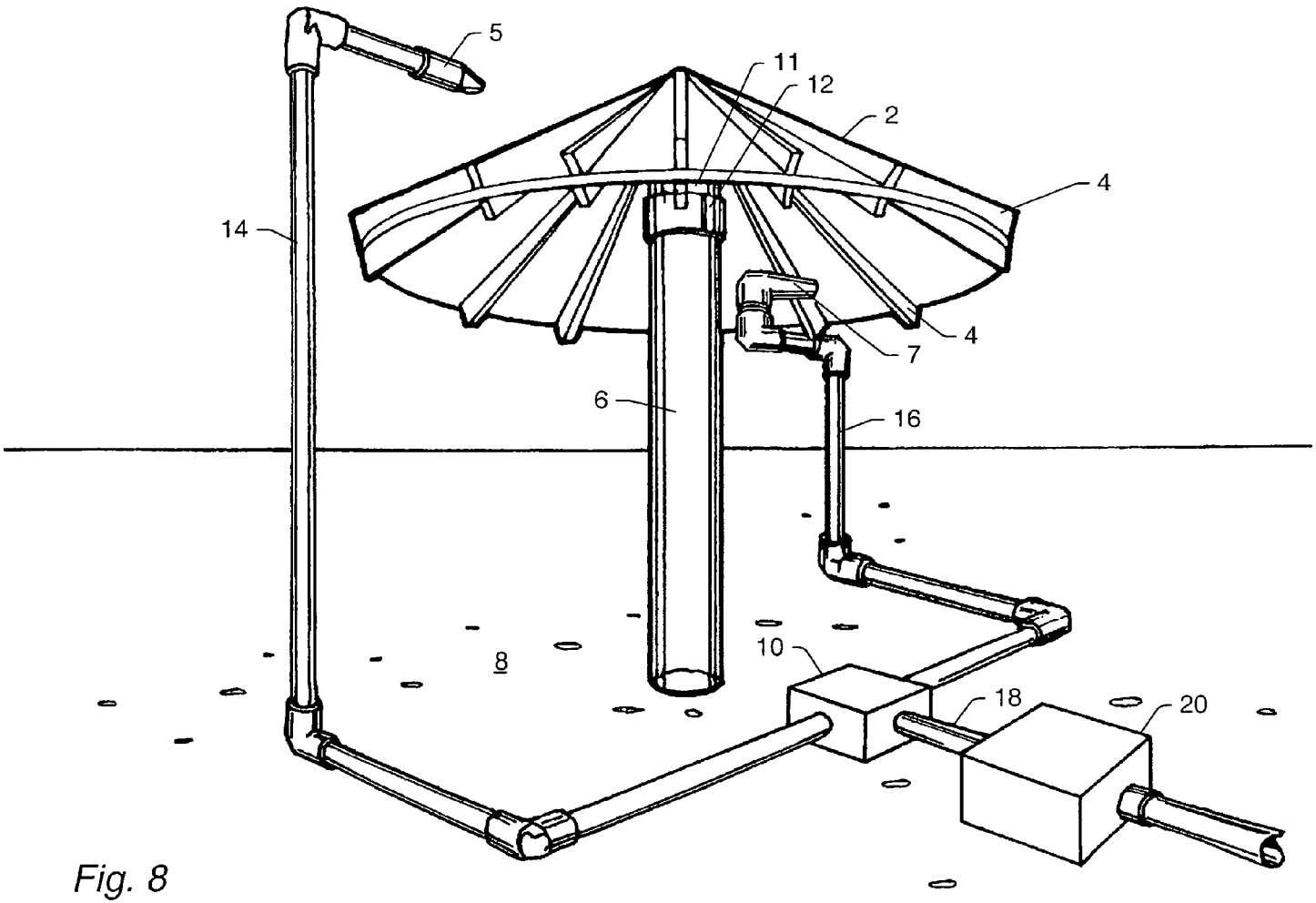
FIG. 8 is a perspective view of one embodiment of a water fountain system having an exoskeletal support member.

FIG. 8 depicts an embodiment of a water system in which support member 6 is an exoskeletal support member. All of the components of this embodiment may have the same functions as previously discussed with reference to FIG. 3. Conduits 14 and 16 may be separated from support member 6. Protrusions 4 may be located on both the upper surface and the lower surface of roof 2 to form friction surfaces on both the top and the bottom of roof 2. Conduits 14 and 16 may extend upwardly on opposite sides of support member 6 to carry water to the roof. Conduit 14 may extend to an elevational level above roof 2 so that nozzle 5 may direct water toward the top of roof 2. Conduit 16 may extend to an elevational level underneath roof 2 so that nozzle 7 may direct water toward the bottom of roof 2. Nozzles 5 and 7 may be positioned to simultaneously direct water at the roof to rotate the roof in one direction. In an alternative embodiment, nozzles 5 and 7 direct water toward the roof at different times. In such an embodiment, nozzle 5 may be positioned to cause the roof to rotate in either a clockwise or counterclockwise direction, and nozzle 7 may be positioned to cause the roof to rotate in a direction opposite the rotation caused by nozzle 5.

Figure 9:
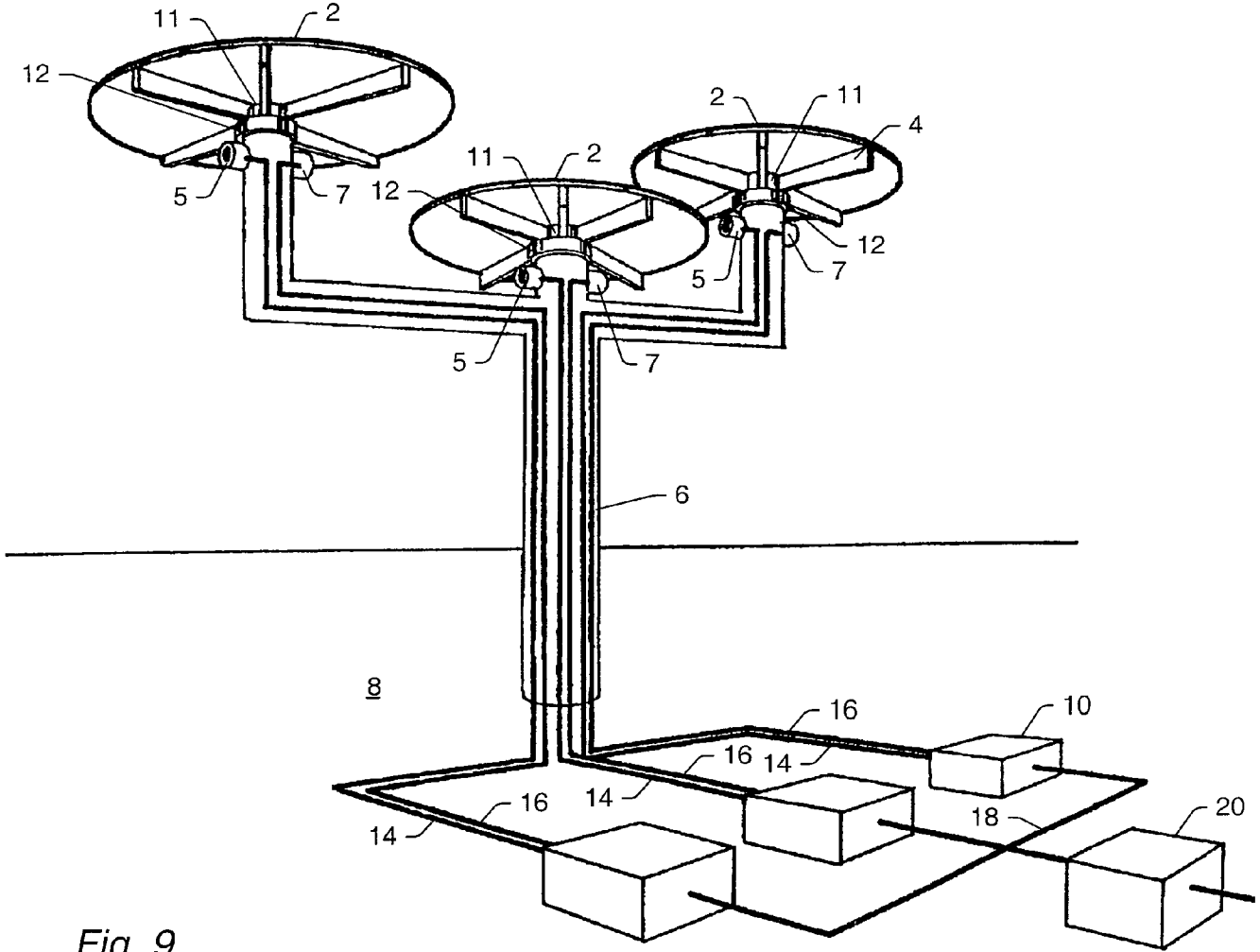
FIG. 9 is a cross-sectional plan view of one embodiment of a water fountain system having a plurality of roofs.

FIG. 9 depicts an embodiment of a water fountain system having a plurality of rotatable roofs 2. All of the components of this embodiment may have the same functions as previously discussed with reference to FIG. 3. Roofs 2 may have any suitable shapes. In an embodiment where roofs 2 may be spaced very close together (e.g., stacked on top of one another), it may be desirable for roofs 2 to be shaped such that they are prevented from contacting each other upon rotating. In various embodiments, it may also be desirable for roofs 2 to have a balanced mass so that rotation may not induce excessive mechanical stress on support members. Roofs 2 may have protrusions 4 on their upper and/or lower surfaces to form friction surfaces thereon. In the embodiment depicted in FIG. 9, the water system may include a plurality of conduits 14 and 16, a plurality of nozzles 5 and 7, and a plurality of flow control devices 10. One or more pumps 20 may pump water from reservoir 8 to flow control devices 10 via conduits 18. Each flow control device 10 may be adjustable to direct water through either conduit 14 or conduit 16. Water may be directed to each roof 2 via either nozzles 5 or nozzles 7. Each nozzle 5 may direct a jet of water to its respective roof 2 such that roof 2 rotates in a clockwise direction. Each nozzle 7 may direct a jet of water to its respective roof 2 such that roof 2 rotates in a counterclockwise direction. Bearings 12 and lips 11 of roofs 2 may be configured to enable roofs 2 to spin.

Figure 10:
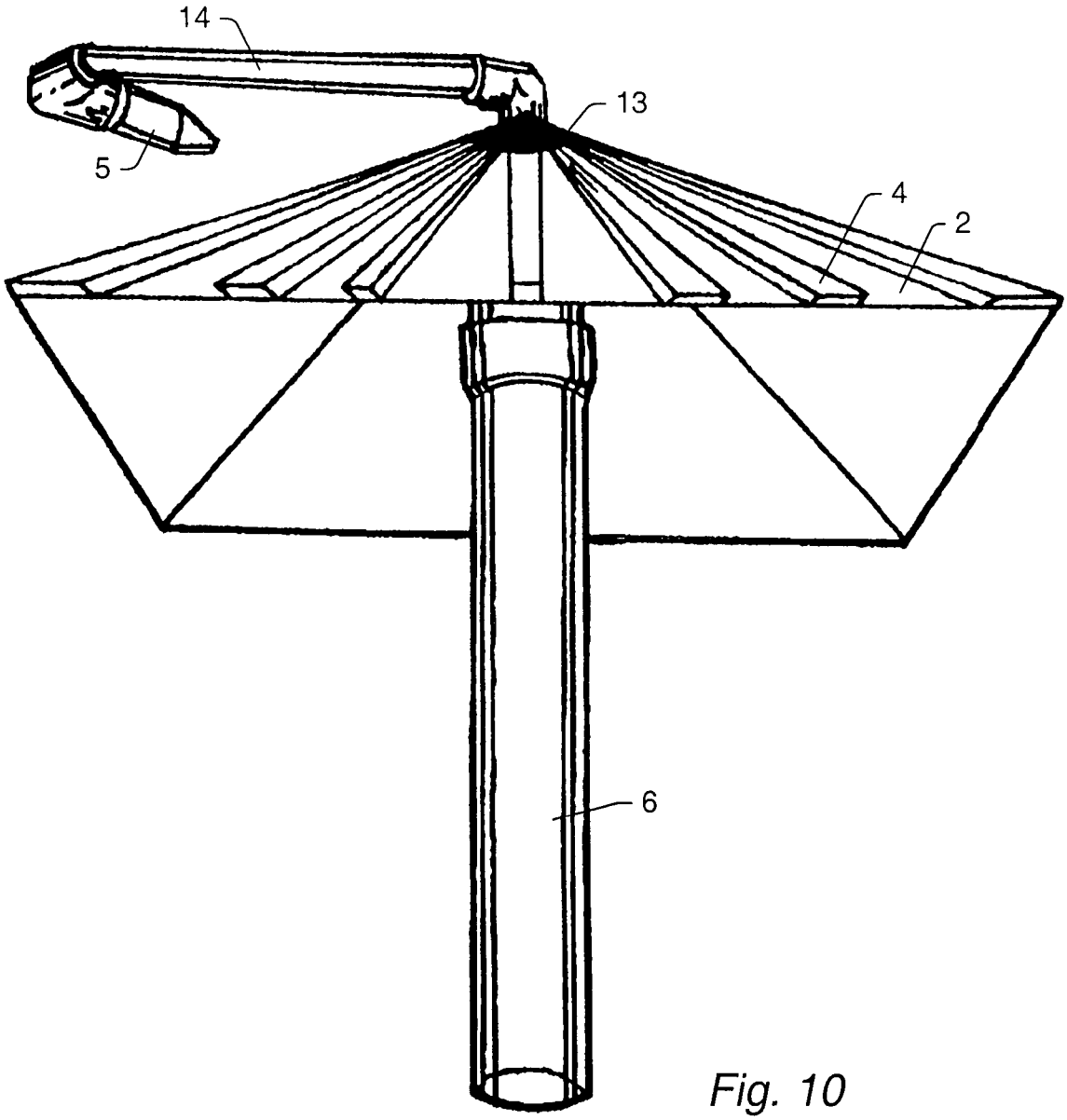
FIG. 10 depicts a perspective view of an embodiment of a water fountain system that includes a roof having members protruding from its surface.
Figure 11:
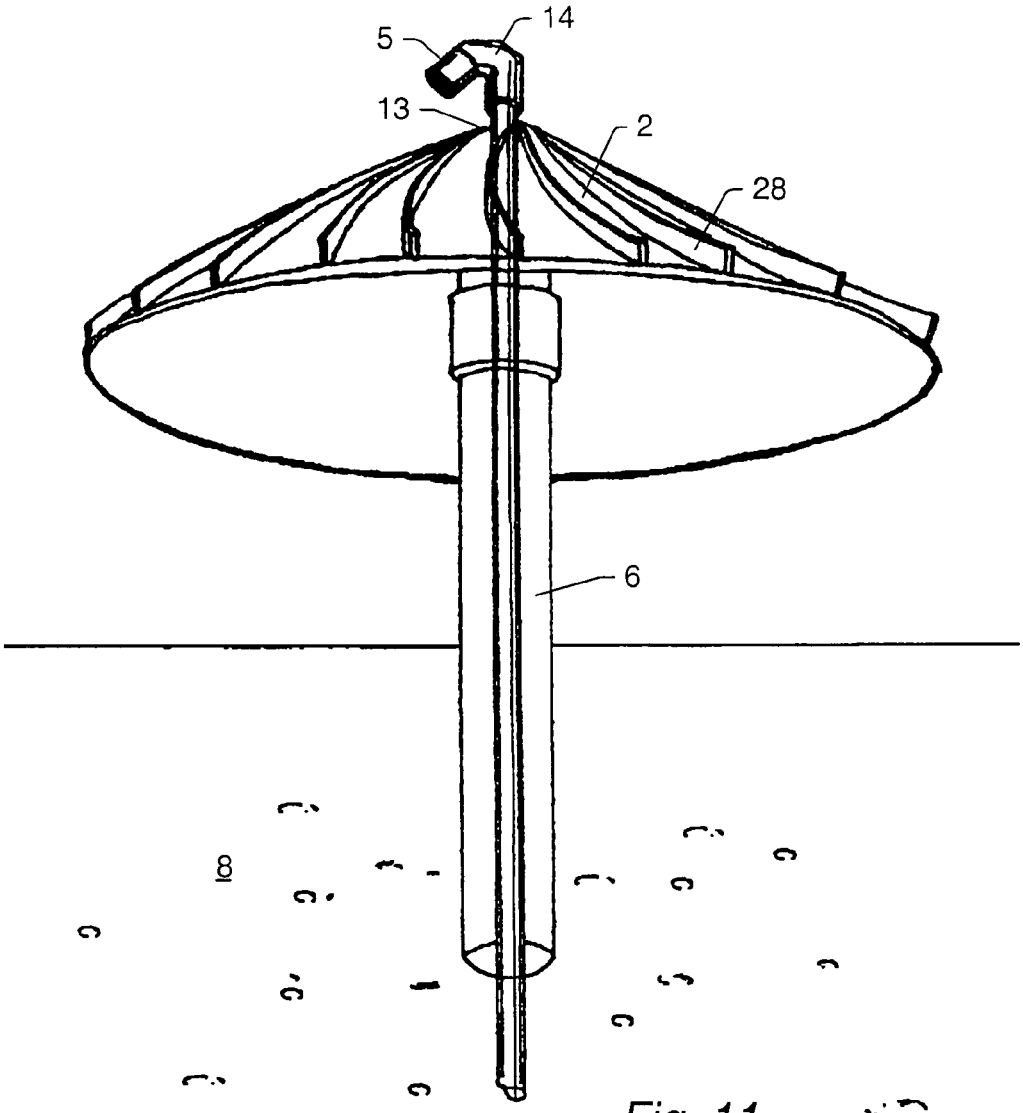
FIG. 11 depicts a perspective view of an embodiment of a water fountain system that includes a roof having curved members protruding from its surface.
Figure 12:
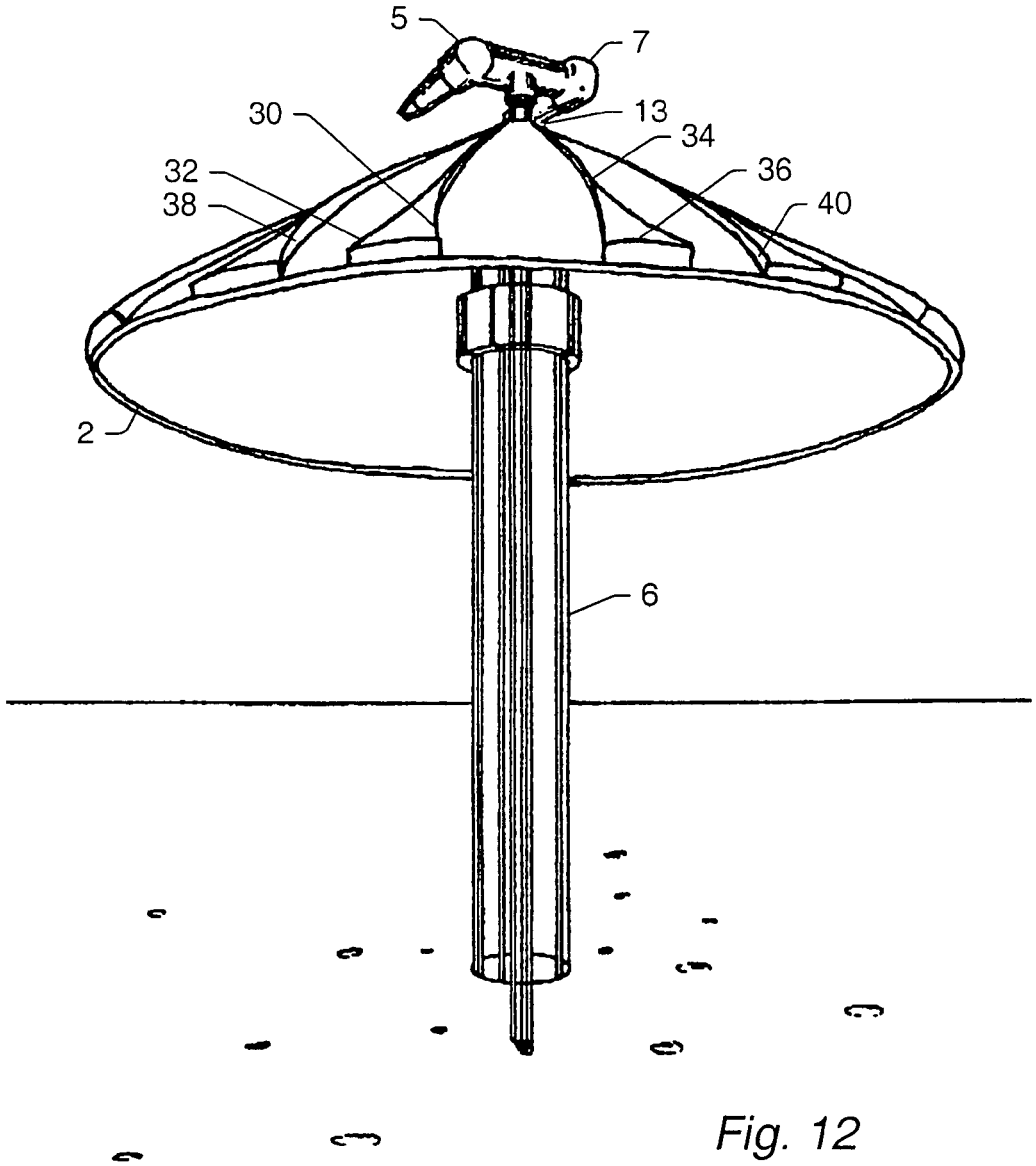
FIG. 12 depicts a perspective view of an embodiment of a water fountain system that includes a roof having curved members protruding from its surface.

Perspective views of various embodiments of roof 2 are depicted in FIGS. 10-12. Protrusions 4 may be ribs that radially extend from central portion 13 of roof 2. The ribs may include a contact surface that is raised from the surface of the roof. It is envisioned that protrusions 4 may be disposed on both the top surface and/or the bottom surface of roof 2, depending upon the position of the nozzles.

Referring to FIG. 10, conduit 14 may extend from central portion 13 toward the outer edge of roof 2 to allow water to be directed from nozzle 5 to the radially outward portions of protrusions 4. Such a configuration may maximize the torque applied to roof 2. The water may impinge upon the contact surfaces of protrusions 4 at a substantially perpendicular angle.

Referring to FIG. 11, roof 2 may include a plurality of substantially curved ribs 28 radially disposed about the roof. Curved ribs 28 may be curved in a direction opposite of the rotational direction of roof 2. In this manner, nozzle 5 may direct water toward ribs 28 from a location in the vicinity of central portion 13. The water may contact at least a portion of ribs 28 at a substantially perpendicular angle to cause the roof to rotate.

Referring to FIG. 12, each radially disposed rib may include a pair of complementary curved portions 30 and 32 that extend toward the edge of the roof in diverging directions. The curved portions 30 and 32 may be located about the outer edge of the roof. Curved portion 30 may be curved in a direction to allow roof 2 to rotate in a clockwise direction upon being contacted with a jet of water directed from nozzle 5. Curved portion 32 may be curved in a direction to allow roof 2 to rotate in a counterclockwise direction upon being contacted with a jet of water directed from nozzle 7.

As shown in FIG. 12, nozzle 5 may be offset from the center of central portion 13 and angled to direct water substantially along flow path 38 of curved portion 30 to rotate the roof in a clockwise direction (as viewed from above). Water flowing along flow path 38 of curved portion 30 may be inhibited from interacting with curved portions 32. Thus, curved portions 32 may be inhibited from producing a significant torque in the counterclockwise direction when water is directed toward roof 2 from nozzle 5. Likewise, nozzle 7 may be offset from the center of central portion 13 and angled to direct water substantially along flow path 40 of curved portions 32 to rotate roof 2 in a counterclockwise direction (as viewed from above). Water flowing along flow path 40 of curved portion 32 may be inhibited from interacting with curved portions 30. Thus, curved portions 30 may be inhibited from producing a significant torque in the counterclockwise direction when water is directed toward roof 2 from nozzle 7.

The radially inward portions 34 of the ribs may have a lower height than the radially outward portions 36. In this manner, radially inward portions 34 may tend not to block water directed at the radially outward portions 36 from nozzles 5 and 7. Alternatively, nozzles 5 and 7 may be positioned above or below the roof and angled to direct water above or below radially-inward portions 34 so that it may reach radially outward portions 36. Alternatively, the radially inward portions 34 may be absent.

In each of the embodiments described herein, nozzles 5 and 7 may be directionally adjustable so that the water directed from such nozzles may be directed in different directions without having to alter the positions of conduits 14 and 16. Nozzles 5 and 7 may be directionally adjusted manually or via a control system as described with reference to FIG. 1. In an embodiment, a water system as described with reference to FIGS. 3-12 may include a single nozzle that may be adjusted to direct water towards roof 2 in at least two directions such that the nozzle may cause the roof to be rotated in a clockwise or counterclockwise direction. In an embodiment, the nozzle may be adjustable using a control system so that a participant proximate ground level may change the direction from which water is directed at the roof.

In an embodiment, support member 6 may be shaped to resemble a figure such as, for example, a square, a circle, a triangle, a cone, a sphere, an umbrella, a pyramid, an animal, an insect, a plant, a dinosaur, a space ship, an inner tube, a boat, an auto, and or airplane. A sound system may be adapted to play sound effects that relate to the figures represented by roof 2 and/or support member 6. For example, support member 6 may have the shape of a dinosaur, and the sound system may be capable of producing sounds that would be associated with a dinosaur. Likewise, roof 2 may have the shape of, for example, a boat, car, or airplane, and the sound system may be capable of producing sounds generated by boats, cars or airplanes.

Figure 13:
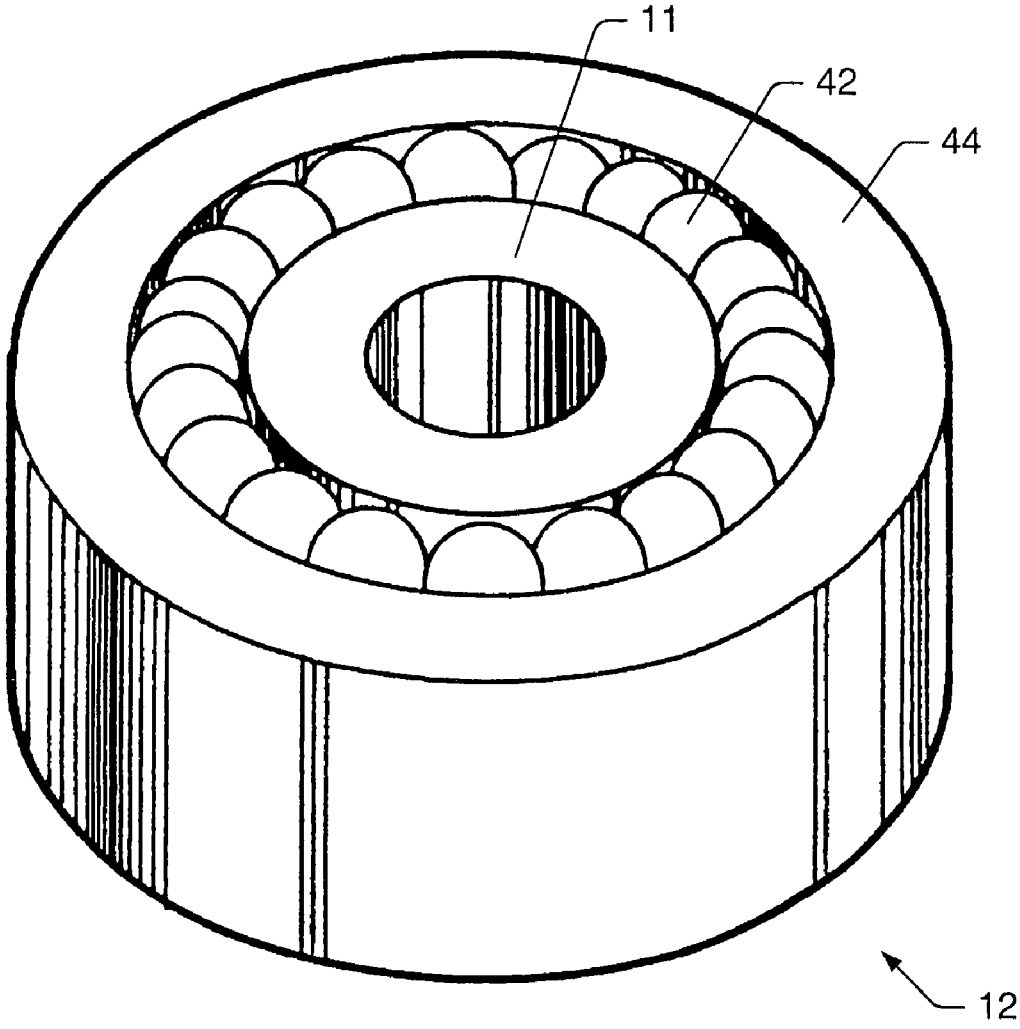
FIG. 13 is a cross-sectional view along a horizontal plane through a bearing of a water fountain system.

FIG. 13 illustrates a horizontal cross-section of bearing 12. Lip 11 of roof 2 may be a cylindrical shell seated within bearing 12. The outer surface of lip 11 may contact spinnable objects 42. Spinnable objects 42 may be in the form of balls or drums encased within a race 44. Race 44 may surround spinnable objects 42. When a jet of water hits roof 2 at an appropriate angle, lip 11 may rotate. Little or no friction may exist between spinnable objects 42 and lip 11. In another embodiment, a bushing may be used instead of a bearing. In such an embodiment, the inner surface of the bushing may be lubricated to reduce friction between the bushing and the lip.

Each of the above-described water systems may include a light system and/or a sound system 23 as illustrated in FIG. 3. A light system may include lights 46 which may be located near or on roof 2. A control system 21 may be electrically coupled to the water system, lights 46 and/or sound system 23. Control system 21 may include a control system as discussed with reference to FIG. 1. Control system 21 may be configured to turn different lights 46 on and/or off randomly, according to a predetermined schedule, or in conjunction with operation of the water system. Similarly, control system 21 may be configured to generate one or more sound effects through sound system 23 randomly, according to a predetermined schedule, or in conjunction with operation of the water system. Control system 21 may also be configured to adjust flow control device 10 randomly, according to a predetermined schedule, or in conjunction with operation of the water system. In an embodiment, the control system 21 may be programmed to operate the water system when no participant input has been received for a predetermined amount of time. In this manner, the water system may be operated in an "attract" mode to draw the attention of people in the vicinity of the water system. In an embodiment, control system 21 may activate one or more of lights 46 in response to flow control device 10 being adjusted. Control system 21 may also activate sound system 23 in response to flow control device 10 being adjusted. Upon activation, sound system 23 may play music, and/or produce a sound effect. For example, sound system 23 may play a whistle sound, animal sound, horn sound, etc. Alternatively, sound system 23 may play music or sound effects at predetermined times so that the adjustment of flow control device 10 is not required for the sound system to be activated.

III. Water Cannon System

Figure 14:
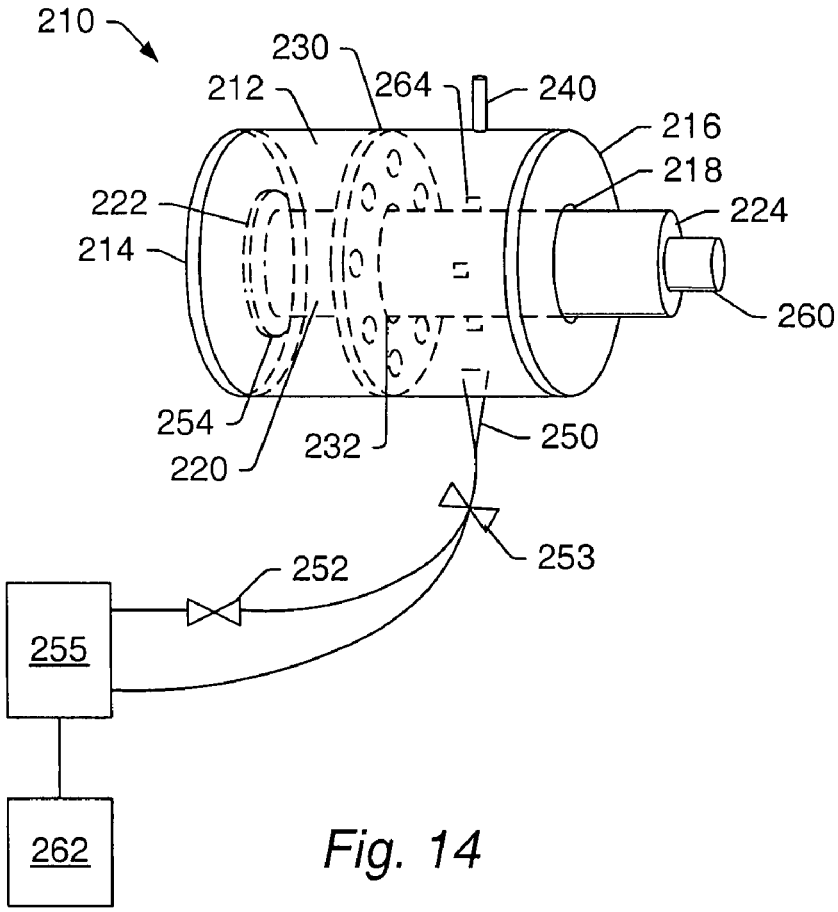
FIG. 14 is a perspective side view of an embodiment of a water cannon.

Turning to FIG. 14, a perspective view of an embodiment of a water cannon 210 is shown. The water cannon may include a first hollow member or reservoir 212, having a closed end 214 and an opposing end 216. Opposing end 216 provides an opening 218 through which a second hollow member or channel 220 may be disposed. Second hollow member 220 may have opposing open ends 222 and 224, such that, during use, open end 222 may be disposed inside first hollow member 212, and open end 224 may be disposed outside of first hollow member 212. Open end 224, in certain embodiments, may include a hollow projection or nose 260, in open communication with the second open end 222, such that a fluid flowing into the second open end 222 may flow out the projection or nose 260. Alternatively, open end 224 may include a flat end with an opening therein. The opening in open end 224 may be the same size as and contiguous with the hollow interior channel of hollow member 220, or the opening may be narrower, or larger. It is understood that a narrowing structure may project into the hollow member 222. In certain embodiments, an opening in second hollow member 220 may be at least partially covered by a screen.

When member 220 is disposed within opening 218, an airtight and watertight seal may be formed between member 220 and member 212 at opening 218. The members may be rigidly and/or permanently sealed, as with a weld or other permanent joint, or they may be sealed with the use of a gasket and/or sealant such as silicone or glue.

In an embodiment, water cannon 210 may further include a planar or disc shaped member, partition member 230. Partition member 230 may provide an opening 232 such that the second hollow member 220 is able to fit within the opening 232. In such a configuration, partition member 230 may be freely slidable along second hollow member 220. The device may also include a stop 254 to prevent the partition member 230 from sliding off the second hollow member 220 during use. Stop 254 may be coupled to second hollow member 220, to first hollow member 212, or to partition member 230. Stop 254 may be a ridge, bump, projection or a series of projections formed to prevent the partition member 230 from sliding off the second hollow member 220 during use. In certain embodiments, the stop 254 may be attached to or formed as a combination of attachments to, or projections in, the first and second hollow members 212, 220. In certain embodiments, open end 222 may be positioned so close to end 214 that a partition member 230 may be too large to slip off second hollow member 220. In such embodiments, a stop may not be present. In some embodiments, a second stop 264 may be present. Second stop 264 may prevent partition member 230 from sliding beyond an operational limit. For example, for proper function of water cannon 210, gas inlet 250 may be positioned such that gas entering via gas inlet 250 pushes partition member 230 toward open end 222. Second stop 264 may prevent partition member 230 from sliding beyond gas inlet 250. In some embodiments, gas inlet 250 may be attached to end 216. In such embodiments, a stop 264 may not be present.

The first hollow member 212 may also include one or more inlets 240 for a liquid, such as water. Inlet 240 may include a valve (not shown) to control the flow of liquid into the first hollow member 212. The valve may be passively operational such that the valve automatically closes when the fluid level in the reservoir reaches a predetermined level. The valve may open when the fluid level falls below the predetermined level. In other embodiments, the valve may be operated by a participant using the water cannon, or may be operated by a timer or control system. Inlet 240 may be in fluid communication with a fluid source, such as a water source. The fluid source may, in certain embodiments, include a pump for moving fluid from the source into the inlet.

As previously mentioned, reservoir 212 may include one or more gas inlets 250 disposed between end 216 of reservoir 212 and partition member 230. In some embodiments, gas inlets 250 may be connected to a control system or to a valve 252. A source of compressed gas or compressed air may be coupled to gas inlets 250. Valve 252 may be activated by a participant to cause reservoir 212 to become filled with gas. During use, opening valve 252 may allow gas to flow into the chamber, causing an increase in gas pressure to be produced within the chamber. This increase in gas pressure may cause partition 230 to move causing the ejection of a projectile of water. After the projectile has been ejected, additional gas may be inhibited from entering reservoir 212.

In an embodiment, a valve 253 may be positioned between valve 252 and gas inlet 250. Valve 253 may be configured to allow the gas pressure to build up between valves 252 and 253 such that the gas is pressurized to an appropriate pressure. To produce a burst of gas, valve 253 may be opened allowing the pressurized gas to enter reservoir 212. After a burst of gas is released, valve 253 may be closed and the air pressure allowed to increase. In this manner, an air line coupled to valve 253 may supply air for only the time required to eject the projectile of water. Valve 252 may serve as a main cutoff valve. During use, valve 252 may remain open to allow flow of air to reservoir 212. Valve 252 may be closed to prevent the water cannon from being used, e.g., during routine maintenance. The use of a dual valve system may allow gas from the gas supply system to be conserved and energy use of the device to be reduced.

Valve 252 and/or valve 253 may be connected to a control system 255. Control system 255 may be configured to accept remote signals from an activation point 262. Activation point 262 may be an activation point that generates an activation signal in response to a participant signal, as described with reference to FIG. 1. For example, in an embodiment, activation point 262 may include an optical touch button as was previously described with reference to FIG. 2. Valves 252 and/or 253 may be coupled to activation point 262 via control system 255. A participant signal delivered to activation point 262 may cause an activation signal to be sent to control system 255. Control system 255, upon receiving an activation signal from activation point 262, may send a control signal to at least one of valves 252 and 253 such that the valve is opened. Opening of the valve may initiate a sequence of events that ultimately produces a water projectile. Signals sent between activation point 262, control system 255, and valves 252 and/or 253 may be electrical, pneumatic, or hydraulic signals. In an embodiment, activation point 262 may be located on or in the vicinity of water cannon 210. Alternatively, activation point 262 may be located at a remote location from water cannon 210. By placing activation point 262 at a remote location, a participant may operate one or more water cannons, which may be located in an inaccessible location (e.g., on top of a play structure or building).

In an embodiment, control system 255 may be configured to operate at least one of valves 252 and 253 without any participant input. Control system 255 may be programmed to produce water projectiles at random, or at predetermined intervals. Control system 255 may also be programmed to produce water projectiles based on one or more predetermined triggering events. For example, a water projectile may be triggered by a detection signal from a participant detector, as described with reference to FIG. 1. Based on the programming of control system 255, the control system may send a signal to valve 252 and/or valve 253 to initiate the production of a water projectile. Control system 255 may be configured to continuously operate the water cannon (e.g., whether a participant is present or not). Alternatively, control system 255 may be configured to operate the water cannon system only when activation point 262 is in an idle state (e.g., when no participants are present).

During operation of water cannon 210, fluid may flow into reservoir 212 to at least partially fill reservoir 212 via fluid inlet 240. In an embodiment, the fluid may fill reservoir 212 at least until the fluid level completely covers open end 222. As the fluid level reaches a predetermined level, a valve in fluid inlet 240 may be closed or the fluid flow may be stopped by some other means. When reservoir 212 is full of fluid (e.g., the predetermined level has been reached), partition member 230 may be disposed near open end 224, and may rest against one or more stops 264. This may be described as the "loaded" cannon configuration. When the cannon is in the loaded configuration, valve 252 and/or valve 253 may be activated to release compressed gas or air into gas inlet 250. The compressed or pressurized gas may force partition member 230 to slide down second hollow member 220. As partition member 230 slides down second hollow member 220, the liquid in reservoir 212 may be forced into open end 222, through second hollow member 220 and out open end 224. In an embodiment, water cannon 210 may be configured such that the radius of the second hollow member 220 is no more than about one-third the radius of the first hollow member 212. It is believed that such a configuration may allow an "explosive" movement of partition member 230 upon entry of the compressed gas into first hollow member 212 resulting in a mass of water being forcefully ejected in a single spurt from second hollow member 220. In some embodiments, first hollow member 212 and second hollow member 220 may not have a circular cross-section. In such embodiments, first hollow member 212 and second hollow member 220 may be sized such that the cross-sectional area of first hollow member 212 is about 9 times the cross-sectional area of second hollow member 220. Alternately, the hollow members may be sized such that the hydraulic radius of second hollow member 220 is about one third the hydraulic radius of first hollow member 212. As used herein, "hydraulic radius" may generally refer to the cross-sectional area of a member divided by the length of the wetted perimeter of the member.

Figure 15A:
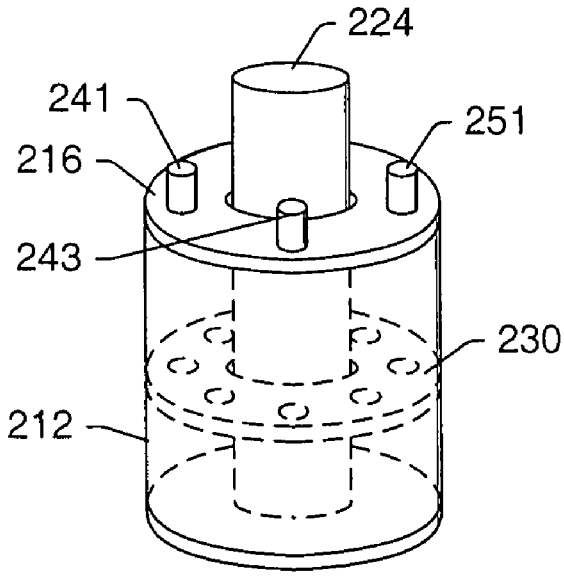
FIG. 15A is a perspective view of an embodiment of a water cannon in a loaded configuration.
Figure 15B:
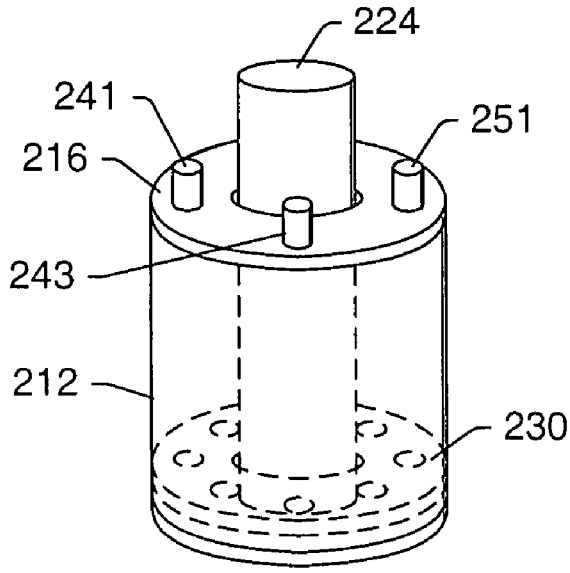
FIG. 15B is a perspective view of an embodiment of a water cannon in a spent configuration.

FIG. 15A depicts a perspective view of an embodiment of a water cannon 210 in a "loaded" configuration. Partition member 230 may be disposed at least partially up second hollow member 220. In the embodiment shown, end 216 of the first hollow member 212 includes an adapter 241 coupled to fluid inlet 240 (depicted in FIG. 14), an adapter 251 coupled to gas inlet 250 (depicted in FIG. 14), and a gas release valve 243. FIG. 15B depicts a perspective view of the embodiment shown in FIG. 15A in a "spent" configuration (i.e., after firing). In FIG. 15B, partition member 230 has been forced down second hollow member 220 by an influx of pressurized gas and has caused ejection of a fluid "projectile." In an embodiment, gas release valve 243 may be coupled to a control system. Gas release valve 243 may be configured to open when fluid level in reservoir 212 reaches a first predetermined level (e.g., when the water cannon is spent, as depicted in FIG. 15B). By opening gas release valve 243, gas pressure may be released from reservoir 212. Gas release valve 243 may be configured to be closed when fluid level in reservoir 212 reaches a second predetermined level (e.g., when the water cannon is loaded, as depicted in FIG. 15A). Closing gas release valve 243 may prevent gas from escaping from reservoir 212; thereby permitting rapid pressurization of the reservoir upon firing of water cannon 210.

As used herein, a "projectile" may generally refer to a discrete volume or mass of water ejected from a water cannon due to a single release of gas into the first hollow member. A projectile may travel through its trajectory as a discrete, or substantially continuous, mass of water. It is understood that the projectile will break into smaller portions during the course of its trajectory. Nevertheless, the projectile may provide a sudden, large impact of short duration when it hits a target. A projectile is differentiated in this way from a continuous or semi-continuous stream of water, as in previous water gun type devices. A device as described herein, therefore, may provide a different and more fun sensation for a "target" person who hit with the projectile as compared to a continuous stream. A water cannon as described herein may provide the target or recipient with a sensation more akin to being hit with a water balloon or a bucket of water. This may be contrasted with a stream of water where the sensation may be similar to being sprayed with a water gun or water hose. In an embodiment, a projectile produced by water cannon 210 may have a volume of between about 8 oz. to about 60 gallons. For example, a projectile may have a volume of between 1 gallon to about 20 gallons or between 2 gallons and 10 gallons depending on the size of the water cannon.

By adjusting the pressure of the gas burst, the shape of the projectile may also be varied. For example, a high pressure, short burst of gas may cause a more diffuse projectile, while a low pressure, longer burst of gas may cause a more dense projectile. The type of projectile produced may be determined by the gas pressure, the flow rate of the gas, and the dimensions of the first and second hollow members.

Figure 16:
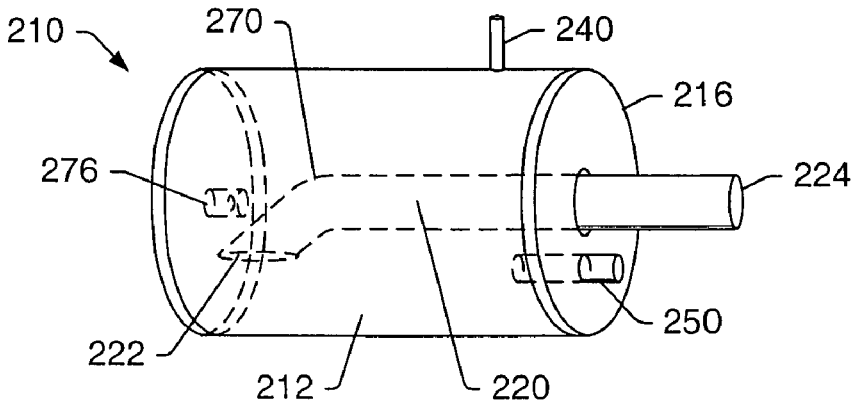
FIG. 16 is a perspective side view of an embodiment of a water cannon.

FIG. 16 depicts an embodiment of water cannon 210 in which second hollow member 220 includes a curve or angle 270. Angle 270 may have any suitable angle. For example, angle 270 may be a large or small obtuse angle, a right angle, or an acute angle so long as a partition member may be configured to force liquid into and through second hollow member 220. It is contemplated that in order to place the open end 222 further beneath the liquid surface level of reservoir 212, it may be advantageous to point second open end 222 in a downward direction relative to first open end 224. In this arrangement, second hollow member 220 may be configured such that, during use, when first open end 224 of the second hollow member 220 is pointed parallel to the ground, second open end 222 of the second hollow member 220 may be positioned lower than the first open end.

In some embodiments, water cannon 210 may be equipped with a secondary water effect generator 276 (e.g., a nozzle, or valve) providing a water passage through closed end 214 of reservoir 212. Secondary water effect generator 276 may be used to create a "backfire" effect, wherein a participant interacting with water cannon 210 may be soaked rather than an intended target. For example, as described in further detail with reference to FIGS. 26 and 27, a first participant's water cannon may backfire if a second participant strikes a target associated with the first participant's water cannon. In such a case, the control system may initiate secondary water effect generator 276 to direct water onto the first participant from the first participant's water cannon.

Figure 17:
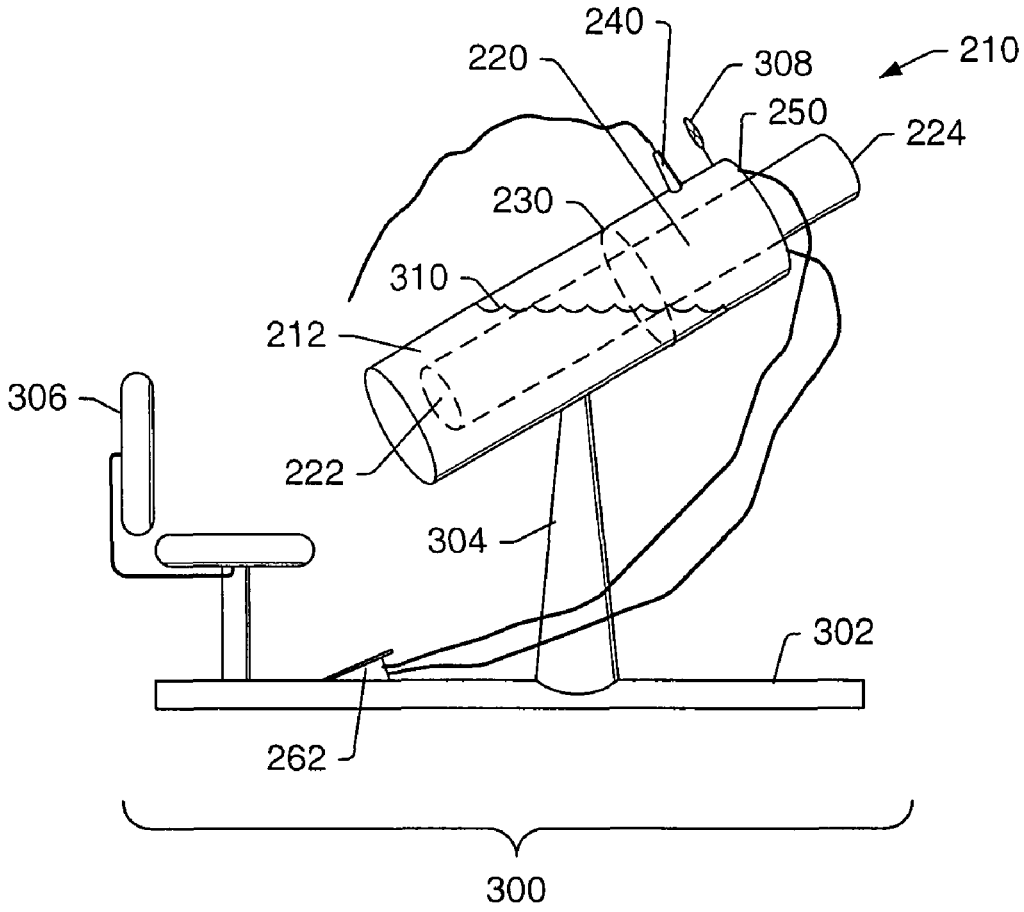
FIG. 17 is a perspective side view of a water cannon that includes a support apparatus.

Turning to FIG. 17, an embodiment of a mounted water cannon station 300 is depicted. The mounting configuration may include a base 302. Base 302 may be attached to or resting on the ground, or in a pool of water, for example. An upright member 304 may extend from base 302 to water cannon 210. Upright member 304 may support water cannon 210. In some embodiments, upright member 304 may be moveably coupled to water cannon 210 such that a participant or an automatic positioning device may aim water cannon 210 at a target. For example, in certain embodiments, upright member 304 may include a semispherical attachment that mates with a cup-like structure in the base 302 such that water cannon 210 may be raised or lowered and/or swiveled simultaneously. In alternative embodiments, the top of upright member 304 may include a vertically adjustable connection to water cannon 210 effective to raise or lower the cannon during use. In certain embodiments, the upper connection of upright member 304 to water cannon 210 may be a semi-spherical ball and cup connection as described above. In addition, mounted water cannon station 300 may be include a seat 306 for a participant to occupy while operating water cannon 210.

As shown in FIG. 17, an activation point 262 may be coupled to water cannon 210. Activation point 262 may be a foot pedal positioned for easy access by a participant seated in seat 306. In other embodiments, activation point 262 may be an electronic switch, a manual switch, a lever, a handle, a wheel, a pressure pad, a button, or a trigger. For example, activation point 262 may include an optical touch button as discussed with reference to FIG. 2. Water cannon 210 may further include a sight 308. Sight 308 may, for example, be positioned on an upper or side surface of water cannon 210. It is contemplated that water cannon 210 may be most effective at producing a projectile or mass of water or other fluid when cannon 210 is tilted such that open end 224 is pointed at a somewhat upward angle, as shown in FIG. 17. As depicted, fluid level 310 may be above the open end 222 in a loaded configuration in this orientation.

A plurality of water cannons, as described herein, may be used in combination to form an array of water cannons in various configurations. For example, two or more water cannons may be set up as opposing sides, such that the participants of one set of cannons may fire at the participants of an opposing set, and vice versa. In certain embodiments, the water cannons of opposing sides may fire water or other fluid of different colors so that non-adjacent cannons can be designated or recognized as being on a particular side. In other embodiments, a single water cannon station may include multiple barrels or multiple cannons operated by a single participant or a single control mechanism so that a rapid-fire effect may be achieved. Alternatively, a single water cannon may be configured to produce multiple projectiles of water. In such an embodiment, when the control mechanism is activated by a participant, the water cannon may produce multiple water projectiles, either one after another or all at once. When multiple projectiles are produced one after another, the water cannon may continue producing water projectiles until the control mechanism is no longer activated.

In an embodiment, a water cannon system, which includes one or more water cannons, may include a sound system and/or light system as discussed with reference to FIG. 1. For example, the water cannon system may be incorporated into a musical water fountain system. In such an embodiment, the sound system, water cannon system, and/or lighting system may be activated by a participant. The timing of the light, water and sound effects may be coordinated to create a unified effect dependent upon physical acts of the participant(s). For example, an explosive sound and/or flash of light may be initiated in response to a participant's firing of a water cannon. In some embodiments, one or more activation points may be coupled to electrical control devices, such as but not limited to: switches and relays. In such embodiments, the activation point may send an activation signal to the electrical control device. The electrical control device may activate the water cannon, sound system, and/or light system in response to a received activation signal.

Figure 18:
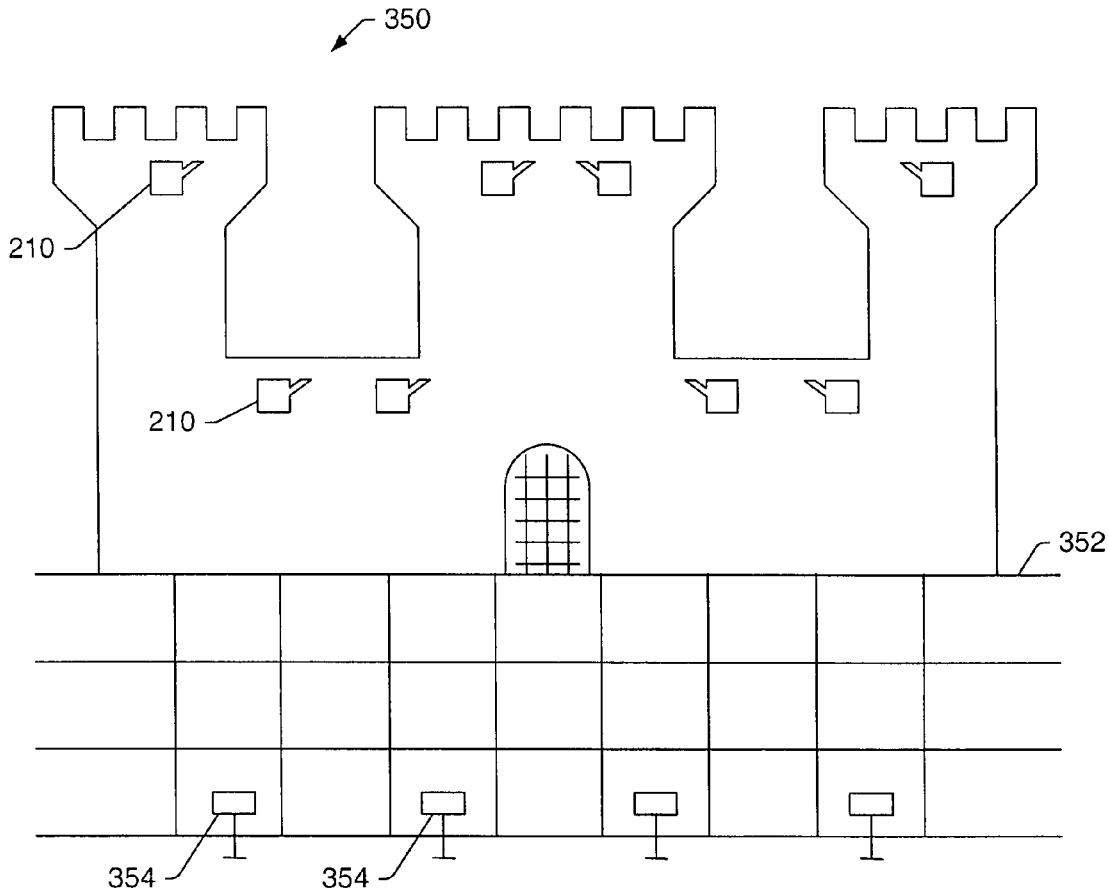
FIG. 18 is a front view of a water structure which includes a water cannon.

FIG. 18 depicts an embodiment of a play structure 350 with a number of associated water cannons. Play structure 350 may be a castle (as depicted in FIG. 18), a boat, a house, a fort, a space ship, or another form selected to conform to a desired theme. A number of water cannons 210 may be placed about the structure. In some embodiments, participants may enter structure 350 and activate water cannons 210 to shoot water at targets outside the structure. A grid 352 may be associated with play structure 350. Grid 352 may include markings which may allow the participants operating water cannons 210 to aim the projectiles. For example, water cannons 210 may include a guide for allowing the participants to aim at a specific region of the grid. When a person enters the specific region of the grid, the participant may activate the water cannon causing the cannon to project water onto the person. Alternatively, the structure may be inaccessible to participants. In such an embodiment, activation points 354 may be remotely coupled to water cannons 210. Activation points 354 may be configured to send an activation signal to a control system, as previously described with reference to FIG. 1. The control system may cause one or more of water cannons 210 to fire a projectile of water in response to the activation signal. Each activation point 354 may activate one or more of water cannons 210 causing a projectile of water to be sent onto grid 352. Activation points 354 may also allow water cannon 210 to be remotely aimed at a specific grid. The participant may therefore "aim" the cannon at a specific region of the grid using activation points 354, and subsequently, fire a projectile from the water cannon at the grid. In an embodiment, the control system may be configured to fire one or more of water cannons 210 randomly, at predetermined intervals, or in response to a trigger event. For example, the control system may be configured to fire one or more water cannons if a participant detector coupled to the control system detects a participant.

IV. Musical Water Fountain System

Figure 19:
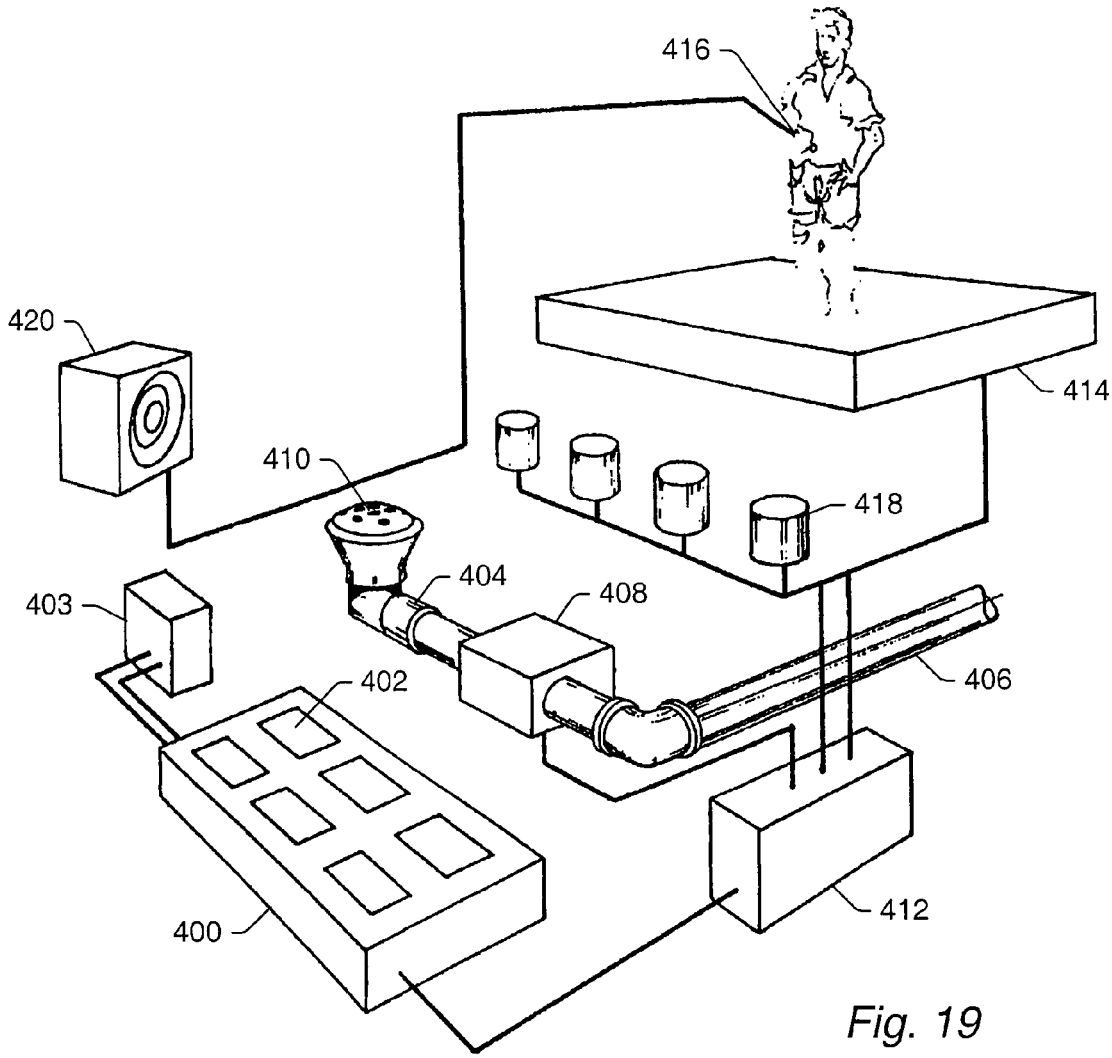
FIG. 19 is a perspective plan view of one embodiment of a musical water fountain system having a sound system.

An embodiment of a musical water fountain system is depicted in FIG. 19. The musical water fountain system may include a sound system 403 for playing musical notes, a water system 404 for spraying water, and a lighting system adapted to activate lights 418. The sound system, water system, and lighting system may be activated by a participant such that the timing of the visual and sound effects created by the musical water fountain system is dependent upon physical acts of the participant.

In an embodiment, the musical water fountain system may include at least one instrument 400. Instrument 400 may be a real instrument (i.e., may actually generate sounds) or may be a structure formed to resemble an instrument (i.e., may only trigger a control system to make sounds). For example, instrument 400 may be an instrument included in an "orchestra." In an embodiment, participants apply a participant signal to activation points 402 to activate the instrument. The participant signal may be applied by the application of pressure, moving a movable activating device, a gesture (e.g., waving a hand), interrupting a light beam, or by other means. Activation points 402 may be configured to respond to the participant signal. In one embodiment, activation point 402 may be configured to respond to a participant's touching of the activation point. Activation point 402 may respond to varying amounts of pressure, from a very light touch to a strong application of pressure. Alternatively, activation point 402 may include a button that may be depressed by the participant to signal the activation point. In another embodiment, activation point 402 may include a movable activation device. For example, activation point 402 may include a lever or a rotatable wheel. The participant may then signal activation point 402 by moving the movable activation device (e.g., reciprocating a lever or rotating a wheel). In another embodiment, activation point 402 may respond to a gesture. For example, activation point 402 may include a motion detector. The participant may then signal activation point 402 by creating movement within a detection area of the motion detector. For example, movement may be created by passing an object (e.g., an elongated member) or a body part (e.g., waving a hand) in front of the motion detector.

Activation points 402 may be located on or in the vicinity of instrument 400. Each instrument 400 may include a plurality of activation points 402. For example, instrument 400 may resemble a piano or a keyboard containing a plurality of keys. Each of the keys may include an activation point 402 (see FIG. 20). Each activation points 402 may be configured to cause sound system 403 to play a different sound. In an embodiment, the musical water fountain system may be adapted to create musical notes. Sound system 403 may be used to increase the volume of and/or alter the sound of a musical notes created by instrument 400. Sound system 403 may include a speaker to increase the volume of a musical note being played. Alternatively, the musical notes may be pre-recorded and generated by sound system 403 in response to a control signal. In such an embodiment, instrument 400 may serve to contain the activation points without actually playing the musical notes. Alternatively, the sound system may make sound effects. For example, the sound system may produce a whistle sound, animal sound, horn sound, etc. In another embodiment, sound system 403 may include a mechanical device configured to produce sounds or musical notes when activation points 402 are signaled.

In one embodiment, each of activation points 402 may be configured to sense a participant signal and generate one or more activation signals in response to the participant signal (as described with reference to FIG. 1). Activation signals generated by the activation point may be electric, hydraulic or pneumatic. Each of activation points 402 may be coupled to a control system 412. Control system 412 may be configured to process the signals from the activation points and send corresponding output signals to the sound system, lighting system, and/or water system. For instance, each time a participant signal is applied to an activation point, a first signal may be relayed to a sound system 403 via control system 412. The first signal may indicate to sound system 403 a particular musical note to play, depending on the activation point from which it originated.

Furthermore, when a participant signals an activation point, a second signal may be relayed to a water system 404 via control system 412. In response to the second signal, water system 404 may produce a water effect. Examples of water effects include, but are not limited to: spraying of water, generation of bubbles, and generation of smoke. The water effect of spraying water may include varying the height, direction, and/or volume of the water produced by the fountain when certain activation points are signaled. The water effect of spraying water may also include producing a projectile of water as previously described. Water system 404 may include at least one conduit 406, at least one flow control device (e.g., valve 408) disposed within conduit 406, and at least one water effect generator 410 connected to conduit 406 for producing a water effect. Conduit 406 may, for example, be made from materials such as PVC or galvanized steel. Valve 408 may be coupled to control system 412. The second signal may be relayed to valve 408 to signal it to open, thereby causing the water effect to be generate by water effect generator 410.

In an embodiment, lights 418 may be located near water system 404. When a participant signals an activation point a third signal may be generated by control system 412. The third signal may be relayed to lighting system, thereby activating selected lights 418 of the lighting system.

It is to be understood that the first, second, and third signals described herein may each be a single signal or may be a series of signals. For instance, an activation point may generate an activation signal and send it to control system 412. In response, control system 412 may transmit a signal to the sound system to produce a musical note. For simplicity, the "first signal" may be taken to include the signal generated by the activation point and the signal relayed by the control system.

Each of activation points 402 may be configured to generate the first, second, and/or third signals each time a participant signal having a predetermined magnitude is sensed by the activation point. For pressure activated activation points, the activation signals may be generated in response to a predetermined amount of force applied to the activation point. For motion-activated activation points, the activation signals may be generated in response to movement having a predetermined speed and/or direction or within a predetermined range.

In some embodiment, each activation point 402 may be associated with only one of the systems (i.e., the sound system, water system, or lighting system). That is, an activation point 402 may be configured to generate either the first, second, or third signal such that a participant may separately activate the sound system, water system, and lighting system by applying a participant signal to different activation points 402. Activation points 402 may include transducers for sensing the magnitude of the signal applied to the activation points. Activation points 402 may selectively generate the first, second, and/or third signals as a function of the magnitude of the signal applied to the activation point. In this manner, a participant may control which of the systems is activated by controlling the magnitude of the signal applied to the activation point. For instance, a pressure sensitive activation point may generate the first signal to activate the sound system in response to sensing a force below a predetermined magnitude, while the activation point may generate the second and/or third signals in response to sensing a force above the predetermined magnitude.

In an embodiment, the sequence in which a participant signals the activation points may affect the resultant sound quality of music generated by sound system 403. For instance, the sequence in which participant signals are applied to activation points 402 may determine the order in which musical notes are played by sound system 403. In an embodiment, various indications may be provided by control system 412 to participants at predetermined times to coordinate the activation of the sound system, water system, and/or lighting system to create a desired visual and audio display. The participant may apply a participant signal to an activation point immediately after receiving an indication at a pre-determined time.

The indication provided to the participants may be supplied by an indicator coupled to control system 412. Control system 412 may activate the indicator at predetermined times or in response to a signal from a proximity sensor located near the activation point. The indication provided by the indicator may be a visual signal (e.g., light), an audio signal (e.g., a tone), or a tactile signal (e.g., a vibration). The indication may be located in the vicinity of the activation point. In an embodiment, a separate indicator may produce an indication to a participant when to apply a participant signal to activation points to separately activate the sound system, lighting system, and water system.

In an embodiment, an indication may be provided by a conductor 416. As described herein, "conductor" may refer to an object, mechanism or person for coordinating the actions of the participants to create desired visual and/or sound effects by activating the sound system, lighting system, and/or water system. Conductor 416 may be an individual that motions and/or speaks to participants to signal the participants when to apply a participant signal to an activation point. Conductor 416 may speak into a microphone, and the volume of the conductor's voice may be increased by a speaker 420 directed toward the participants. Individual speakers 420 may be located proximate each instrument or set of activation points corresponding to an instrument so that conductor 416 may communicate to selected participants at different times. Alternatively, conductor 416 may be a robotic arm for directing the participants. In an embodiment, conductor 416 may be a projected image. For instance, different colors or images may be displayed on the screen at predetermined times, wherein each color or image corresponds to a different instrument, different group of instruments, or different activation points. The display of a particular color or image may indicate to selected participants to apply a participant signal to selected activation points. Platform 414 may support conductor 416. Platform 414 may be at an elevational level above the participants and activation points 402 so that the participants may easily see conductor 416. The control system 412 may be configured to control conductor 416.

Figure 20:
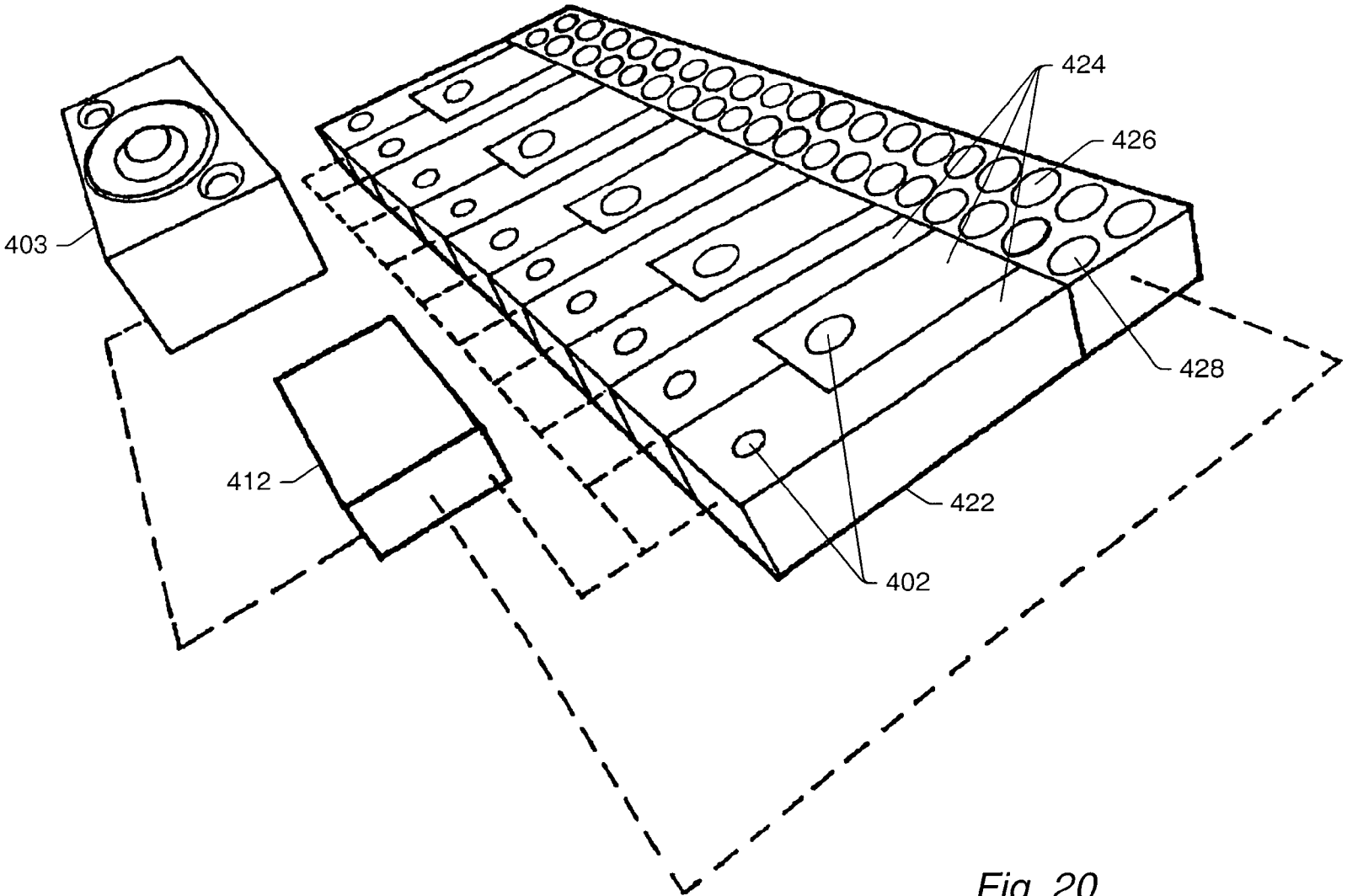
FIG. 20 is a perspective plan view of a keyboard which is an element of a sound system.
Figure 21:
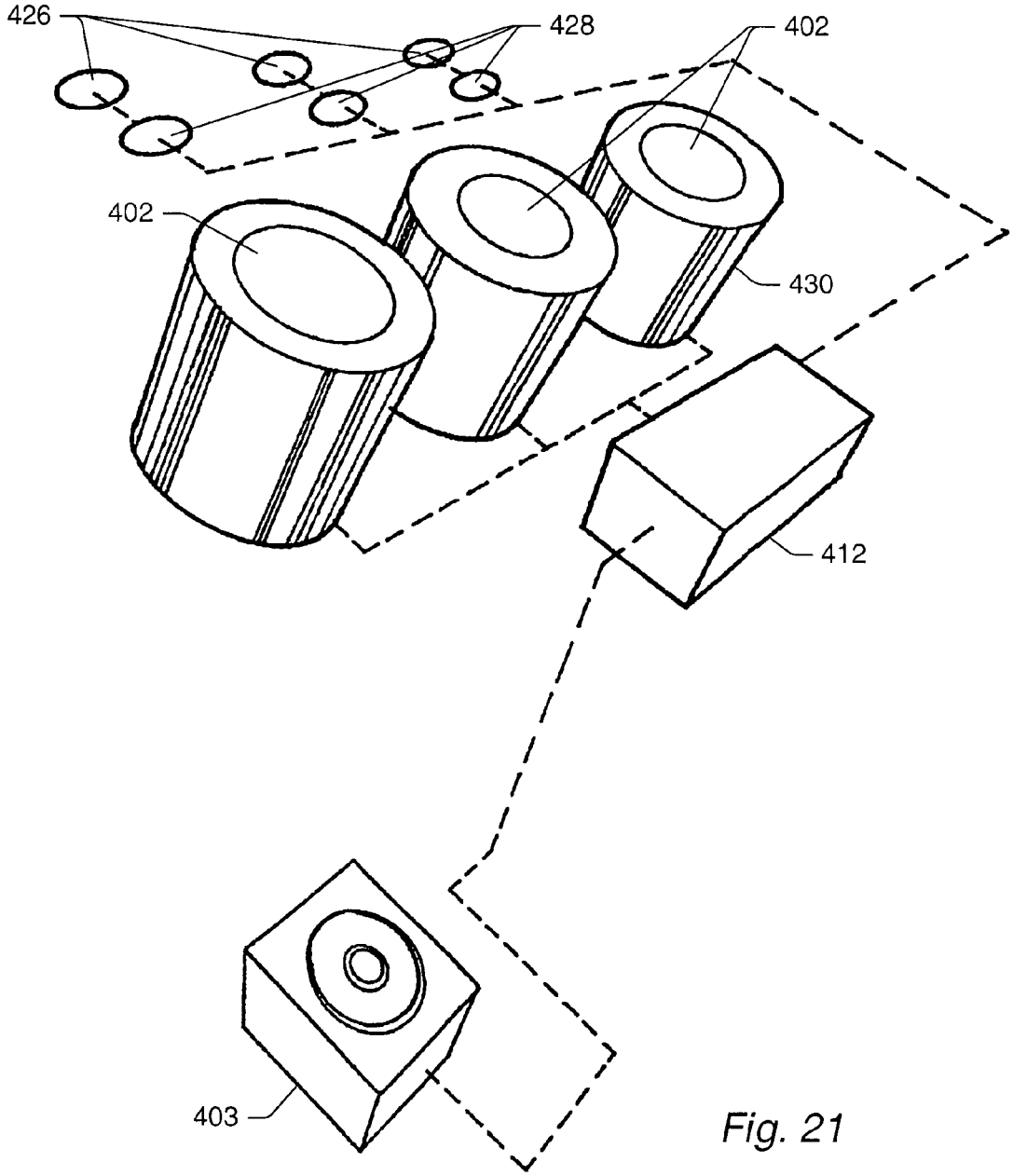
FIG. 21 is a perspective plan view of a drum set which is one element of a sound system.
Figure 22:
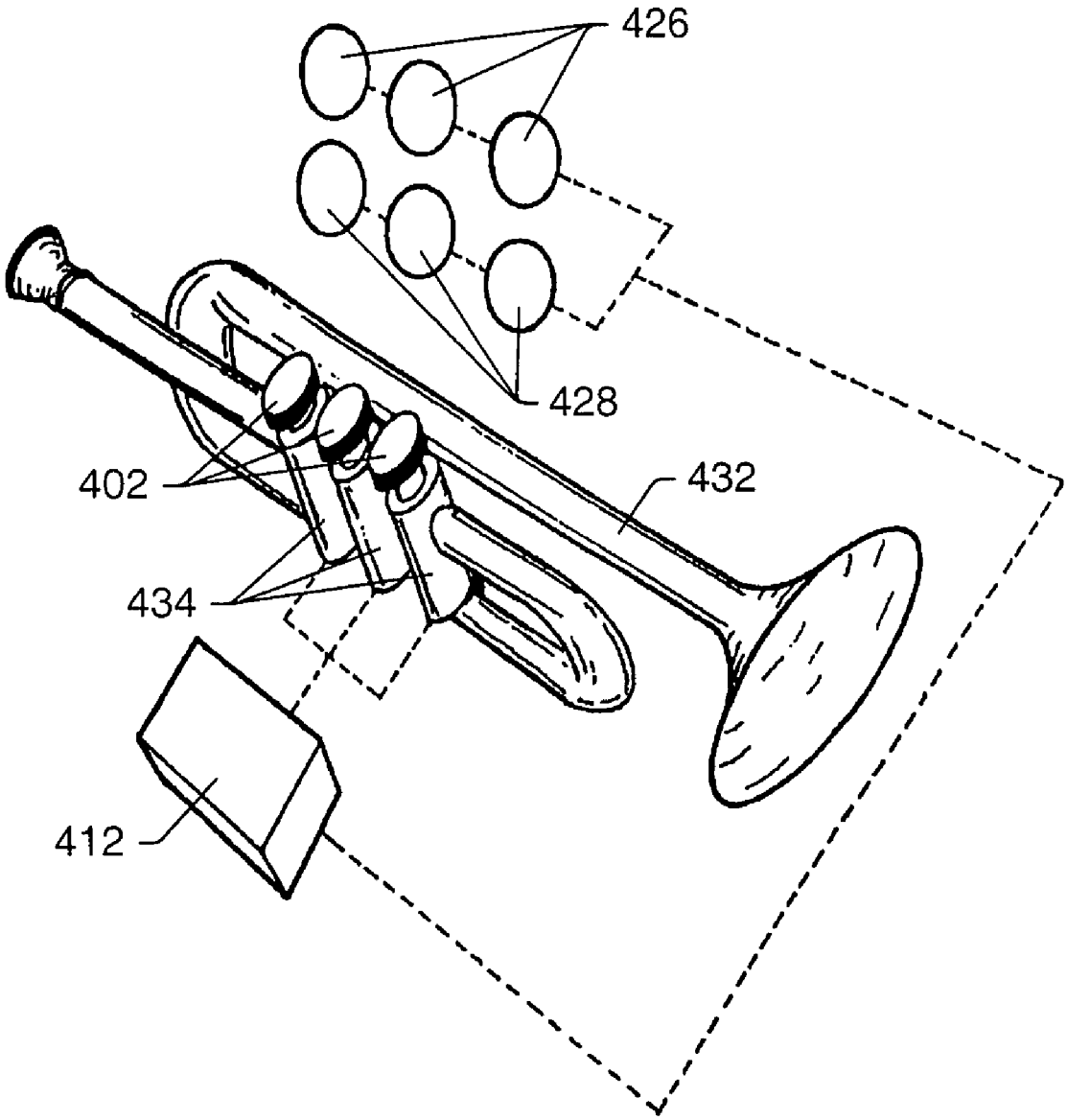
FIG. 22 is a perspective plan view of a trumpet which is one element of a sound system.
Figure 23:
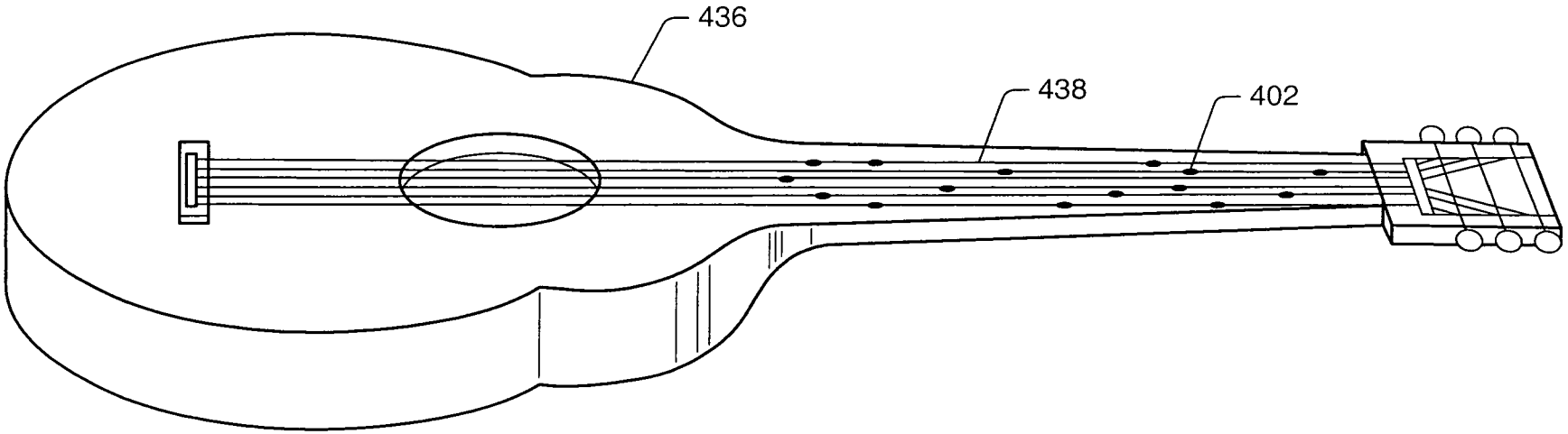
FIG. 23 is a perspective plan view of a guitar which is one element of a sound system.
Figure 24:
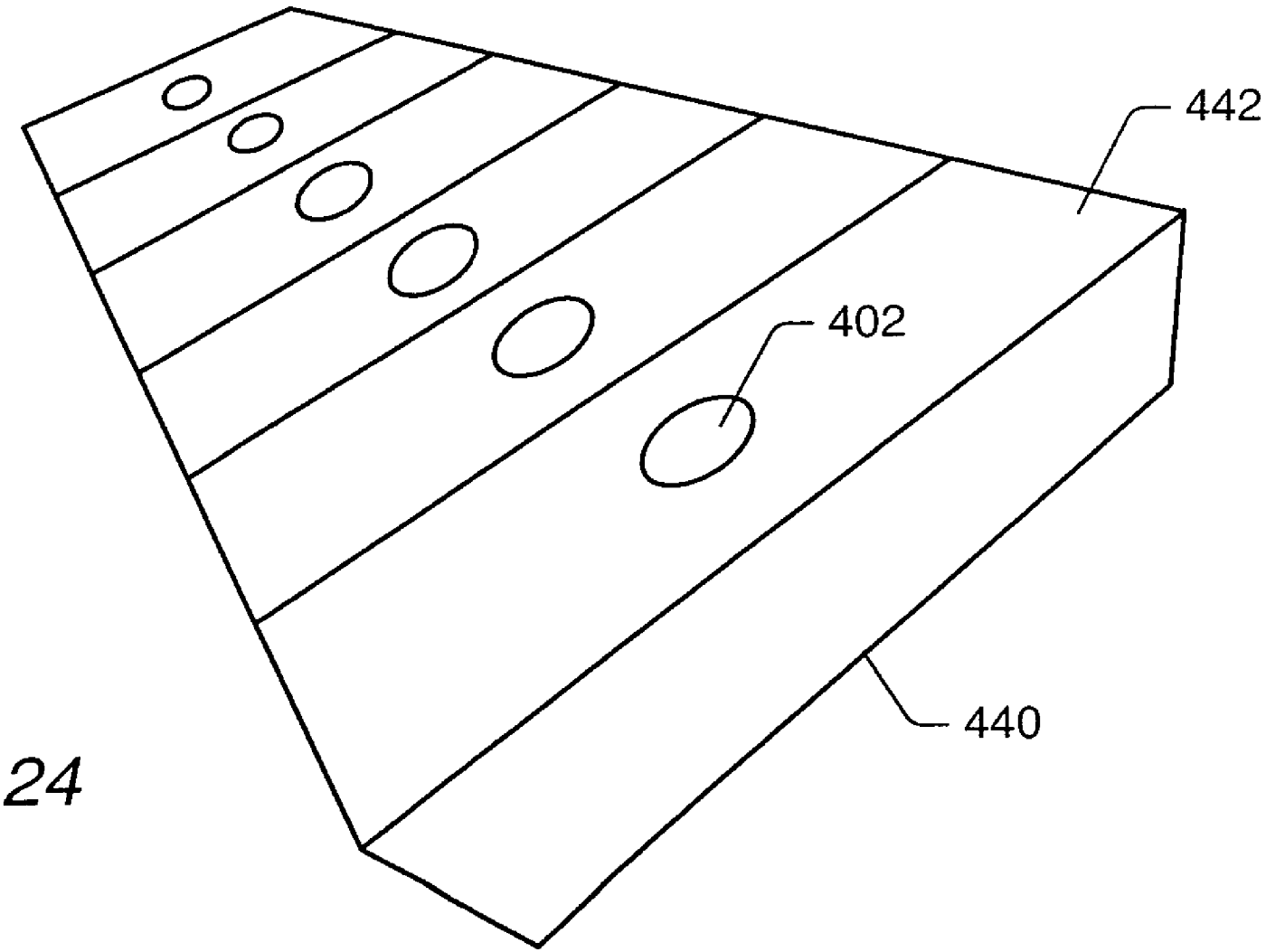
FIG. 24 is a perspective plan view of a xylophone which is one element of a sound system.

FIG. 20 illustrates one type of instrument that may belong to an "orchestra" of instruments associated with a musical water fountain system. The instrument depicted in FIG. 20 is a keyboard 422 having a plurality of keys 424. Each key 424 may include an activation point 402 coupled to control system 412. In an embodiment, keys 424 may be large enough to support a participant standing thereon. In an embodiment, the weight of a participant may serve as a force applied to a pressure sensitive activation point 402 to generate a participant signal. Activation point 402 may sense the force and generate a first signal, second signal, and/or third signal. Control system 412 may relay the first signal to a sound system 403 that may produce a note associated with the activation point (e.g., the keyboard key) contacted. Control system 412 may also send a second signal to a water system to create a water effect and/or a third signal to a light system to create a light effect.

An indicator, for example, lights 426 and 428 may indicate when a participant signal should and should not be applied to a certain activation points. Lights 426 and 428 may be coupled to control system 412, which may activate the lights at appropriate times. One of the lights may indicate when a participant should apply a participant signal to (e.g., stand on) one of activation points 402. The other light may indicate when the participant should discontinue application of the participant signal to the activation point. A musical note or sequence of musical notes may be played by sound system 403 in response to various participant signals applied to various activation points 402. It is to be understood that lights 426 and 428 may be different colors. For example, in one embodiment, light 426 may be red and light 428 may be green. In an alternative embodiment, a single light may be activated to indicate to a participant to apply a participant signal to an activation point. The light may be one of a variety of colors, such as yellow, green, red, blue, purple, and orange. After the participant has applied a participant signal to the activation point the light may be turned off to indicate when the participant should discontinue applying the participant signal to the activation point.

FIGS. 21-24 depict a drum set 430, a trumpet 432 (horn), a guitar 436, and a xylophone 440, respectively. These instruments as well as other instruments may be included in a musical water fountain system "orchestra." They may each operate in a similar manner to keyboard 422 discussed with reference to FIG. 20. For example, activation points 402 may be located on each drum 430, on each playing valve 434 of trumpet 432, on each string 438 of guitar 436, and/or on each key 442 of xylophone 440. A participant may apply a participant signal to an activation point 402 by standing on it or by contacting it with a finger or hand. In an embodiment, activation point 402 may include an electronic switch, a manual switch, a lever, a handle, a wheel, a pressure pad, a button, or a trigger. For example, activation point 402 may include an optical touch button as discussed with reference to FIG. 2.

Figure 25:
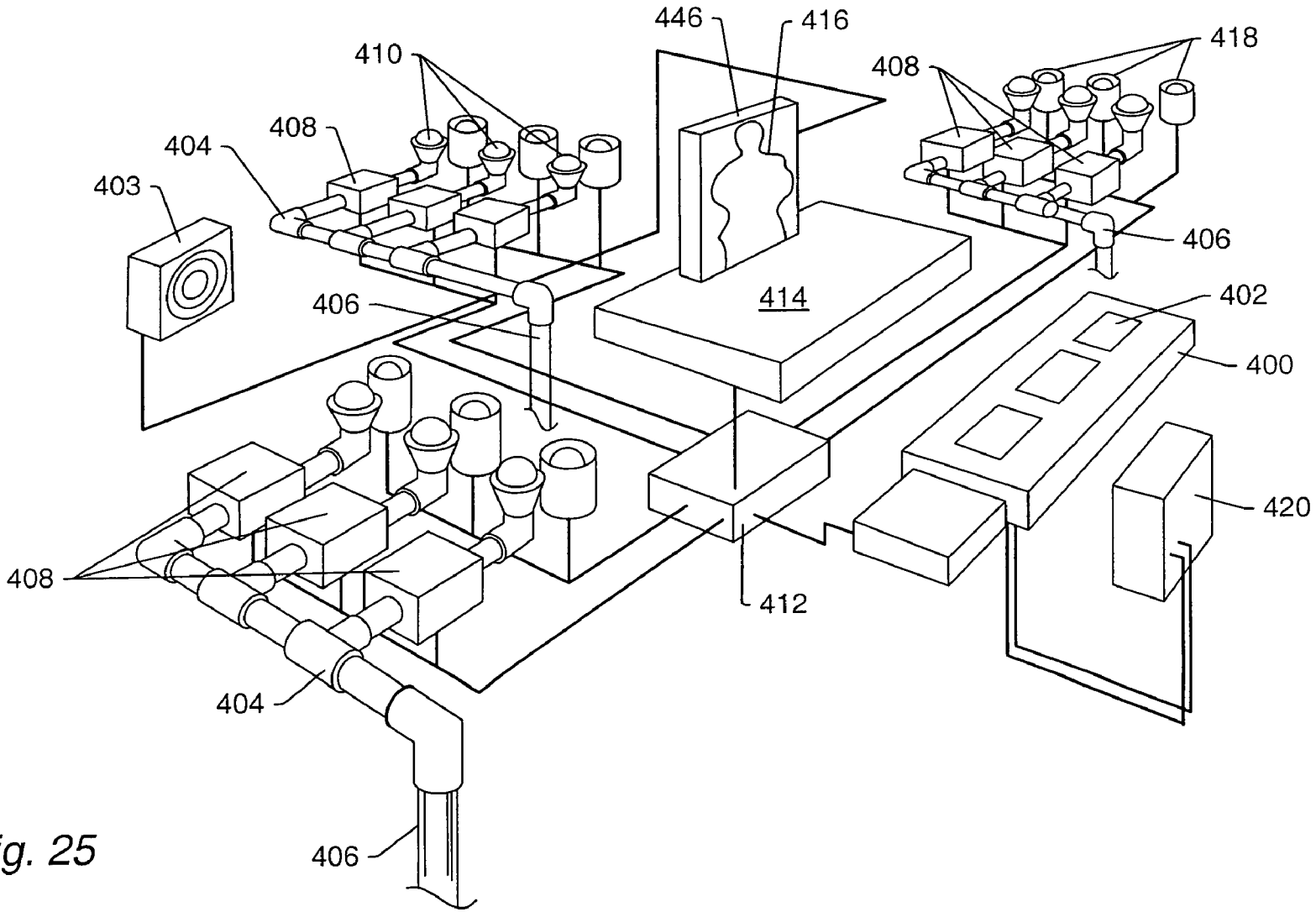
FIG. 25 is a perspective plan view of an embodiment of a musical water fountain system having a plurality of fountain systems.

FIG. 25 illustrates an embodiment of a musical water fountain system having a plurality of water systems 404. Each water system 404 may include a conduit 406, one or more valves 408, and one or more water effect generators 410. Conductor 416 may be an image projected onto a screen 446 (e.g., a television screen or movie screen) so that a person or robot need not be present to conduct music. Screen 446 may be positioned on platform 414 so that participants in the "orchestra" may be able to see it. A participant may apply a participant signal to a particular activation point 402 in response to receiving an indication from an indicator at a pre-determined time. Upon sensing the participant signal, control system 412 may generate one or more signals that may be relayed to sound system 403, one or more of water systems 404, and/or one or more lights 418 of the light systems. In response to receiving a signal from control system 412, sound system 403 may produce a musical note, one or more of valves 408 may open to create a water effect, and/or certain lights 418 may be turned on. The lights activated may be in close proximity to the fountain system generating the water effect. The cooperative effort of the participants at each of the individual instruments may create a pleasant musical tune and/or visual display.

In an embodiment, control system 412 may receive activation signals generated in response to the participant signals applied at activation points 402. Control system 412 may then indicates to sound system 403 the appropriate time to play a particular note. Control system 412 may control operation of sound system 403 such that the resultant music is affected by the presence or absences of participant signals and the order in which such signals are relayed to control system 412. In this manner, whether or not a participant applies a signal to an activation point 402 and the time at which a participant applies a signal to the activation point may affect the music produced by sound system 403. Control system 412 may receive activation signals from activation points 402 and delay playing of sounds by sound system 403 for a predetermined time (e.g., ten seconds or more). Alternatively, sound system 403 may play a musical note substantially immediately with application of a participant signal. In an alternative embodiment, control system 412 may be programmed to cause a determined sequence of notes to be produced at a particular time so that a song is correctly played even when the participants do not contact activation points 402 at appropriate times. In an embodiment, control system 412 may be programmed to cause a song to play after a predetermined time with no participant signal.

In some embodiments, one or more activation points may be coupled to electrical control devices, such as but not limited to: switches and relays. In such embodiments, an activation point may send an activation signal to the electrical control device. The electrical control device may activate the water system, sound system, and/or light system in response to a received activation signal.

In an embodiment, a music water fountain system may include a plurality of different activation points for producing various sound, light, and/or water effects. Each of the activation points may activate an instrument, or one or more notes of an instrument when a participant signal is applied to the activation point. A conductor may be used to signal the activation of the instruments or of specific notes of the instruments. A group of participants may respond to the conductor's indications such that a musical tune may be produced.

In another embodiment, water from a musical water fountain system may be used to create at least some of the sounds produced by the musical water fountain system. For example, a plurality of activation points may be disposed about a musical water fountain system. The activation points may be coupled to a water system. The water system may include one or more water cannons as described above. In response to a participant signal, a control system may cause water to be fired at a sound-producing device. The water may be fired as a stream or a projectile. The impact of the water against the sound-producing device may produce a sound. For example, the sound producing device may be a series of gongs which, when struck with water may produce a ringing sound. Other sound devices, which may produce a sound when contacted with water, include but are not limited to: drums, bells, tubes, or chimes. It is envisioned that any percussive instrument may be used. In certain embodiments, non-percussive instruments, such as stringed instruments or wind instruments may be used. In such embodiments, the water may impact a mechanism configured to activate the instrument. For example, water may activate a bellow to sound a wind instrument, or a movable clapper, hammer or pick mechanism to activate a stringed instrument.

In another embodiment, the musical water fountain system may include a bubble organ. The bubble organ may include a series of pipes arranged in a manner typical of a pipe organ. In an embodiment, the pipes may be made of a substantially transparent material. A series of activation points may be disposed about the bubble organ. In response to a participant signal, the bubble organ may produce sound while simultaneously producing a water effect. The water effect may include the production of bubbles. The bubbles may be produced such that they emanate out of a top portion of the pipes. A lighting system may also be coupled to the pipes such that the participant signal activates one or more lights such that the bubbles appear to be colored as they move through the pipe.

In another embodiment, the musical fountain may be constructed in the form of a walkway. A plurality of activation points may be arranged on the surface of the walkway such that participants may step on the activation points. The activation points may be configured to respond to the weight of the participants. As the participants move along the walkway, they may contact the activation points such that a musical and/or a water effect is produced. For example, when a participant steps on an activation point, a portion of a song may be played by a sound system of the music water fountain system. Additionally, a water effect, such as a stream of water, may be produced.

V. Interactive Water Game

Figure 26:
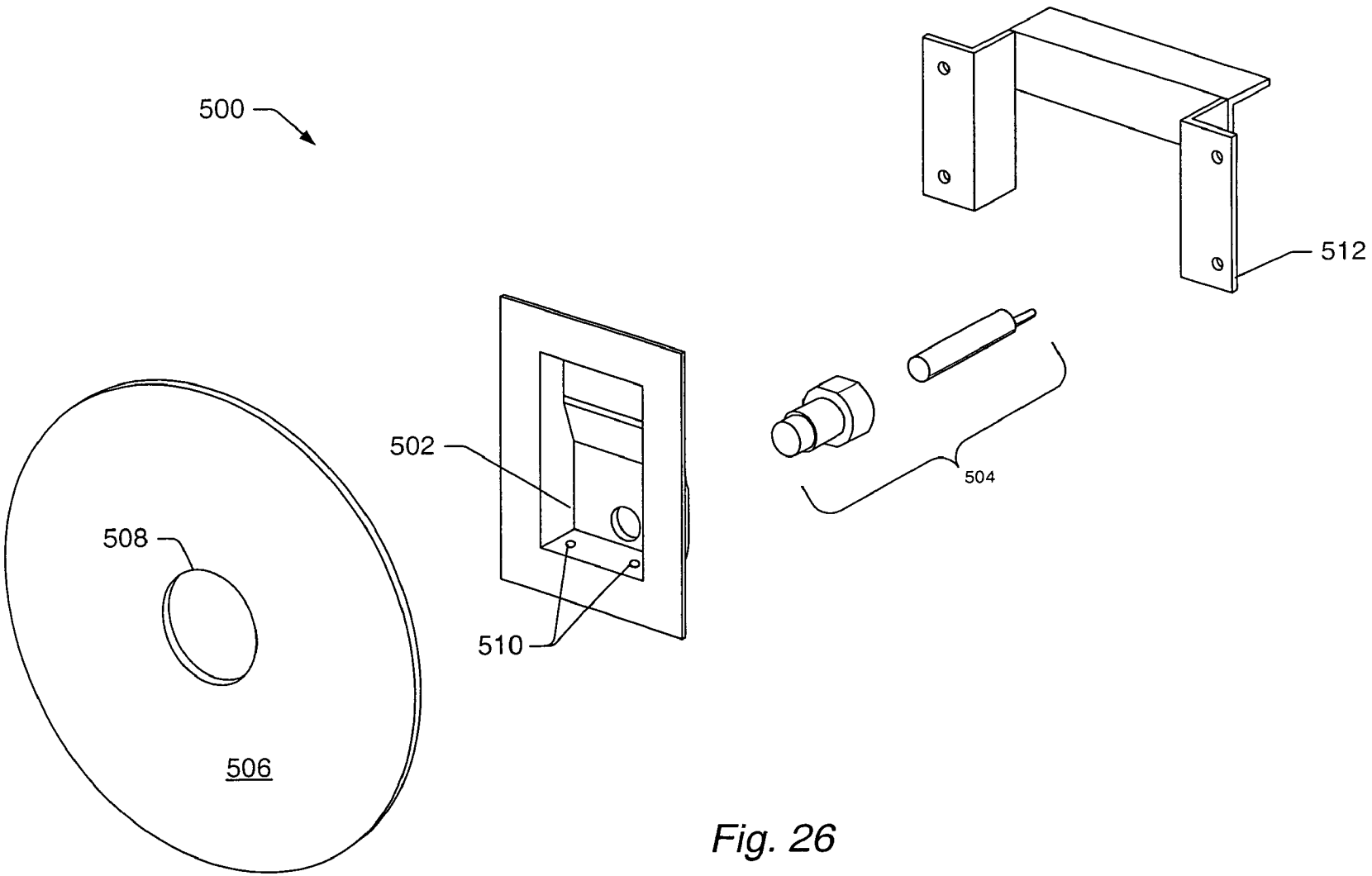
FIG. 26 is an exploded perspective view of an embodiment of a water target device having a liquid level sensor.

Turning to FIG. 26, an exploded perspective up view of an embodiment of a water target 500 is shown. Water target 500 may include a water retention area 502, an associated liquid sensor 504, and a mounting bracket 512. In an embodiment, water target 500 may be incorporated into an interactive water game system. An interactive water game system may include at least one water system, and at least one control system. The interactive water game system may be arranged so that participants may interact with the game system in competition with one another, or to accomplish a task. For example, the participants may interact with the game system to trigger an event such as a water effect, sound effect, and/or light effect as previously described. An event triggered by a first participant may include a water effect wherein water may be directed toward a second participant. In such a case, the first and second participants may compete with one another to attempt to get each other wet via one or more triggered water effects.

In an embodiment, water target 500 may include a target area 506 with one or more water capture openings 508. Water capture openings 508 may provide a passage through target area 506 into water retention area 502. If water target 500 is hit, water may pass through water capture opening 508 into water retention area 502. The water entering water retention area 502 may cause a change in a monitored electrical property of liquid sensor 504. For example, the water may cause a change in capacitance, or resistance of liquid sensor 504. A suitable capacitive liquid sensor system may be purchased from the Balluff Inc. of Florence, Ky. The change in the monitored electrical property may be registered as an activation signal by the control system. One or more drains 510 may be provided in water retention area 502 to allow captured water to drain. By draining the water from water retention area 502, the monitored electrical property may be returned to a "normal" state. Thus, water target 500 may be reset, and prepared to register subsequent hits.

In an embodiment, one or more water targets 500 may be coupled to a musical water fountain system. In such an embodiment, water target 500 may act as an activation point. The musical water fountain system may include one or more water effect generators (e.g., nozzles, water cannons, etc.) moveably mounted for participant interaction. A participant may direct water from the one or more water effect generators toward water target 500. If the participant hits water target 500, an activation signal may be sent by the water target to a control system. The control system may then send one or more control signals to the musical water fountain system to trigger one or more water effects, sound effects, and/or light effects.

Figure 27:
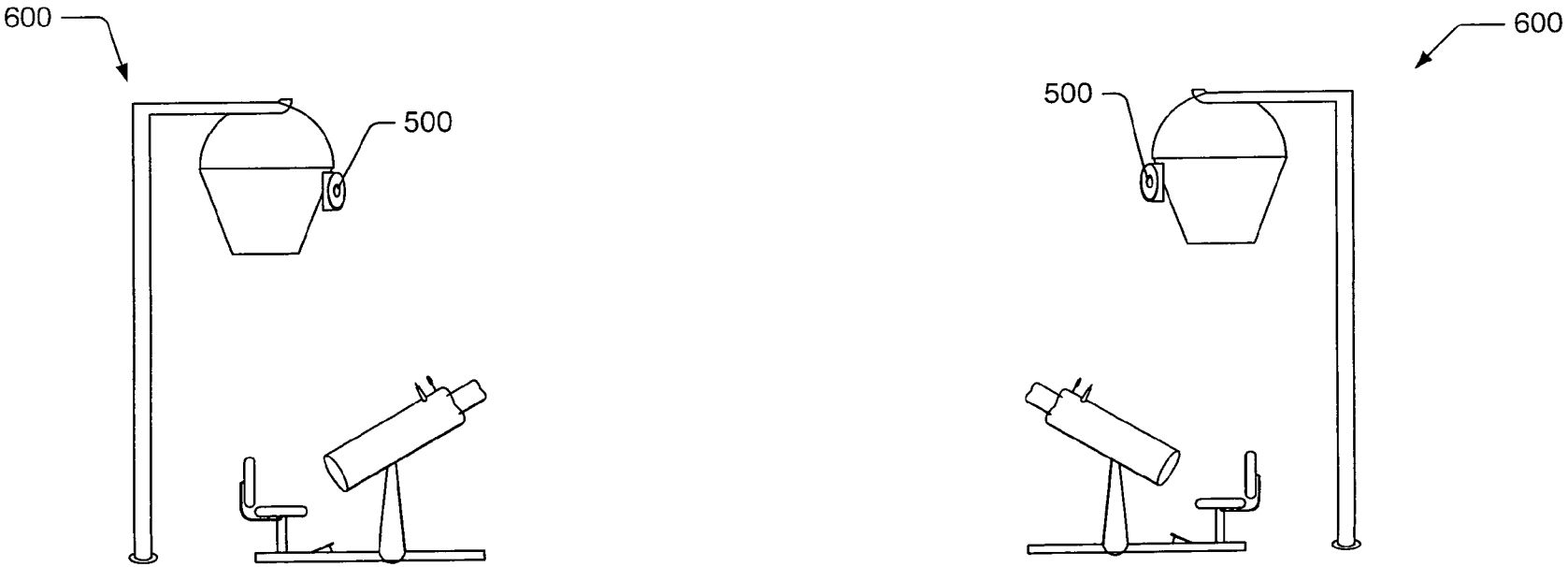
FIG. 27 is a side view of an embodiment of an interactive water game using water targets.

In other embodiments, one or more water targets 500 may be associated with a play structure. Again, water targets 500 may act as activation points. A participant may direct water from one or more water effect generators (e.g., nozzles, water cannons, etc.) toward one or more water targets 500. If a participant hits one of water targets 500, the water target may send an activation signal to a control system. The control system may be coupled to one or more water systems associated with the play structure. The control system may send one or more control signals to the water systems to generate one or more water effects. In a competitive arrangement of such a system, the one or more water effects generated may be directed toward another participant. For example, each participant may be seated at a water cannon station as described with reference to FIGS. 14-18. Each participant may fire water projectiles in an attempt to strike one or more water targets 500 associated with the other participant's water cannon station. If a first participant is successful in striking a water target associated with a second participant's water cannon station, the control system may initiate a water effect directed toward the second participant. For example, the second participant's water cannon may "backfire." That is, some or all of the water in the reservoir of the second participant's water cannon may be directed out of the back of the water cannon onto the second participant. In another embodiment, another water effect generator may be directed toward the second participant. For example, a rotatable water container or "tipping bucket" water feature 600 (as depicted in FIG. 27) may tip onto the second participant. It is anticipated that any water effect that may be safely direct toward a participant may be associated with such a system.

In an embodiment, liquid sensor 504 may include a capacitive liquid sensor, or other liquid sensor such as is known in the art. An advantage of a capacitive liquid sensor may be its relatively low installation and operating costs as compared with mechanical liquid sensing systems.

Each of the embodiments discussed above may be used individually or combined with any one or more of the other embodiments. Other rides or amusement devices, such as may be found in a wet or dry amusement park, may also be present. A control system as discussed concerning FIG. 1 may relate one or more of the devices with one or more other amusement devices or rides such that the amusement devices or rides may trigger events associated with the devices described herein. For example, a control system may fire a water cannon as disclosed herein as an amusement ride begins, ends, or passes a predefined location.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A method of operating a water system configured to produce a water effect, comprising:

applying at least one participant signal to an activation point, wherein the activation point comprises an optical touch button;

producing at least one activation signal in response to the at least one participant signal;

sending the at least one activation signal to a control system;

producing at least one water system control signal in the control system in response to the at least one received activation signal;

sending the at least one water system control signal from the control system to the water system, wherein the water system produces a water effect in response to the at least one water system control signal;

producing at least one water system control signal in the control system in the absence of an activation signal; and sending the water system control signal produced in the absence of an activation signal from the control system to the water system to produce a water effect;

wherein producing the water system control signal in the control system in the absence of an activation signal comprises producing the water system control signal when an activation signal is not received for a predetermined amount of time.

2. The method of claim 1, wherein the water system comprises a water effect generator, a conduit for carrying water to the water effect generator, and a flow control device disposed in the conduit, the flow control device configured to control the flow of water through the conduit, and further comprising operating the flow control device in response to the water system control signals generated by the control system.

3. The method of claim 1, further comprising:

producing an indicator control signal from the control system;

sending the indicator control signal to an indicator, wherein the indicator is coupled to the control system and positioned proximate to the activation point, sending an indication to a participant to apply a participant signal with the indicator in response to the received indictor control signal.

4. The method of claim 1, wherein the water system comprises a plurality of activation points for detecting participant signals during use, wherein at least one of the additional activation points comprises an optical touch button, and wherein the water system is configured to produce a plurality of water effects; and the method further comprises:

producing different water system control signals in response to activation signals received from different activation points;

sending the different water control system signals to the water system, wherein the water system is configured to produce different water effects in response to different water system control system signals.

5. The method of claim 1, wherein the water system comprises a participant detection system coupled to the control system; and the method further comprises:

detecting the presence of a participant proximate to the water system with the participant detection system;

generating a detection signal in response to the presence of a participant proximate to the water system, and producing water system control signals in response to the detection signal.

6. The method of claim 1, wherein the water system comprises a participant detection system coupled to the control system; and the method further comprises:

detecting the presence of a participant proximate to the water system with the participant detection system;

generating a detection signal in response to the presence of a participant proximate to the water system, producing water system control signals in response to a detection signal; and inhibiting the generation of water system control signals in the absence of a detection signal.

7. The method of claim 1, wherein the control system comprises a programmable logic controller.

8. A method of operating an water amusement device, the water amusement device comprising a water system configured to produce a water effect and a sound system configured to produce a sound effect, comprising:

applying one or more participant signals to an activation point, wherein the activation point comprises an optical touch button;

producing an activation signal in response to the applied participant signal;

wherein the water system produces the water effect in response to the activation signal; and wherein the sound system produces the sound effect in response to the activation signal;

wherein the water amusement device further comprises a control system coupled to the water system and the sound system; and a participant detection system coupled to the control system, the method further comprising:

detecting the presence of a participant proximate to the water system with the participant detection system;

generating a detection signal in response to the presence of the participant proximate to the water system, and producing water system control signal and the sound system control signal in response to the detection signal.

9. The method of claim 8, wherein the water amusement device further comprises a control system coupled to the activation point, the water system and the sound system.

10. The method of claim 8, wherein the water amusement device further comprises a control system coupled to the activation point, the water system and the sound system; the method further comprising producing a water system control signal and a sound system control signal in the control system in the absence of an activation signal;

sending the water system control signal produced in the absence of an activation signal from the control system to the water system to produce a water effect;

sending the sound system control signal produced in the absence of an activation signal from the control system to the sound system to produce a sound effect.

11. The method of claim 8, wherein the water amusement device further comprises a control system coupled to the activation point, the water system and the sound system;

the method further comprising:

producing an indicator control signal from the control system;

sending the indicator control signal to an indicator, wherein the indicator is coupled to the control system and positioned proximate to the activation point, sending an indication to a participant to apply a participant signal with the indicator in response to the received indictor control signal.

* * * * *